US010266928B2

(12) United States Patent
Toda et al.

(10) Patent No.: US 10,266,928 B2
(45) Date of Patent: Apr. 23, 2019

(54) METHOD FOR PRODUCING A COLD-ROLLED STEEL SHEET

(71) Applicant: NIPPON STEEL & SUMITOMO METAL CORPORATION, Tokyo (JP)

(72) Inventors: Yuri Toda, Tokyo (JP); Riki Okamoto, Tokyo (JP); Nobuhiro Fujita, Tokyo (JP); Kohichi Sano, Tokyo (JP); Hiroshi Yoshida, Tokyo (JP); Toshio Ogawa, Tokyo (JP); Kunio Hayashi, Tokyo (JP); Kazuaki Nakano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 255 days.

(21) Appl. No.: 15/398,446

(22) Filed: Jan. 4, 2017

(65) Prior Publication Data

US 2017/0183756 A1 Jun. 29, 2017

Related U.S. Application Data

(62) Division of application No. 14/118,968, filed as application No. PCT/JP2012/063261 on May 24, 2012, now Pat. No. 9,567,658.

(30) Foreign Application Priority Data

May 25, 2011 (JP) ..... 2011-117432

(51) Int. Cl.

| | |
|---|---|
| ***C21D 9/46*** | (2006.01) |
| ***C21D 8/02*** | (2006.01) |
| ***C22C 38/38*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/60*** | (2006.01) |
| ***C22C 38/22*** | (2006.01) |
| ***C22C 38/28*** | (2006.01) |
| ***C22C 38/32*** | (2006.01) |
| ***C21D 8/00*** | (2006.01) |

(52) U.S. Cl.

CPC ..... *C22C 38/38* (2013.01); *C21D 8/005* (2013.01); *C21D 8/02* (2013.01); *C21D 8/0205* (2013.01); *C21D 8/0226* (2013.01); *C21D 8/0236* (2013.01); *C21D 8/0263* (2013.01); *C21D 8/0273* (2013.01); *C21D 8/0278* (2013.01); *C21D 9/46* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/105* (2013.01); *C22C 38/12* (2013.01); *C22C 38/14* (2013.01); *C22C 38/16* (2013.01); *C22C 38/18* (2013.01); *C22C 38/22* (2013.01); *C22C 38/28* (2013.01); *C22C 38/32* (2013.01); *C22C 38/60* (2013.01); *C21D 2211/002* (2013.01); *C21D 2211/005* (2013.01); *C21D 2211/008* (2013.01); *Y10T 428/12799* (2015.01)

(58) Field of Classification Search

None

See application file for complete search history.

(56) References Cited

U.S. PATENT DOCUMENTS

| | | | |
|---|---|---|---|
| 4,898,583 | A | 2/1990 | Borsanyi et al. |
| 5,539,425 | A | 7/1996 | Kamaguchi et al. |
| 7,503,984 | B2 | 3/2009 | Yokoi et al. |
| 2003/0047256 | A1 | 3/2003 | Kami et al. |
| 2003/0116238 | A1 | 6/2003 | Fujita et al. |
| 2003/0131909 | A1 | 7/2003 | Yoshinaga et al. |

(Continued)

FOREIGN PATENT DOCUMENTS

| | | | |
|---|---|---|---|
| CA | 2 422 753 | A1 | 3/2003 |
| CN | 1386143 | A | 12/2002 |

(Continued)

OTHER PUBLICATIONS

Canadian Office Action dated May 27, 2015, issued in corresponding Canadian Patent Application No. 2,843,186.

(Continued)

*Primary Examiner* — Deborah Yee

(74) *Attorney, Agent, or Firm* — Birch, Stewart, Kolasch & Birch, LLP

(57) ABSTRACT

A cold-rolled steel sheet satisfies that an average pole density of an orientation group of {100}<011> to {223}<110> is 1.0 to 5.0, a pole density of a crystal orientation {332}<113> is 1.0 to 4.0, a Lankford-value rC in a direction perpendicular to a rolling direction is 0.70 to 1.50, and a Lankford-value r30 in a direction making an angle of 30° with the rolling direction is 0.70 to 1.50. Moreover, the cold-rolled steel sheet includes, as a metallographic structure, by area %, a ferrite and a bainite of 30% to 99% in total and a martensite of 1% to 70%.

13 Claims, No Drawings

(56) References Cited

U.S. PATENT DOCUMENTS

| | | | |
|---|---|---|---|
| 2003/0145920 | A1 | 8/2003 | Kami et al. |
| 2003/0188811 | A1 | 10/2003 | Kami et al. |
| 2003/0196735 | A1 | 10/2003 | Sugiura et al. |
| 2004/0069382 | A1 | 4/2004 | Yokoi et al. |
| 2004/0238081 | A1 | 12/2004 | Yoshinaga et al. |
| 2006/0096678 | A1 | 5/2006 | Kariya |
| 2007/0089814 | A1 | 4/2007 | Sugiura et al. |
| 2008/0008901 | A1 | 1/2008 | Sugiura et al. |
| 2008/0202639 | A1 | 8/2008 | Tomida et al. |
| 2009/0014095 | A1 | 1/2009 | Mukai et al. |
| 2009/0223609 | A1 | 9/2009 | Hakomori et al. |
| 2010/0047617 | A1 | 2/2010 | Sugiura et al. |
| 2010/0108201 | A1 | 5/2010 | Yokoi et al. |
| 2010/0209283 | A1 | 8/2010 | Tomida et al. |
| 2010/0263767 | A1 | 10/2010 | Tomida et al. |
| 2011/0036465 | A1 | 2/2011 | Kawasaki et al. |
| 2013/0153091 | A1 | 6/2013 | Fujita et al. |
| 2013/0323112 | A1 | 12/2013 | Okamoto et al. |
| 2014/0000765 | A1 | 1/2014 | Nozaki |
| 2014/0110022 | A1 | 4/2014 | Sano et al. |

FOREIGN PATENT DOCUMENTS

| | | | |
|---|---|---|---|
| CN | 1401012 | A | 3/2003 |
| CN | 1462317 | | 12/2003 |
| CN | 1492938 | A | 4/2004 |
| CN | 1547620 | A | 11/2004 |
| CN | 1599802 | A | 3/2005 |
| CN | 1989267 | A | 6/2007 |
| CN | 101535519 | | 9/2009 |
| CN | 101646794 | A | 2/2010 |
| CN | 103476960 | | 12/2013 |
| EP | 1 327 695 | A1 | 7/2003 |
| EP | 1 362 930 | A1 | 11/2003 |
| EP | 1 193 322 | B1 | 7/2006 |
| EP | 2088218 | | 8/2009 |
| EP | 2 264 206 | A1 | 12/2010 |
| EP | 2 700 728 | A1 | 2/2014 |
| JP | 61-217529 | A | 9/1986 |
| JP | 2-19173 | A | 1/1990 |
| JP | 3-2942 | A | 1/1991 |
| JP | 5-14764 | A | 1/1993 |
| JP | 5-59429 | A | 3/1993 |
| JP | 2002-53935 | A | 2/2002 |
| JP | 2004-250744 | | 2/2002 |
| JP | 2003-113440 | | 4/2003 |
| JP | 2004-263270 | A | 9/2004 |
| JP | 2005-256020 | | 9/2005 |
| JP | 2005-314798 | A | 11/2005 |
| JP | 2006-022349 | | 1/2006 |
| JP | 2006-193819 | A | 7/2006 |
| JP | 2007-146275 | | 6/2007 |
| JP | 2007-162078 | A | 6/2007 |
| JP | 2007-291500 | A | 11/2007 |
| JP | 2007-291514 | | 11/2007 |
| JP | 2008-189978 | A | 8/2008 |
| JP | 2009-013478 | | 1/2009 |
| JP | 2009-30159 | A | 2/2009 |
| JP | 2009-114523 | | 5/2009 |
| JP | 2009-132981 | | 6/2009 |
| JP | 2009-249733 | A | 10/2009 |
| JP | 2009-263718 | | 11/2009 |
| JP | 2010-053387 | | 3/2010 |
| JP | 2010-59452 | A | 3/2010 |
| JP | 5-488764 | B | 5/2014 |
| KR | 10-2010-0101691 | | 9/2010 |
| RU | 2294386 | | 2/2007 |
| RU | 2312163 | | 12/2007 |
| RU | 2323983 | | 5/2008 |
| RU | 2403291 | | 11/2010 |
| TW | 550296 | B | 9/2003 |
| TW | I236503 | B | 7/2005 |
| TW | 201114921 | | 5/2011 |
| WO | WO 2007/015541 | A1 | 2/2007 |
| WO | WO 2008/123366 | A1 | 10/2008 |
| WO | WO 2009/099251 | A1 | 8/2009 |
| WO | WO 2011/0148490 | | 12/2011 |
| WO | WO 2012/014926 | | 2/2012 |

OTHER PUBLICATIONS

Chinese Office Action and Search Report dated Dec. 16, 2014, for Chinese Application No. 201280018923.9.

Chinese Office Action and Search Report, dated Mar. 24, 2015, for Chinese Application No. 201280036958.5, with a partial English translation.

European Search Report dated Dec. 1, 2014, issued in corresponding European Patent Application No. 12774097.5.

International Search Report issued in PCT/JP2012/060634, dated Jul. 24, 2012, including English translation.

International Search Report issued in PCT/JP2012/069259 dated Oct. 23, 2012.

Mexican Office Action dated Jun. 1, 2015, for Mexican Application No. MX/a/2013/012116, including a partial English translation.

Taiwanese Office Action for Appl. No. 101127384 dated Sep. 9, 2014.

Taiwanese Office Action for Taiwanese Application No. 101114134 dated Feb. 12, 2014.

Takahashi, "Development of High Strength Steels for Automobiles", Nippon Steel Technical Report, No. 88, Jul. 2003, pp. 2-6, including an English translation (11 pages total).

Written Opinion of the International Searching Authority issued in PCT/JP2012/060634, dated Jul. 24, 2012, including an English translation.

Written Opinion of the International Searching Authority issued in PCT/JP2012/069259 dated Oct. 23, 2012, including an English translation.

Decision to Grant dated Apr. 22, 2015 issued in corresponding Russian Application No. 2013151463.

European Search Report, dated Nov. 5, 2014, for European Application No. 12763971.4.

European Search Report, dated Sep. 28, 2015, for European Application No. 12817554.4.

International Search Report dated Aug. 21, 2012 issued in corresponding PCT Application No. PCT/JP2012/063261, with English translation.

International Search Report dated Aug. 21, 2012 issued in corresponding PCT Application No. PCT/JP2012/063273, with English translation.

International Search Report, dated Jun. 26, 2012, for International Application No. PCT/JP2012/058199, including English translation.

Japanese Office Action dated Aug. 27, 2013 from corresponding JP Application No. 2011-032465, with English translation.

Katoh et al., "Development of New High-Strength Hot-Rolled Steel Sheets", Steel-manufacturing studies (seitetu kenkyu), vol. 312, pp. 41-50, 1984, with English abstract.

Kishida, "High Strength Steel Sheets for Light Weight Vehicle", Nippon Steel Corporation Technical Report, No. 371, pp. 13-17, 1999, with English abstract.

Matsumura et al., "Enhancement of Elongation by Retained Austenite in Intercritical Annealed 0.4C-1.5Si-0.8Mn Steel", Transactions ISIJ, vol. 27, pp. 570-579, 1987.

NFG Catalog, Nakayama Steel Works, Ltd., Available at http://www.nakayama-steel.co.jp/menu/product/nfg.html [with Machine Translation].

Notice of Allowance dated Jan. 19, 2015 issued in corresponding Russian Application No. 2013151804.

Notice of Allowance dated Mar. 25, 2016, in corresponding Korean Application No. KR 10-2013-7030692.

Office Action dated Jan. 13, 2015 issued in corresponding Chinese Application No. 201280024587.9.

Office Action dated Jan. 16, 2015 issued in corresponding Chinese Application No. 201280024780.2.

Office Action dated Jan. 17, 2014 from corresponding Taiwanese Application No. 101118534 with English translation.

(56) References Cited

OTHER PUBLICATIONS

Office Action issued on Dec. 18, 2015 in corresponding Mexican Application No. MX/a/2013/013064.
Search Report dated Nov. 26, 2014 from corresponding European Application No. 12789266.9.
Sugimoto et al, "Stretch-flangeabifity of High-strength TRIP Type Bainite Sheet Steel", ISIJ International, vol. 40, No. 9, pp. 920-926, 2000.
Takahashi et al., "High Strength Hot-rolled Steel Sheets for Automobiles", Nippon Steel Corporation Technical Report, No. 378, pp. 7-11, 2003, with English abstract.
U.S. Notice of Allowance, dated Aug. 16, 2016, for U.S. Appl. No. 14/235,009.
U.S. Office Action, dated Feb. 4, 2016, for U.S. Appl. No. 14/112,187.
U.S. Office Action, dated Jun. 1, 2016, for U.S. Appl. No. 14/118,968.
U.S. Office Action, dated Sep. 12, 2016, for U.S. Appl. No. 14/004,562.
Brazilian Examination Report and Search Report, dated May 22, 2018, for Brazilian Application No. BR-112013025015-1, with English translations.
Ferrer et al., "Metallurgical Aspects Associated to Thermomechanical Process of High Strength Low Alloy Trip Steels," 62nd ABM International Annual Congress, Vitoria, Brazil, Jul. 23, 2007, pp. 1242-1254, with English abstract.
Indian Office Action for Indian Application No. 10051/DELNP/2013, dated Dec. 26, 2018, with English translation.

METHOD FOR PRODUCING A COLD-ROLLED STEEL SHEET

This application is a Divisional of application Ser. No. 14/118,968, filed on Nov. 20, 2013, now U.S. Pat. No. 9,567,658 B2 which was filed as PCT International Application No. PCT/JP2012/063261 on May 24, 2012, which claims the benefit under 35 U.S.C. § 119(a) to Patent Application No. 2011-117432, filed in Japan on May 25, 2011, all of which are hereby expressly incorporated by reference into the present application.

TECHNICAL FIELD

The present invention relates to a high-strength cold-rolled steel sheet which is excellent in uniform deformability contributing to stretchability, drawability, or the like and is excellent in local deformability contributing to bendability, stretch flangeability, burring formability, or the like, and relates to a method for producing the same. Particularly, the present invention relates to a steel sheet including a Dual Phase (DP) structure.

BACKGROUND OF INVENTION

In order to suppress emission of carbon dioxide gas from a vehicle, a weight reduction of an automobile body has been attempted by utilization of a high-strength steel sheet. Moreover, from a viewpoint of ensuring safety of a passenger, the utilization of the high-strength steel sheet for the automobile body has been attempted in addition to a mild steel sheet. However, in order to further improve the weight reduction of the automobile body in future, a usable strength level of the high-strength steel sheet should be increased as compared with that of conventional one. Moreover, in order to utilize the high-strength steel sheet for suspension parts or the like of the automobile body, the local deformability contributing to the burring formability or the like should also be improved in addition to the uniform deformability.

However, in general, when the strength of steel sheet is increased, the formability (deformability) is decreased. For example, uniform elongation which is important for drawing or stretching is decreased. In respect to the above, Non-Patent Document 1 discloses a method which secures the uniform elongation by retaining austenite in the steel sheet. Moreover, Non-Patent Document 2 discloses a method which secures the uniform elongation by compositing metallographic structure of the steel sheet even when the strength is the same.

In addition, Non-Patent Document 3 discloses a metallographic structure control method which improves local ductility representing the bendability, hole expansibility, or the burring formability by controlling inclusions, controlling the microstructure to single phase, and decreasing hardness difference between microstructures. In the Non-Patent Document 3, the microstructure of the steel sheet is controlled to the single phase by microstructure control, and the hardness difference is decreased between the microstructures. As a result, the local deformability contributing to the hole expansibility or the like is improved. However, in order to control the microstructure to the single phase, a heat treatment from an austenite single phase is a basis producing method as described in Non-Patent Document 4.

In addition, the Non-Patent Document 4 discloses a technique which satisfies both the strength and the ductility of the steel sheet by controlling a cooling after a hot-rolling in order to control the metallographic structure, specifically, in order to obtain intended morphologies of precipitates and transformation structures and to obtain an appropriate fraction of ferrite and bainite. However, all techniques as described above are the improvement methods for the local deformability which rely on the microstructure control, and are largely influenced by a microstructure formation of a base.

Also, a method, which improves material properties of the steel sheet by increasing reduction at a continuous hot-rolling in order to refine grains, is known as a related art. For example, Non-Patent Document 5 discloses a technique which improves the strength and toughness of the steel sheet by conducting a large reduction rolling in a comparatively lower temperature range within an austenite range in order to refine the grains of ferrite which is a primary phase of a product by transforming non-recrystallized austenite into the ferrite. However, in Non-Patent Document 5, a method for improving the local deformability to be solved by the present invention is not considered at all, and a method which is applied to the cold-rolled steel sheet is not also described.

RELATED ART DOCUMENTS

Non-Patent Documents

[Non-Patent Document 1] Takahashi: Nippon Steel Technical Report No. 378 (2003), p. 7.

[Non-Patent Document 2] O. Matsumura et al: Trans. ISIJ vol. 27 (1987), p. 570.

[Non-Patent Document 3] Katoh et al: Steel-manufacturing studies vol. 312 (1984), p. 41.

[Non-Patent Document 4] K. Sugimoto et al: ISIJ International, vol. 40 (2000), p. 920.

[Non-Patent Document 5] NFG product introduction of NAKAYAMA STEEL WORKS, LTD.

SUMMARY OF INVENTION

Technical Problem

As described above, it is the fact that the technique, which simultaneously satisfies the high-strength and both properties of the uniform deformability and the local deformability, is not found. For example, in order to improve the local deformability of the high-strength steel sheet, it is necessary to conduct the microstructure control including the inclusions. However, since the improvement relies on the microstructure control, it is necessary to control the fraction or the morphology of the microstructure such as the precipitates, the ferrite, or the bainite, and therefore the metallographic structure of the base is limited. Since the metallographic structure of the base is restricted, it is difficult not only to improve the local deformability but also to simultaneously improve the strength and the local deformability.

An object of the present invention is to provide a cold-rolled steel sheet which has the high-strength, the excellent uniform deformability, the excellent local deformability, and small orientation dependence (anisotropy) of formability by controlling texture and by controlling the size or the morphology of the grains in addition to the metallographic structure of the base, and is to provide a method for producing the same. Herein, in the present invention, the strength mainly represents tensile strength, and the high-strength indicates the strength of 440 MPa or more in the tensile strength. In addition, in the present invention, satisfaction of the high-strength, the excellent uniform deformability, and the excellent local deformability indicates a case of simultaneously satisfying all conditions of TS≥440 (unit: MPa), TS×u-EL≥7000 (unit: MPa·%), TS×λ≤30000 (unit: MPa·%), and d/RmC≥1 (no unit) by using characteristic values of the tensile strength (TS), the uniform elongation (u-EL), hole expansion ratio (λ), and d/RmC which is a ratio of thickness d to minimum radius RmC of bending to a C-direction.

Solution to Problem

In the related arts, as described above, the improvement in the local deformability contributing to the hole expansibility, the bendability, or the like has been attempted by controlling the inclusions, by refining the precipitates, by homogenizing the microstructure, by controlling the microstructure to the single phase, by decreasing the hardness difference between the microstructures, or the like. However, only by the above-described techniques, main constituent of the microstructure must be restricted. In addition, when an element largely contributing to an increase in the strength, such as representatively Nb or Ti, is added for high-strengthening, the anisotropy may be significantly increased. Accordingly, other factors for the formability must be abandoned or directions to take a blank before forming must be limited, and as a result, the application is restricted. On the other hand, the uniform deformability can be improved by dispersing hard phases such as martensite in the metallographic structure.

In order to obtain the high-strength and to improve both the uniform deformability contributing to the stretchability or the like and the local deformability contributing to the hole expansibility, the bendability, or the like, the inventors have newly focused influences of the texture of the steel sheet in addition to the control of the fraction or the morphology of the metallographic structures of the steel sheet, and have investigated and researched the operation and the effect thereof in detail. As a result, the inventors have found that, by controlling a chemical composition, the metallographic structure, and the texture represented by pole densities of each orientation of a specific crystal orientation group of the steel sheet, the high-strength is obtained, the local deformability is remarkably improved due to a balance of Lankford-values (r values) in a rolling direction, in a direction (C-direction) making an angle of 90° with the rolling direction, in a direction making an angle of 30° with the rolling direction, or in a direction making an angle of 60° with the rolling direction, and the uniform deformability is also secured due to the dispersion of the hard phases such as the martensite.

An aspect of the present invention employs the following.

(1) A cold-rolled steel sheet according to an aspect of the present invention includes, as a chemical composition of the steel sheet, by mass %, C: 0.01% to 0.4%, Si: 0.001% to 2.5%, Mn: 0.001% to 4.0%, Al: 0.001% to 2.0%, P: limited to 0.15% or less, S: limited to 0.03% or less, N: limited to 0.01% or less, O: limited to 0.01% or less, and a balance consisting of Fe and unavoidable impurities, wherein: an average pole density of an orientation group of {100}<011> to {223}<110>, which is a pole density represented by an arithmetic average of pole densities of each crystal orientation {100}<011>, {116}<110>, {114}<110>, {112}<110>, and {223}<110>, is 1.0 to 5.0 and a pole density of a crystal orientation {332}<113> is 1.0 to 4.0 in a thickness central portion which is a thickness range of ⅝ to ⅜ based on a surface of the steel sheet; a Lankford-value rC in a direction perpendicular to a rolling direction is 0.70 to 1.50 and a Lankford-value r30 in a direction making an angle of 30° with the rolling direction is 0.70 to 1.50; and the steel sheet includes, as a metallographic structure, plural grains, and includes, by area %, a ferrite and a bainite of 30% to 99% in total and a martensite of 1% to 70%.

(2) The cold-rolled steel sheet according to (1) may further includes, as the chemical composition of the steel sheet, by mass %, at least one selected from the group consisting of Ti: 0.001% to 0.2%, Nb: 0.001% to 0.2%, B: 0.0001% to 0.005%, Mg: 0.0001% to 0.01%, Rare Earth Metal: 0.0001% to 0.1%, Ca: 0.0001% to 0.01%, Mo: 0.001% to 1.0%, Cr: 0.001% to 2.0%, V: 0.001% to 1.0%, Ni: 0.001% to 2.0%, Cu: 0.001% to 2.0%, Zr: 0.0001% to 0.2%, W: 0.001% to 1.0%, As: 0.0001% to 0.5%, Co: 0.0001% to 1.0%, Sn: 0.0001% to 0.2%, Pb: 0.0001% to 0.2%, Y: 0.001% to 0.2%, and Hf: 0.001% to 0.2%.

(3) In the cold-rolled steel sheet according to (1) or (2), a volume average diameter of the grains may be 5 μm to 30 μm.

(4) In the cold-rolled steel sheet according to (1) or (2), the average pole density of the orientation group of {100}<011> to {223}<110> may be 1.0 to 4.0, and the pole density of the crystal orientation {332}<113> may be 1.0 to 3.0.

(5) In the cold-rolled steel sheet according to any one of (1) to (4), a Lankford-value rL in the rolling direction may be 0.70 to 1.50, and a Lankford-value r60 in a direction making an angle of 60° with the rolling direction may be 0.70 to 1.50.

(6) In the cold-rolled steel sheet according to any one of (1) to (5), when an area fraction of the martensite is defined as fM in unit of area %, an average size of the martensite is defined as dia in unit of μm, an average distance between the martensite is defined as dis in unit of μm, and a tensile strength of the steel sheet is defined as TS in unit of MPa, a following Expression 1 and a following Expression 2 may be satisfied.

$$\text{dia} \leq 13\ \mu\text{m} \quad \text{(Expression 1)}$$

$$\text{TS}/fM \times \text{dis}/\text{dia} \geq 500 \quad \text{(Expression 2)}$$

(7) In the cold-rolled steel sheet according to any one of (1) to (6), when an area fraction of the martensite is defined as fM in unit of area %, a major axis of the martensite is defined as La, and a minor axis of the martensite is defined as Lb, an area fraction of the martensite satisfying a following Expression 3 may be 50% to 100% as compared with the area fraction fM of the martensite.

$$La/Lb \leq 5.0 \quad \text{(Expression 3)}$$

(8) In the cold-rolled steel sheet according to any one of (1) to (7), the steel sheet may include, as the metallographic structure, by area %, the bainite of 5% to 80%.

(9) In the cold-rolled steel sheet according to any one of (1) to (8), the steel sheet may include a tempered martensite in the martensite.

(10) In the cold-rolled steel sheet according to any one of (1) to (9), an area fraction of coarse grain having grain size of more than 35 μm may be 0% to 10% among the grains in the metallographic structure of the steel sheet.

(11) In the cold-rolled steel sheet according to any one of (1) to (10), when a hardness of the ferrite or the bainite which is a primary phase is measured at 100 points or more, a value dividing a standard deviation of the hardness by an average of the hardness may be 0.2 or less.

(12) In the cold-rolled steel sheet according to any one of (1) to (11), a galvanized layer or a galvannealed layer may be arranged on the surface of the steel sheet.

(13) A method for producing a cold-rolled steel sheet according to an aspect of the present invention includes: first-hot-rolling a steel in a temperature range of 1000° C. to 1200° C. under conditions such that at least one pass whose reduction is 40% or more is included so as to control an average grain size of an austenite in the steel to 200 μm or less, wherein the steel includes, as a chemical composition, by mass %, C: 0.01% to 0.4%, Si: 0.001% to 2.5%, Mn: 0.001% to 4.0%, Al: 0.001% to 2.0%, P: limited to 0.15% or less, S: limited to 0.03% or less, N: limited to 0.01% or less, O: limited to 0.01% or less, and a balance consisting of Fe and unavoidable impurities; second-hot-rolling the steel under conditions such that, when a temperature calculated by a following Expression 4 is defined as T1 in unit of ° C. and a ferritic transformation temperature calculated by a following Expression 5 is defined as $Ar_3$ in unit of ° C., a large reduction pass whose reduction is 30% or more in a temperature range of T1+30° C. to T1+200° C. is included, a cumulative reduction in the temperature range of T1+30° C. to T1+200° C. is 50% or more, a cumulative reduction in a temperature range of $Ar_3$ to lower than T1+30° C. is limited to 30% or less, and a rolling finish temperature is $Ar_3$ or higher; first-cooling the steel under conditions such that, when a waiting time from a finish of a final pass in the large reduction pass to a cooling start is defined as tin unit of second, the waiting time t satisfies a following Expression 6, an average cooling rate is 50° C./second or faster, a cooling temperature change which is a difference between a steel temperature at the cooling start and a steel temperature at a cooling finish is 40° C. to 140° C., and the steel temperature at the cooling finish is T1+100° C. or lower; second-cooling the steel to a temperature range of a room temperature to 600° C. after finishing the second-hot-rolling; coiling the steel in the temperature range of the room temperature to 600° C.; pickling the steel; cold-rolling the steel under a reduction of 30% to 70%; heating-and-holding the steel in a temperature range of 750° C. to 900° C. for 1 second to 1000 seconds; third-cooling the steel to a temperature range of 580° C. to 720° C. under an average cooling rate of 1° C./second to 12° C./second; fourth-cooling the steel to a temperature range of 200° C. to 600° C. under an average cooling rate of 4° C./second to 300° C./second; and holding the steel as an overageing treatment under conditions such that, when an overageing temperature is defined as T2 in unit of ° C. and an overageing holding time dependent on the overageing temperature T2 is defined as t2 in unit of second, the overageing temperature T2 is within a temperature range of 200° C. to 600° C. and the overageing holding time t2 satisfies a following Expression 8.

$$T1=850+10\times([C]+[N])\times[Mn] \quad \text{(Expression 4)}$$

here, [C], [N], and [Mn] represent mass percentages of C, N, and Mn respectively.

$$Ar_3=879.4-516.1\times[C]-65.7\times[Mn]+38.0\times[Si]+274.7\times[P] \quad \text{(Expression 5)}$$

here, in Expression 5, [C], [Mn], [Si] and [P] represent mass percentages of C, Mn, Si, and P respectively.

$$t\leq 2.5\times t1 \quad \text{(Expression 6)}$$

here, t1 is represented by a following Expression 7.

$$t1=0.001\times((Tf-T1)\times P1/100)^2-0.109\times((Tf-T1)\times P1/100)+3.1 \quad \text{(Expression 7)}$$

here, Tf represents a celsius temperature of the steel at the finish of the final pass, and P1 represents a percentage of a reduction at the final pass.

$$\log(t2)\leq 0.0002\times(T2-425)^2+1.18 \quad \text{(Expression 8)}$$

(14) In the method for producing the cold-rolled steel sheet according to (13), the steel may further includes, as the chemical composition, by mass %, at least one selected from the group consisting of Ti: 0.001% to 0.2%, Nb: 0.001% to 0.2%, B: 0.0001% to 0.005%, Mg: 0.0001% to 0.01%, Rare Earth Metal: 0.0001% to 0.1%, Ca: 0.0001% to 0.01%, Mo: 0.001% to 1.0%, Cr: 0.001% to 2.0%, V: 0.001% to 1.0%, Ni: 0.001% to 2.0%, Cu: 0.001% to 2.0%, Zr: 0.0001% to 0.2%, W: 0.001% to 1.0%, As: 0.0001% to 0.5%, Co: 0.0001% to 1.0%, Sn: 0.0001% to 0.2%, Pb: 0.0001% to 0.2%, Y: 0.001% to 0.2%, and Hf: 0.001% to 0.2%, and a temperature calculated by a following Expression 9 may be substituted for the temperature calculated by the Expression 4 as T1.

$$T1=850+10\times([C]+[N])\times[Mn]+350\times[Nb]+250\times[Ti]+40\times[B]+10\times[Cr]+100\times[Mo]+100\times[V] \quad \text{(Expression 9)}$$

here, [C], [N], [Mn], [Nb], [Ti], [B], [Cr], [Mo], and [V] represent mass percentages of C, N, Mn, Nb, Ti, B, Cr, Mo, and V respectively.

(15) In the method for producing the cold-rolled steel sheet according to (13) or (14), the waiting time t may further satisfy a following Expression 10.

$$0\leq t<t1 \quad \text{(Expression 10)}$$

(16) In the method for producing the cold-rolled steel sheet according to (13) or (14), the waiting time t may further satisfy a following Expression 11.

$$t1\leq t\leq t1\times 2.5 \quad \text{(Expression 11)}$$

(17) In the method for producing the cold-rolled steel sheet according to any one of (13) to (16), in the first-hot-rolling, at least two times of rollings whose reduction is 40% or more may be conducted, and the average grain size of the austenite may be controlled to 100 μm or less.

(18) In the method for producing the cold-rolled steel sheet according to any one of (13) to (17), the second-cooling may start within 3 seconds after finishing the second-hot-rolling.

(19) In the method for producing the cold-rolled steel sheet according to any one of (13) to (18), in the second-hot-rolling, a temperature rise of the steel between passes may be 18° C. or lower.

(20) In the method for producing the cold-rolled steel sheet according to any one of (13) to (19), the first-cooling may be conducted at an interval between rolling stands.

(21) In the method for producing the cold-rolled steel sheet according to any one of (13) to (20), a final pass of rollings in the temperature range of T1+30° C. to T1+200° C. may be the large reduction pass.

(22) In the method for producing the cold-rolled steel sheet according to any one of (13) to (21), in the second-cooling, the steel may be cooled under an average cooling rate of 10° C./second to 300° C./second.

(23) In the method for producing the cold-rolled steel sheet according to any one of (13) to (22), a galvanizing may be conducted after the overageing treatment.

(24) In the method for producing the cold-rolled steel sheet according to any one of (13) to (23), a galvanizing may be conducted after the overageing treatment; and a heat treatment may be conducted in a temperature range of 450° C. to 600° C. after the galvanizing.

Advantageous Effects of Invention

According to the above aspects of the present invention, it is possible to obtain a cold-rolled steel sheet which has the high-strength, the excellent uniform deformability, the excellent local deformability, and the small anisotropy even when the element such as Nb or Ti is added.

DETAILED DESCRIPTION OF PREFERRED EMBODIMENTS

Hereinafter, a cold-rolled steel sheet according to an embodiment of the present invention will be described in detail. First, a pole density of a crystal orientation of the cold-rolled steel sheet will be described.

Average Pole Density D1 of Crystal Orientation: 1.0 to 5.0

Pole Density D2 of Crystal Orientation: 1.0 to 4.0

In the cold-rolled steel sheet according to the embodiment, as the pole densities of two kinds of the crystal orientations, the average pole density D1 of an orientation group of {100}<011> to {223}<110> (hereinafter, referred to as "average pole density") and the pole density D2 of a crystal orientation {332}<113> in a thickness central portion, which is a thickness range of ⅝ to ⅜ (a range which is ⅝ to ⅜ of the thickness distant from a surface of the steel sheet along a normal direction (a depth direction) of the steel sheet), are controlled in reference to a thickness-cross-section (a normal vector thereof corresponds to the normal direction) which is parallel to a rolling direction.

In the embodiment, the average pole density D1 is an especially-important characteristic (orientation integration and development degree of texture) of the texture (crystal orientation of grains in metallographic structure). Herein, the average pole density D1 is the pole density which is represented by an arithmetic average of pole densities of each crystal orientation {100}<011>, {116}<110>, {114}<110>, {112}<110>, and {223}<110>.

A intensity ratio of electron diffraction intensity or X-ray diffraction intensity of each orientation to that of a random sample is obtained by conducting Electron Back Scattering Diffraction (EBSD) or X-ray diffraction on the above cross-section in the thickness central portion which is the thickness range of ⅝ to ⅜, and the average pole density D1 of the orientation group of {100}<011> to {223}<110> can be obtained from each intensity ratio.

When the average pole density D1 of the orientation group of {100}<011> to {223}<110> is 5.0 or less, it is satisfied that d/RmC (a parameter in which the thickness d is divided by a minimum bend radius RmC (C-direction bending)) is 1.0 or more, which is minimally-required for working suspension parts or frame parts. Particularly, the condition is a requirement in order that tensile strength TS, hole expansion ratio λ, and total elongation EL preferably satisfy TS×λ≥30000 and TS×EL≥14000 which are two conditions required for the suspension parts of the automobile body.

In addition, when the average pole density D1 is 4.0 or less, a ratio (Rm45/RmC) of a minimum bend radius Rm45 of 45°-direction bending to the minimum bend radius RmC of the C-direction bending is decreased, in which the ratio is a parameter of orientation dependence (isotropy) of formability, and the excellent local deformability which is independent of the bending direction can be secured. As described above, the average pole density D1 may be 5.0 or less, and may be preferably 4.0 or less. In a case where the further excellent hole expansibility or small critical bending properties are needed, the average pole density D1 may be more preferably less than 3.5, and may be furthermore preferably less than 3.0.

When the average pole density D1 of the orientation group of {100}<011> to {223}<110> is more than 5.0, the anisotropy of mechanical properties of the steel sheet is significantly increased. As a result, although the local deformability in only a specific direction is improved, the local deformability in a direction different from the specific direction is significantly decreased. Therefore, in the case, the steel sheet cannot satisfy d/RmC≥1.0.

On the other hand, when the average pole density D1 is less than 1.0, the local deformability may be decreased. Accordingly, preferably, the average pole density D1 may be 1.0 or more.

In addition, from the similar reasons, the pole density D2 of the crystal orientation {332}<113> in the thickness central portion which is the thickness range of ⅝ to ⅜ may be 4.0 or less. The condition is a requirement in order that the steel sheet satisfies d/RmC≥1.0, and particularly, that the tensile strength TS, the hole expansion ratio λ, and the total elongation EL preferably satisfy TS×λ≥30000 and TS×EL≥14000 which are two conditions required for the suspension parts.

Moreover, when the pole density D2 is 3.0 or less, TS×λ or d/RmC can be further improved. The pole density D2 may be preferably 2.5 or less, and may be more preferably 2.0 or less. When the pole density D2 is more than 4.0, the anisotropy of the mechanical properties of the steel sheet is significantly increased. As a result, although the local deformability in only a specific direction is improved, the local deformability in a direction different from the specific direction is significantly decreased. Therefore, in the case, the steel sheet cannot sufficiently satisfy d/RmC≥1.0.

On the other hand, when the average pole density D2 is less than 1.0, the local deformability may be decreased. Accordingly, preferably, the pole density D2 of the crystal orientation {332}<113> may be 1.0 or more.

The pole density is synonymous with an X-ray random intensity ratio. The X-ray random intensity ratio can be obtained as follows. Diffraction intensity (X-ray or electron) of a standard sample which does not have a texture to a specific orientation and diffraction intensity of a test material are measured by the X-ray diffraction method in the same conditions. The X-ray random intensity ratio is obtained by dividing the diffraction intensity of the test material by the diffraction intensity of the standard sample. The pole density can be measured by using the X-ray diffraction, the Electron Back Scattering Diffraction (EBSD), or Electron Channeling Pattern (ECP). For example, the average pole density D1 of the orientation group of {100}<011> to {223}<110> can be obtained as follows. The pole densities of each orientation {100}<110>, {116}<110>, {114}<110>, {112}<110>, and {223}<110> are obtained from a three-dimensional texture (ODF: Orientation Distribution Functions) which is calculated by a series expanding method using plural pole figures in pole figures of {110}, {100}, {211}, and {310} measured by the above methods. The average pole density D1 is obtained by calculating an arithmetic average of the pole densities.

With respect to samples which are supplied for the X-ray diffraction, the EBSD, and the ECP, the thickness of the steel sheet may be reduced to a predetermined thickness by mechanical polishing or the like, strain may be removed by chemical polishing, electrolytic polishing, or the like, the samples may be adjusted so that an appropriate surface including the thickness range of ⅝ to ⅜ is a measurement surface, and then the pole densities may be measured by the above methods. With respect to a transverse direction, it is preferable that the samples are collected in the vicinity of ¼ or ¾ position of the thickness (a position which is at ¼ of a steel sheet width distant from a side edge the steel sheet).

When the above pole densities are satisfied in many other thickness portions of the steel sheet in addition to the thickness central portion, the local deformability is further improved. However, since the texture in the thickness central portion significantly influences the anisotropy of the steel sheet, the material properties of the thickness central portion approximately represent the material properties of the entirety of the steel sheet. Accordingly, the average pole density D1 of the orientation group of {100}<011> to {223}<110> and the pole density D2 of the crystal orientation {332}<113> in the thickness central portion of ⅝ to ⅜ are prescribed.

Herein, {hkl}<uvw> indicates that the normal direction of the sheet surface is parallel to <hkl> and the rolling direction is parallel to <uvw> when the sample is collected by the above-described method. In addition, generally, in the orientation of the crystal, an orientation perpendicular to the sheet surface is represented by (hkl) or {hkl} and an orientation parallel to the rolling direction is represented by [uvw] or <uvw>. {hkl}<uvw> indicates collectively equivalent planes, and (hkl)[uvw] indicates each crystal plane. Specifically, since the embodiment targets a body centered cubic (bcc) structure, for example, (111), (-111), (1-11), (11-1), (-1-11), (-11-1), (1-1-1), and (-1-1-1) planes are equivalent and cannot be classified. In the case, the orientation is collectively called as {111}. Since the ODF expression is also used for orientation expressions of other crystal structures having low symmetry, generally, each orientation is represented by (hkl)[uvw] in the ODF expression. However, in the embodiment, {hkl}<uvw> and (hkl)[uvw] are synonymous.

Next, an r value (Lankford-value) of the steel sheet will be described.

In the embodiment, in order to further improve the local deformability, the r values of each direction (as described below, rL which is the r value in the rolling direction, r30 which is the r value in a direction making an angle of 30° with the rolling direction, r60 which is the r value in a direction making an angle of 60° with the rolling direction, and rC which is the r value in a direction perpendicular to the rolling direction) may be controlled to be a predetermined range. In the embodiment, the r values are important. As a result of investigation in detail by the inventors, it is found that the more excellent local deformability such as the hole expansibility is obtained by appropriately controlling the r values in addition to the appropriate control of each pole density as described above.

r Value in Direction Perpendicular to Rolling Direction (rC): 0.70 to 1.50

As a result of the investigation in detail by the inventors, it is found that more excellent hole expansibility is obtained by controlling the rC to 0.70 or more in addition to the control of each pole density to the above-described range. Accordingly, the rC may be 0.70 or more. In order to obtain the more excellent hole expansibility, an upper limit of the rC may be 1.50 or less. Preferably, the rC may be 1.10 or less.

r Value in Direction Making Angle of 30° with Rolling Direction (r30): 0.70 to 1.50

As a result of the investigation in detail by the inventors, it is found that more excellent hole expansibility is obtained by controlling the r30 to 1.50 or less in addition to the control of each pole density to the above-described range. Accordingly, the r30 may be 1.50 or less. Preferably, the r30 may be 1.10 or less. In order to obtain the more excellent hole expansibility, a lower limit of the r30 may be 0.70 or more.

r Value of Rolling Direction (rL): 0.70 to 1.50 r Value in Direction Making Angle of 60° with Rolling Direction (r60): 0.70 to 1.50

As a result of further investigation in detail by the inventors, it is found that more excellent TS×λ is obtained by controlling the rL and the r60 so as to satisfy rL≥0.70 and r60≤1.50 respectively, in addition to the control of the rC and the r30 to the above-described range. Accordingly, the rL may be 0.70 or more, and the r60 may be 1.50 or less. Preferably, the r60 may be 1.10 or less. In order to obtain the more excellent hole expansibility, an upper limit of the rL may be 1.50 or less, and a lower limit of the r60 may be 0.70 or more. Preferably, the rL may be 1.10 or less.

Each r value as described above is evaluated by tensile test using JIS No. 5 tensile test sample. In consideration of a general high-strength steel sheet, the r values may be evaluated within a range where tensile strain is 5% to 15% and a range which corresponds to the uniform elongation.

In addition, since the directions in which the bending is conducted differ in the parts which are bent, the direction is not particularly limited. In the cold-rolled steel sheet according to the embodiment, the similar properties can be obtained in any bending direction.

Generally, it is known that the texture and the r value have a correlation. However, in the cold-rolled steel sheet according to the embodiment, the limitation with respect to the pole densities of the crystal orientations and the limitation with respect to the r values as described above are not synonymous. Accordingly, when both limitations are simultaneously satisfied, more excellent local deformability can be obtained.

Next, a metallographic structure of the cold-rolled steel sheet according to the embodiment will be described.

A metallographic structure of the cold-rolled steel sheet according to the embodiment is fundamentally to be a Dual Phase (DP) structure which includes plural grains, includes ferrite and/or bainite as a primary phase, and includes martensite as a secondary phase. The strength and the uniform deformability can be increased by dispersing the martensite which is the secondary phase and the hard phase to the ferrite or the bainite which is the primary phase and has the excellent deformability. The improvement in the uniform deformability is derived from an increase in work hardening rate by finely dispersing the martensite which is the hard phase in the metallographic structure. Moreover, herein, the ferrite or the bainite includes polygonal ferrite and bainitic ferrite.

The cold-rolled steel sheet according to the embodiment includes residual austenite, pearlite, cementite, plural inclusions, or the like as the microstructure in addition to the ferrite, the bainite, and the martensite. It is preferable that the microstructures other than the ferrite, the bainite, and the martensite are limited to, by area %, 0% to 10%. Moreover, when the austenite is retained in the microstructure, secondary work embrittlement or delayed fracture properties deteriorates. Accordingly, except for the residual austenite of approximately 5% in area fraction which unavoidably exists, it is preferable that the residual austenite is not substantially included.

Area fraction of Ferrite and Bainite which are Primary Phase: 30% to less than 99%

The ferrite and the bainite which are the primary phase are comparatively soft, and have the excellent deformability. When the area fraction of the ferrite and the bainite is 30% or more in total, both properties of the uniform deformability and the local deformability of the cold-rolled steel sheet according to the embodiment are satisfied. More preferably, the ferrite and the bainite may be, by area %, 50% or more in total. On the other hand, when the area fraction of the ferrite and the bainite is 99% or more in total, the strength and the uniform deformability of the steel sheet are decreased.

Preferably, the area fraction of the bainite which is the primary phase may be 5% to 80%. By controlling the area fraction of the bainite which is comparatively excellent in the strength to 5% to 80%, it is possible to preferably increase the strength in a balance between the strength and the ductility (deformability) of the steel sheet. By increasing the area fraction of the bainite which is harder phase than the ferrite, the strength of the steel sheet is improved. In addition, the bainite, which has small hardness difference from the martensite as compared with the ferrite, suppresses initiation of voids at an interface between the soft phase and the hard phase, and improves the hole expansibility.

Alternatively, the area fraction of the ferrite which is the primary phase may be 30% to 99%. By controlling the area fraction of the ferrite which is comparatively excellent in the deformability to 30% to 99%, it is possible to preferably increase the ductility (deformability) in the balance between the strength and the ductility (deformability) of the steel sheet. Particularly, the ferrite contributes to the improvement in the uniform deformability.

Area fraction fM of Martensite: 1% to 70%

By dispersing the martensite, which is the secondary phase and is the hard phase, in the metallographic structure, it is possible to improve the strength and the uniform deformability. When the area fraction of the martensite is less than 1%, the dispersion of the hard phase is insufficient, the work hardening rate is decreased, and the uniform deformability is decreased. Preferably, the area fraction of the martensite may be 3% or more. On the other hand, when the area fraction of the martensite is more than 70%, the area fraction of the hard phase is excessive, and the deformability of the steel sheet is significantly decreased. In accordance with the balance between the strength and the deformability, the area fraction of the martensite may be 50% or less. Preferably, the area fraction of the martensite may be 30% or less. More preferably, the area fraction of the martensite may be 20% or less.

Average Grain Size dia of Martensite: 13 μm or less

When the average size of the martensite is more than 13 μm, the uniform deformability of the steel sheet may be decreased, and the local deformability may be decreased. It is considered that the uniform elongation is decreased due to the fact that contribution to the work hardening is decreased when the average size of the martensite is coarse, and that the local deformability is decreased due to the fact that the voids easily initiates in the vicinity of the coarse martensite. Preferably, the average size of the martensite may be less than 10 μm. More preferably, the average size of the martensite may be 7 μm or less. Furthermore preferably, the average size of the martensite may be 5 μm or less.

Relationship of TS/fM×dis/dia: 500 or more

Moreover, as a result of the investigation in detail by the inventors, it is found that, when the tensile strength is defined as TS (tensile strength) in unit of MPa, the area fraction of the martensite is defined as fM (fraction of Martensite) in unit of %, an average distance between the martensite grains is defined as dis (distance) in unit of μm, and the average grain size of the martensite is defined as dia (diameter) in unit of μm, the uniform deformability of the steel sheet may be preferably improved in a case that a relationship among the TS, the fM, the dis, and the dia satisfies a following Expression 1.

$$TS/fM \times dis/dia \geq 500 \quad \text{(Expression 1)}$$

When the relationship of TS/fM×dis/dia is less than 500, the uniform deformability of the steel sheet may be significantly decreased. A physical meaning of the Expression 1 has not been clear. However, it is considered that the work hardening more effectively occurs as the average distance dis between the martensite grains is decreased and as the average grain size dia of the martensite is increased. Moreover, the relationship of TS/fM×dis/dia does not have particularly an upper limit. However, from an industrial standpoint, since the relationship of TS/fM×dis/dia barely exceeds 10000, the upper limit may be 10000 or less.

Fraction of Martensite having 5.0 or less in Ratio of Major Axis to Minor Axis: 50% or more In addition, when a major axis of a martensite grain is defined as La in unit of μm and a minor axis of a martensite grain is defined as Lb in unit of μm, the local deformability may be preferably improved in a case that an area fraction of the martensite grain satisfying a following Expression 2 is 50% to 100% as compared with the area fraction fM of the martensite.

$$La/Lb \leq 5.0 \quad \text{(Expression 2)}$$

The detail reasons why the effect is obtained has not been clear. However, it is considered that the local deformability is improved due to the fact that the shape of the martensite varies from an acicular shape to a spherical shape and that excessive stress concentration to the ferrite or the bainite near the martensite is relieved. Preferably, the area fraction of the martensite grain having La/Lb of 3.0 or less may be 50% or more as compared with the fM. More preferably, the area fraction of the martensite grain having La/Lb of 2.0 or less may be 50% or more as compared with the fM. Moreover, when the fraction of equiaxial martensite is less than 50% as compared with the fM, the local deformability may deteriorate. Moreover, a lower limit of the Expression 2 may be 1.0.

Moreover, all or part of the martensite may be a tempered martensite. When the martensite is the tempered martensite, although the strength of the steel sheet is decreased, the hole expansibility of the steel sheet is improved by a decrease in the hardness difference between the primary phase and the secondary phase. In accordance with the balance between the required strength and the required deformability, the area fraction of the tempered martensite may be controlled as compared with the area fraction fM of the martensite. Moreover, the cold-rolled steel sheet according to the embodiment may include the residual austenite of 5% or less. When the residual austenite is more than 5%, the residual austenite is transformed to excessive hard martensite after working, and the hole expansibility may deteriorate significantly.

The metallographic structure such as the ferrite, the bainite, or the martensite as described above can be observed by a Field Emission Scanning Electron Microscope (FE-SEM) in a thickness range of ⅛ to ⅜ (a thickness range in which ¼ position of the thickness is the center). The above characteristic values can be determined from micrographs which are obtained by the observation. In addition, the characteristic values can be also determined by the EBSD as described below. For the observation of the FE-SEM, samples are collected so that an observed section is the thickness-cross-section (the normal vector thereof corresponds to the normal direction) which is parallel to the rolling direction of the steel sheet, and the observed section is polished and nital-etched. Moreover, in the thickness direction, the metallographic structure (constituent) of the steel sheet may be significantly different between the vicinity of the surface of the steel sheet and the vicinity of the center of the steel sheet because of decarburization and Mn segregation. Accordingly, in the embodiment, the metallographic structure based on ¼ position of the thickness is observed.

Volume Average Diameter of Grains: 5 μm to 30 μm

Moreover, in order to further improve the deformability, size of the grains in the metallographic structure, particularly, the volume average diameter may be refined. Moreover, fatigue properties (fatigue limit ratio) required for an automobile steel sheet or the like are also improved by refining the volume average diameter. Since the number of coarse grains significantly influences the deformability as compared with the number of fine grains, the deformability significantly correlates with the volume average diameter calculated by the weighted average of the volume as compared with a number average diameter. Accordingly, in order to obtain the above effects, the volume average diameter may be 5 μm to 30 μm, may be more preferably 5 μm to 20 μm, and may be furthermore preferably 5 μm to 10 μm.

Moreover, it is considered that, when the volume average diameter is decreased, local strain concentration occurred in micro-order is suppressed, the strain can be dispersed during local deformation, and the elongation, particularly, the uniform elongation is improved. In addition, when the volume average diameter is decreased, a grain boundary which acts as a barrier of dislocation motion may be appropriately controlled, the grain boundary may affect repetitive plastic deformation (fatigue phenomenon) derived from the dislocation motion, and thus, the fatigue properties may be improved.

Moreover, as described below, the diameter of each grain (grain unit) can be determined. The pearlite is identified through a metallographic observation by an optical microscope. In addition, the grain units of the ferrite, the austenite, the bainite, and the martensite are identified by the EBSD. If crystal structure of an area measured by the EBSD is a face centered cubic structure (fcc structure), the area is regarded as the austenite. Moreover, if crystal structure of an area measured by the EBSD is the body centered cubic structure (bcc structure), the area is regarded as the any one of the ferrite, the bainite, and the martensite. The ferrite, the bainite, and the martensite can be identified by using a Kernel Average Misorientation (KAM) method which is added in an Electron Back Scatter Diffraction Pattern-Orientation Image Microscopy (EBSP-OIM, Registered Trademark). In the KAM method, with respect to a first approximation (total 7 pixels) using a regular hexagonal pixel (central pixel) in measurement data and 6 pixels adjacent to the central pixel, a second approximation (total 19 pixels) using 12 pixels further outside the above 6 pixels, or a third approximation (total 37 pixels) using 18 pixels further outside the above 12 pixels, an misorientation between each pixel is averaged, the obtained average is regarded as the value of the central pixel, and the above operation is performed on all pixels. The calculation by the KAM method is performed so as not to exceed the grain boundary, and a map representing intragranular crystal rotation can be obtained. The map shows strain distribution based on the intragranular local crystal rotation.

In the embodiment, the misorientation between adjacent pixels is calculated by using the third approximation in the EBSP-OIM (registered trademark). For example, the above-described orientation measurement is conducted by a measurement step of 0.5 μm or less at a magnification of 1500-fold, a position in which the misorientation between the adjacent measurement points is more than 15° is regarded as a grain border (the grain border is not always a general grain boundary), the circle equivalent diameter is calculated, and thus, the grain sizes of the ferrite, the bainite, the martensite, and the austenite are obtained. When the pearlite is included in the metallographic structure, the grain size of the pearlite can be calculated by applying an image processing method such as binarization processing or an intercept method to the micrograph obtained by the optical microscope.

In the grain (grain unit) defined as described above, when a circle equivalent radius (a half value of the circle equivalent diameter) is defined as r, the volume of each grain is obtained by $4\times\pi\times r^3/3$, and the volume average diameter can be obtained by the weighted average of the volume. In addition, an area fraction of coarse grains described below can be obtained by dividing area of the coarse grains obtained using the method by measured area. Moreover, except for the volume average diameter, the circle equivalent diameter or the grain size obtained by the binarization processing, the intercept method, or the like is used, for example, as the average grain size dia of the martensite.

The average distance dis between the martensite grains may be determined by using the border between the martensite grain and the grain other than the martensite obtained by the EBSD method (however, FE-SEM in which the EBSD can be conducted) in addition to the FE-SEM observation method.

Area fraction of Coarse Grains having Grain Size of more than 35 μm: 0% to 10%

In addition, in order to further improve the local deformability, with respect to all constituents of the metallographic structure, the area fraction (the area fraction of the coarse grains) which is occupied by grains (coarse grains) having the grain size of more than 35 μm occupy per unit area may be limited to be 0% to 10%. When the grains having a large size are increased, the tensile strength may be decreased, and the local deformability may be also decreased. Accordingly, it is preferable to refine the grains. Moreover, since the local deformability is improved by straining all grains uniformly and equivalently, the local strain of the grains may be suppressed by limiting the fraction of the coarse grains.

Hardness H of Ferrite: it is preferable to satisfy a following Expression 3

The ferrite which is the primary phase and the soft phase contributes to the improvement in the deformability of the steel sheet. Accordingly, it is preferable that the average hardness H of the ferrite satisfies the following Expression 3. When a ferrite which is harder than the following Expression 3 is contained, the improvement effects of the deformability of the steel sheet may not be obtained. Moreover, the average hardness H of the ferrite is obtained by measuring the hardness of the ferrite at 100 points or more under a load of 1 mN in a nano-indenter.

$$H<200+30\times[Si]+21\times[Mn]+270\times[P]+78\times[Nb]^{1/2}+108\times[Ti]^{1/2} \quad \text{(Expression 3)}$$

Here, [Si], [Mn], [P], [Nb], and [Ti] represent mass percentages of Si, Mn, P, Nb, and Ti respectively.

Standard Deviation/Average of Hardness of Ferrite or Bainite: 0.2 or less

As a result of investigation which is focused on the homogeneity of the ferrite or bainite which is the primary phase by the inventors, it is found that, when the homogeneity of the primary phase is high in the microstructure, the balance between the uniform deformability and the local deformability may be preferably improved. Specifically, when a value, in which the standard deviation of the hardness of the ferrite is divided by the average of the hardness of the ferrite, is 0.2 or less, the effects may be preferably obtained. Moreover, when a value, in which the standard deviation of the hardness of the bainite is divided by the average of the hardness of the bainite, is 0.2 or less, the effects may be preferably obtained. The homogeneity can be obtained by measuring the hardness of the ferrite or the bainite which is the primary phase at 100 points or more under the load of 1 mN in the nano-indenter and by using the obtained average and the obtained standard deviation. Specifically, the homogeneity increases with a decrease in the value of the standard deviation of the hardness/the average of the hardness, and the effects may be obtained when the value is 0.2 or less. In the nano-indenter (for example, UMIS-2000 manufactured by CSIRO corporation), by using a smaller indenter than the grain size, the hardness of a single grain which does not include the grain boundary can be measured.

Next, a chemical composition of the cold-rolled steel sheet according to the embodiment will be described.

C: 0.01% to 0.4%

C (carbon) is an element which increases the strength of the steel sheet, and is an essential element to obtain the area fraction of the martensite. A lower limit of C content is to be 0.01% in order to obtain the martensite of 1% or more, by area %. Preferably, the lower limit may be 0.03% or more. On the other hand, when the C content is more than 0.40%, the deformability of the steel sheet is decreased, and weldability of the steel sheet also deteriorates. Preferably, the C content may be 0.30% or less. The C content may be preferably 0.3% or less, and may be more preferably 0.25% or less.

Si: 0.001% to 2.5%

Si (silicon) is a deoxidizing element of the steel and is an element which is effective in an increase in the mechanical strength of the steel sheet. Moreover, Si is an element which stabilizes the ferrite during the temperature control after the hot-rolling and suppresses cementite precipitation during the bainitic transformation. However, when Si content is more than 2.5%, the deformability of the steel sheet is decreased, and surface dents tend to be made on the steel sheet. On the other hand, when the Si content is less than 0.001%, it is difficult to obtain the effects.

Mn: 0.001% to 4.0%

Mn (manganese) is an element which is effective in an increase in the mechanical strength of the steel sheet. However, when Mn content is more than 4.0%, the deformability of the steel sheet is decreased. Preferably, the Mn content may be 3.5% or less. More preferably, the Mn content may be 3.0% or less. On the other hand, when the Mn content is less than 0.001%, it is difficult to obtain the effects. In addition, Mn is also an element which suppresses cracks during the hot-rolling by fixing S (sulfur) in the steel. When elements such as Ti which suppresses occurrence of cracks due to S during the hot-rolling are not sufficiently added except for Mn, it is preferable that the Mn content and the S content satisfy $Mn/S \geq 20$ by mass %.

Al: 0.001% to 2.0%

Al (aluminum) is a deoxidizing element of the steel. Moreover, Al is an element which stabilizes the ferrite during the temperature control after the hot-rolling and suppresses the cementite precipitation during the bainitic transformation. In order to obtain the effects, Al content is to be 0.001% or more. However, when the Al content is more than 2.0%, the weldability deteriorates. In addition, although it is difficult to quantitatively show the effects, Al is an element which significantly increases a temperature $Ar_3$ at which transformation starts from γ (austenite) to a (ferrite) at the cooling of the steel. Accordingly, $Ar_3$ of the steel may be controlled by the Al content.

The cold-rolled steel sheet according to the embodiment includes unavoidable impurities in addition to the above described base elements. Here, the unavoidable impurities indicate elements such as P, S, N, O, Cd, Zn, or Sb which are unavoidably mixed from auxiliary raw materials such as scrap or from production processes. In the elements, P, S, N, and O are limited to the following in order to preferably obtain the effects. It is preferable that the unavoidable impurities other than P, S, N, and O are individually limited to 0.02% or less. Moreover, even when the impurities of 0.02% or less are included, the effects are not affected. The limitation range of the impurities includes 0%, however, it is industrially difficult to be stably 0%. Here, the described % is mass %.

P: 0.15% or less

P (phosphorus) is an impurity, and an element which contributes to crack during the hot-rolling or the cold-rolling when the content in the steel is excessive. In addition, P is an element which deteriorates the ductility or the weldability of the steel sheet. Accordingly, the P content is limited to 0.15% or less. Preferably, the P content may be limited to 0.05% or less. Moreover, since P acts as a solid solution strengthening element and is unavoidably included in the steel, it is not particularly necessary to prescribe a lower limit of the P content. The lower limit of the P content may be 0%. Moreover, considering current general refining (includes secondary refining), the lower limit of the P content may be 0.0005%.

S: 0.03% or less

S (sulfur) is an impurity, and an element which deteriorates the deformability of the steel sheet by forming MnS stretched by the hot-rolling when the content in the steel is excessive. Accordingly, the S content is limited to 0.03% or less. Moreover, since S is unavoidably included in the steel, it is not particularly necessary to prescribe a lower limit of the S content. The lower limit of the S content may be 0%. Moreover, considering the current general refining (includes the secondary refining), the lower limit of the S content may be 0.0005%.

N: 0.01% or less

N (nitrogen) is an impurity, and an element which deteriorates the deformability of the steel sheet. Accordingly, the N content is limited to 0.01% or less. Moreover, since N is unavoidably included in the steel, it is not particularly necessary to prescribe a lower limit of the N content. The lower limit of the N content may be 0%. Moreover, considering the current general refining (includes the secondary refining), the lower limit of the N content may be 0.0005%.

O: 0.01% or less

O (oxygen) is an impurity, and an element which deteriorates the deformability of the steel sheet. Accordingly, the O content is limited to 0.01% or less. Moreover, since O is unavoidably included in the steel, it is not particularly necessary to prescribe a lower limit of the O content. The lower limit of the O content may be 0%. Moreover, considering the current general refining (includes the secondary refining), the lower limit of the O content may be 0.0005%.

The above chemical elements are base components (base elements) of the steel in the embodiment, and the chemical composition, in which the base elements are controlled (included or limited) and the balance consists of Fe and unavoidable impurities, is a base composition of the embodiment. However, in addition to the base elements (instead of a part of Fe which is the balance), in the embodiment, the following chemical elements (optional elements) may be additionally included in the steel as necessary. Moreover, even when the optional elements are unavoidably included in the steel (for example, amount less than a lower limit of each optional element), the effects in the embodiment are not decreased.

Specifically, the cold-rolled steel sheet according to the embodiment may further include, as a optional element, at least one selected from a group consisting of Mo, Cr, Ni, Cu, B, Nb, Ti, V, W, Ca, Mg, Zr, REM, As, Co, Sn, Pb, Y, and Hf in addition to the base elements and the impurity elements. Hereinafter, numerical limitation ranges and the limitation reasons of the optional elements will be described. Here, the described % is mass %.

Ti: 0.001% to 0.2%

Nb: 0.001% to 0.2%

B: 0.001% to 0.005%

Ti (titanium), Nb (niobium), and B (boron) are the optional elements which form fine carbon-nitrides by fixing the carbon and the nitrogen in the steel, and which have the effects such as precipitation strengthening, microstructure control, or grain refinement strengthening for the steel. Accordingly, as necessary, at least one of Ti, Nb, and B may be added to the steel. In order to obtain the effects, preferably, Ti content may be 0.001% or more, Nb content may be 0.001% or more, and B content may be 0.0001% or more. More preferably, the Ti content may be 0.01% or more and the Nb content may be 0.005% or more. However, when the optional elements are excessively added to the steel, the effects may be saturated, the control of the crystal orientation may be difficult because of suppression of recrystallization after the hot-rolling, and the workability (deformability) of the steel sheet may deteriorate. Accordingly, preferably, the Ti content may be 0.2% or less, the Nb content may be 0.2% or less, and the B content may be 0.005% or less. More preferably, the B content may be 0.003% or less. Moreover, even when the optional elements having the amount less than the lower limit are included in the steel, the effects in the embodiment are not decreased. Moreover, since it is not necessary to add the optional elements to the steel intentionally in order to reduce costs of alloy, lower limits of amounts of the optional elements may be 0%.

Mg: 0.0001% to 0.01%

REM: 0.0001% to 0.1%

Ca: 0.0001% to 0.01%

Ma (magnesium), REM (Rare Earth Metal), and Ca (calcium) are the optional elements which are important to control inclusions to be harmless shapes and to improve the local deformability of the steel sheet. Accordingly, as necessary, at least one of Mg, REM, and Ca may be added to the steel. In order to obtain the effects, preferably, Mg content may be 0.0001% or more, REM content may be 0.0001% or more, and Ca content may be 0.0001% or more. More preferably, the Mg content may be 0.0005% or more, the REM content may be 0.001% or more, and the Ca content may be 0.0005% or more. On the other hand, when the optional elements are excessively added to the steel, inclusions having stretched shapes may be formed, and the deformability of the steel sheet may be decreased. Accordingly, preferably, the Mg content may be 0.01% or less, the REM content may be 0.1% or less, and the Ca content may be 0.01% or less. Moreover, even when the optional elements having the amount less than the lower limit are included in the steel, the effects in the embodiment are not decreased. Moreover, since it is not necessary to add the optional elements to the steel intentionally in order to reduce costs of alloy, lower limits of amounts of the optional elements may be 0%.

In addition, here, the REM represents collectively a total of 16 elements which are 15 elements from lanthanum with atomic number 57 to lutetium with atomic number 71 in addition to scandium with atomic number 21. In general, REM is supplied in the state of misch metal which is a mixture of the elements, and is added to the steel.

Mo: 0.001% to 1.0%

Cr: 0.001% to 2.0%

Ni: 0.001% to 2.0%

W: 0.001% to 1.0%

Zr: 0.0001% to 0.2%

As: 0.0001% to 0.5%

Mo (molybdenum), Cr (chromium), Ni (nickel), W (tungsten), Zr (zirconium), and As (arsenic) are the optional elements which increase the mechanical strength of the steel sheet. Accordingly, as necessary, at least one of Mo, Cr, Ni, W, Zr, and As may be added to the steel. In order to obtain the effects, preferably, Mo content may be 0.001% or more, Cr content may be 0.001% or more, Ni content may be 0.001% or more, W content may be 0.001% or more, Zr content may be 0.0001% or more, and As content may be 0.0001% or more. More preferably, the Mo content may be 0.01% or more, Cr content may be 0.01% or more, Ni content may be 0.05% or more, and W content is 0.01% or more. However, when the optional elements are excessively added to the steel, the deformability of the steel sheet may be decreased. Accordingly, preferably, the Mo content may be 1.0% or less, the Cr content may be 2.0% or less, the Ni content may be 2.0% or less, the W content may be 1.0% or less, the Zr content may be 0.2% or less, and the As content may be 0.5% or less. More preferably, the Zr content may be 0.05% or less. Moreover, even when the optional elements having the amount less than the lower limit are included in the steel, the effects in the embodiment are not decreased. Moreover, since it is not necessary to add the optional elements to the steel intentionally in order to reduce costs of alloy, lower limits of amounts of the optional elements may be 0%.

V: 0.001% 1.0%

Cu: 0.001% to 2.0%

V (vanadium) and Cu (copper) are the optional elements which is similar to Nb, Ti, or the like and which have the effect of the precipitation strengthening. In addition, a decrease in the local deformability due to addition of V and Cu is small as compared with that of addition of Nb, Ti, or the like. Accordingly, in order to obtain the high-strength and to further increase the local deformability such as the hole expansibility or the bendability, V and Cu are more effective optional elements than Nb, Ti, or the like. Therefore, as necessary, at least one of V and Cu may be added to the steel. In order to obtain the effects, preferably, V content may be 0.001% or more and Cu content may be 0.001% or more. More preferably, the contents of both optional elements may be 0.01% or more. However, the optional elements are excessively added to the steel, the deformability of the steel sheet may be decreased. Accordingly, preferably, the V content may be 1.0% or less and the Cu content may be 2.0% or less. More preferably, the V content may be 0.5% or less. Moreover, even when the optional elements having the amount less than the lower limit are included in the steel, the effects in the embodiment are not decreased. In addition, since it is not necessary to add the optional elements to the steel intentionally in order to reduce costs of alloy, lower limits of amounts of the optional elements may be 0%.

Co: 0.0001% to 1.0%

Although it is difficult to quantitatively show the effects, Co (cobalt) is the optional element which significantly increases the temperature $Ar_3$ at which the transformation starts from γ (austenite) to α (ferrite) at the cooling of the steel. Accordingly, $Ar_3$ of the steel may be controlled by the Co content. In addition, Co is the optional element which improves the strength of the steel sheet. In order to obtain the effect, preferably, the Co content may be 0.0001% or more. More preferably, the Co content may be 0.001% or more. However, when Co is excessively added to the steel, the weldability of the steel sheet may deteriorate, and the deformability of the steel sheet may be decreased. Accordingly, preferably, the Co content may be 1.0% or less. More preferably, the Co content may be 0.1% or less. Moreover, even when the optional element having the amount less than the lower limit are included in the steel, the effects in the embodiment are not decreased. In addition, since it is not necessary to add the optional element to the steel intentionally in order to reduce costs of alloy, a lower limit of an amount of the optional element may be 0%.

Sn: 0.0001% to 0.2%

Pb: 0.0001% to 0.2%

Sn (tin) and Pb (lead) are the optional elements which are effective in an improvement of coating wettability and coating adhesion. Accordingly, as necessary, at least one of Sn and Pb may be added to the steel. In order to obtain the effects, preferably, Sn content may be 0.0001% or more and Pb content may be 0.0001% or more. More preferably, the Sn content may be 0.001% or more. However, when the optional elements are excessively added to the steel, the cracks may occur during the hot working due to high-temperature embrittlement, and surface dents tend to be made on the steel sheet. Accordingly, preferably, the Sn content may be 0.2% or less and the Pb content may be 0.2% or less. More preferably, the contents of both optional elements may be 0.1% or less. Moreover, even when the optional elements having the amount less than the lower limit are included in the steel, the effects in the embodiment are not decreased. In addition, since it is not necessary to add the optional elements to the steel intentionally in order to reduce costs of alloy, lower limits of amounts of the optional elements may be 0%.

Y: 0.0001% to 0.2%

Hf: 0.0001% to 0.2%

Y (yttrium) and Hf (hafnium) are the optional elements which are effective in an improvement of corrosion resistance of the steel sheet. Accordingly, as necessary, at least one of Y and Hf may be added to the steel. In order to obtain the effect, preferably, Y content may be 0.0001% or more and Hf content may be 0.0001% or more. However, when the optional elements are excessively added to the steel, the local deformability such as the hole expansibility may be decreased. Accordingly, preferably, the Y content may be 0.20% or less and the Hf content may be 0.20% or less. Moreover, Y has the effect which forms oxides in the steel and which adsorbs hydrogen in the steel. Accordingly, diffusible hydrogen in the steel is decreased, and an improvement in hydrogen embrittlement resistance properties in the steel sheet can be expected. The effect can be also obtained within the above-described range of the Y content. More preferably, the contents of both optional elements may be 0.1% or less. Moreover, even when the optional elements having the amount less than the lower limit are included in the steel, the effects in the embodiment are not decreased. In addition, since it is not necessary to add the optional elements to the steel intentionally in order to reduce costs of alloy, lower limits of amounts of the optional elements may be 0%.

As described above, the cold-rolled steel sheet according to the embodiment has the chemical composition which includes the above-described base elements and the balance consisting of Fe and unavoidable impurities, or has the chemical composition which includes the above-described base elements, at least one selected from the group consisting of the above-described optional elements, and the balance consisting of Fe and unavoidable impurities.

Moreover, surface treatment may be conducted on the cold-rolled steel sheet according to the embodiment. For example, the surface treatment such as electro coating, hot dip coating, evaporation coating, alloying treatment after coating, organic film formation, film laminating, organic salt and inorganic salt treatment, or non-chrome treatment (non-chromate treatment) may be applied, and thus, the cold-rolled steel sheet may include various kinds of the film (film or coating). For example, a galvanized layer or a galvannealed layer may be arranged on the surface of the cold-rolled steel sheet. Even if the cold-rolled steel sheet includes the above-described coating, the steel sheet can obtain the high-strength and can sufficiently secure the uniform deformability and the local deformability.

Moreover, in the embodiment, a thickness of the cold-rolled steel sheet is not particularly limited. However, for example, the thickness may be 1.5 mm to 10 mm, and may be 2.0 mm to 10 mm. Moreover, the strength of the cold-rolled steel sheet is not particularly limited, and for example, the tensile strength may be 440 MPa to 1500 MPa.

The cold-rolled steel sheet according to the embodiment can be applied to general use for the high-strength steel sheet, and has the excellent uniform deformability and the remarkably improved local deformability such as the bending workability or the hole expansibility of the high-strength steel sheet.

Next, a method for producing the cold-rolled steel sheet according to an embodiment of the present invention will be described. In order to produce the cold-rolled steel sheet which has the high-strength, the excellent uniform deformability, and the excellent local deformability, it is important to control the chemical composition of the steel, the metallographic structure, and the texture which is represented by the pole densities of each orientation of a specific crystal orientation group. The details will be described below.

The production process prior to the hot-rolling is not particularly limited. For example, the steel (molten steel) may be obtained by conducting a smelting and a refining using a blast furnace, an electric furnace, a converter, or the like, and subsequently, by conducting various kinds of secondary refining, in order to melt the steel satisfying the chemical composition. Thereafter, in order to obtain a steel piece or a slab from the steel, for example, the steel can be cast by a casting process such as a continuous casting process, an ingot making process, or a thin slab casting process in general. In the case of the continuous casting, the steel may be subjected to the hot-rolling after the steel is cooled once to a lower temperature (for example, room temperature) and is reheated, or the steel (cast slab) may be continuously subjected to the hot-rolling just after the steel is cast. In addition, scrap may be used for a raw material of the steel (molten steel).

In order to obtain the high-strength steel sheet which has the high-strength, the excellent uniform deformability, and the excellent local deformability, the following conditions may be satisfied. Moreover, hereinafter, the "steel" and the "steel sheet" are synonymous.

First-Hot-Rolling Process

In the first-hot-rolling process, using the molten and cast steel piece, a rolling pass whose reduction is 40% or more is conducted at least once in a temperature range of 1000° C. to 1200° C. (preferably, 1150° C. or lower). By conducting the first-hot-rolling under the conditions, the average grain size of the austenite of the steel sheet after the first-hot-rolling process is controlled to 200 μm or less, which contributes to the improvement in the uniform deformability and the local deformability of the finally obtained cold-rolled steel sheet.

The austenite grains are refined with an increase in the reduction and an increase in the frequency of the rolling. For example, in the first-hot-rolling process, by conducting at least two times (two passes) of the rolling whose reduction is 40% or more per one pass, the average grain size of the austenite may be preferably controlled to 100 μm or less. In addition, in the first-hot-rolling, by limiting the reduction to 70% or less per one pass, or by limiting the frequency of the rolling (the number of times of passes) to 10 times or less, a temperature fall of the steel sheet or excessive formation of scales may can be decreased. Accordingly, in the rough rolling, the reduction per one pass may be 70% or less, and the frequency of the rolling (the number of times of passes) may be 10 times or less.

As described above, by refining the austenite grains after the first-hot-rolling process, it is preferable that the austenite grains can be further refined by the post processes, and the ferrite, the bainite, and the martensite transformed from the austenite at the post processes may be finely and uniformly dispersed. Moreover, the above is one of the conditions in order to control the Lankford-value such as rC or r30. As a result, the anisotropy and the local deformability of the steel sheet are improved due to the fact that the texture is controlled, and the uniform deformability and the local deformability (particularly, uniform deformability) of the steel sheet are improved due to the fact that the metallographic structure is refined. Moreover, it seems that the grain boundary of the austenite refined by the first-hot-rolling process acts as one of recrystallization nuclei during a second-hot-rolling process which is the post process.

In order to inspect the average grain size of the austenite after the first-hot-rolling process, it is preferable that the steel sheet after the first-hot-rolling process is rapidly cooled at a cooling rate as fast as possible. For example, the steel sheet is cooled under the average cooling rate of 10° C./second or faster. Subsequently, the cross-section of the sheet piece which is taken from the steel sheet obtained by the cooling is etched in order to make the austenite grain boundary visible, and the austenite grain boundary in the microstructure is observed by an optical microscope. At the time, visual fields of 20 or more are observed at a magnification of 50-fold or more, the grain size of the austenite is measured by the image analysis or the intercept method, and the average grain size of the austenite is obtained by averaging the austenite grain sizes measured at each of the visual fields.

After the first-hot-rolling process, sheet bars may be joined, and the second-hot-rolling process which is the post process may be continuously conducted. At the time, the sheet bars may be joined after a rough bar is temporarily coiled in a coil shape, stored in a cover having a heater as necessary, and recoiled again.

Second-Hot-Rolling Process

In the second-hot-rolling process, when a temperature calculated by a following Expression 4 is defined as T1 in unit of ° C., the steel sheet after the first-hot-rolling process is subjected to a rolling under conditions such that, a large reduction pass whose reduction is 30% or more in a temperature range of T1+30° C. to T1+200° C. is included, a cumulative reduction in the temperature range of T1+30° C. to T1+200° C. is 50% or more, a cumulative reduction in a temperature range of $Ar_3$° C. to lower than T1+30° C. is limited to 30% or less, and a rolling finish temperature is $Ar_3$° C. or higher.

As one of the conditions in order to control the average pole density D1 of the orientation group of {100}<011> to {223}<110> and the pole density D2 of the crystal orientation {332}<113> in the thickness central portion which is the thickness range of ⅝ to ⅜ to the above-described ranges, in the second-hot-rolling process, the rolling is controlled based on the temperature T1 (unit: ° C.) which is determined by the following Expression 4 using the chemical composition (unit: mass %) of the steel.

$$T1=850+10\times([C]+[N])\times[Mn]+350\times[Nb]+250\times[Ti]+40\times[B]+10\times[Cr]+100\times[Mo]+100\times[V] \quad \text{(Expression 4)}$$

In Expression 4, [C], [N], [Mn], [Nb], [Ti], [B], [Cr], [Mo], and [V] represent mass percentages of C, N, Mn, Nb, Ti, B, Cr, Mo, and V respectively.

The amount of the chemical element, which is included in Expression 4 but is not included in the steel, is regarded as 0% for the calculation. Accordingly, in the case of the chemical composition in which the steel includes only the base elements, a following Expression 5 may be used instead of the Expression 4.

$$T1=850+10\times([C]+[N])\times[Mn] \quad \text{(Expression 5)}$$

In addition, in the chemical composition in which the steel includes the optional elements, the temperature calculated by Expression 4 may be used for T1 (unit: ° C.), instead of the temperature calculated by Expression 5.

In the second-hot-rolling process, on the basis of the temperature T1 (unit: ° C.) obtained by the Expression 4 or 5, the large reduction is included in the temperature range of T1+30° C. to T1+200° C. (preferably, in a temperature range of T1+50° C. to T1+100° C.), and the reduction is limited to a small range (includes 0%) in the temperature range of $Ar_3$° C. to lower than T1+30° C. By conducting the second-hot-rolling process in addition to the first-hot-rolling process, the uniform deformability and the local deformability of the steel sheet is preferably improved. Particularly, by including the large reduction in the temperature range of T1+30° C. to T1+200° C. and by limiting the reduction in the temperature range of $Ar_3$° C. to lower than T1+30° C., the average pole density D1 of the orientation group of {100}<011> to {223}<110> and the pole density D2 of the crystal orientation {332}<113> in the thickness central portion which is the thickness range of ⅝ to ⅜ are sufficiently controlled, and as a result, the anisotropy and the local deformability of the steel sheet are remarkably improved.

The temperature T1 itself is empirically obtained. It is empirically found by the inventors through experiments that the temperature range in which the recrystallization in the austenite range of each steels is promoted can be determined based on the temperature T1. In order to obtain the excellent uniform deformability and the excellent local deformability, it is important to accumulate a large amount of the strain by the rolling and to obtain the fine recrystallized grains. Accordingly, the rolling having plural passes is conducted in the temperature range of T1+30° C. to T1+200° C., and the cumulative reduction is to be 50% or more. Moreover, in order to further promote the recrystallization by the strain accumulation, it is preferable that the cumulative reduction is 70% or more. Moreover, by limiting an upper limit of the cumulative reduction, a rolling temperature can be sufficiently held, and a rolling load can be further suppressed. Accordingly, the cumulative reduction may be 90% or less.

When the rolling having the plural passes is conducted in the temperature range of T1+30° C. to T1+200° C., the strain is accumulated by the rolling, and the recrystallization of the austenite is occurred at an interval between the rolling passes by a driving force derived from the accumulated strain. Specifically, by conducting the rolling having the plural passes in the temperature range of T1+30° C. to T1+200° C., the recrystallization is repeatedly occurred every pass. Accordingly, it is possible to obtain the recrystallized austenite structure which is uniform, fine, and equiaxial. In the temperature range, dynamic recrystallization is not occurred during the rolling, the strain is accumulated in the crystal, and static recrystallization is occurred at the interval between the rolling passes by the driving force derived from the accumulated strain. In general, in dynamic-recrystallized structure, the strain which introduced during the working is accumulated in the crystal thereof, and a recrystallized area and a non-crystallized area are locally mixed. Accordingly, the texture is comparatively developed, and thus, the anisotropy appears. Moreover, the metallographic structures may be a duplex grain structure. In the method for producing the cold-rolled steel sheet according to the embodiment, the austenite is recrystallized by the static recrystallization. Accordingly, it is possible to obtain the recrystallized austenite structure which is uniform, fine, and equiaxial, and in which the development of the texture is suppressed.

In order to increase the homogeneity, and to preferably increase the uniform deformability and the local deformability of the steel sheet, the second-hot-rolling is controlled so as to include at least one large reduction pass whose reduction per one pass is 30% or more in the temperature range of T1+30° C. to T1+200° C. In the second-hot-rolling, in the temperature range of T1+30° C. to T1+200° C., the rolling whose reduction per one pass is 30% or more is conducted at least once. Particularly, considering a cooling process as described below, the reduction of a final pass in the temperature range may be preferably 25% or more, and may be more preferably 30% or more. Specifically, it is preferable that the final pass in the temperature range is the large reduction pass (the rolling pass with the reduction of 30% or more). In a case that the further excellent deformability is required in the steel sheet, it is further preferable that all reduction of first half passes are less than 30% and the reductions of the final two passes are individually 30% or more. In order to more preferably increase the homogeneity of the steel sheet, a large reduction pass whose reduction per one pass is 40% or more may be conducted. Moreover, in order to obtain a more excellent shape of the steel sheet, a large reduction pass whose reduction per one pass is 70% or less may be conducted.

Moreover, as one of conditions in order that the rL and the r60 satisfy respectively $rL \geq 0.70$ and $r60 \leq 1.50$, for example, it is preferable that a temperature rise of the steel sheet between passes of the rolling in the temperature range of T1+30° C. to T1+200° C. is suppressed to 18° C. or lower, in addition to an appropriately control of a waiting time t as described below. Moreover, by the above, it is possible to preferably obtain the recrystallized austenite which is more uniform.

In order to suppress the development of the texture and to keep the equiaxial recrystallized structure, after the rolling in the temperature range of T1+30° C. to T1+200° C., an amount of working in the temperature range of $Ar_3$° C. to lower than T1+30° C. (preferably, T1 to lower than T1+30° C.) is suppressed as small as possible. Accordingly, the cumulative reduction in the temperature range of $Ar_3$° C. to lower than T1+30° C. is limited to 30% or less. In the temperature range, it is preferable that the cumulative reduction is 10% or more in order to obtain the excellent shape of the steel sheet, and it is preferable that the cumulative reduction is 10% or less in order to further improve the anisotropy and the local deformability. In the case, the cumulative reduction may be more preferably 0%. Specifically, in the temperature range of $Ar_3$° C. to lower than T1+30° C., the rolling may not be conducted, and the cumulative reduction is to be 30% or less even when the rolling is conducted.

When the cumulative reduction in the temperature range of $Ar_3$° C. to lower than T1+30° C. is large, the shape of the austenite grain recrystallized in the temperature range of T1+30° C. to T1+200° C. is not to be equiaxial due to the fact that the grain is stretched by the rolling, and the texture is developed again due to the fact that the strain is accumulated by the rolling. Specifically, as the production conditions according to the embodiment, the rolling is controlled at both of the temperature range of T1+30° C. to T1+200° C. and the temperature range of $Ar_3$° C. to lower than T1+30° C. in the second-hot-rolling process. As a result, the austenite is recrystallized so as to be uniform, fine, and equiaxial, the texture, the metallographic structure, and the anisotropy of the steel sheet are controlled, and therefore, the uniform deformability and the local deformability can be improved. In addition, the austenite is recrystallized so as to be uniform, fine, and equiaxial, and therefore, the metallographic structure, the texture, the Lankford-value, or the like of the finally obtained cold-rolled steel sheet can be controlled.

In the second-hot-rolling process, when the rolling is conducted in the temperature range lower than $Ar_3$° C. or the cumulative reduction in the temperature range of $Ar_3$° C. to lower than T1+30° C. is excessive large, the texture of the austenite is developed. As a result, the finally obtained cold-rolled steel sheet does not satisfy at least one of the condition in which the average pole density D1 of the orientation group of {100}<011> to {223}<110> is 1.0 to 5.0 and the condition in which the pole density D2 of the crystal orientation {332}<113> is 1.0 to 4.0 in the thickness central portion. On the other hand, in the second-hot-rolling process, when the rolling is conducted in the temperature range higher than T1+200° C. or the cumulative reduction in the temperature range of T1+30° C. to T1+200° C. is excessive small, the recrystallization is not uniformly and finely occurred, coarse grains or mixed grains may be included in the metallographic structure, and the metallographic structure may be the duplex grain structure. Accordingly, the area fraction or the volume average diameter of the grains which is more than 35 μm is increased.

Moreover, when the second-hot-rolling is finished at a temperature lower than $Ar_3$ (unit: ° C.), the steel is rolled in a temperature range of the rolling finish temperature to lower than $Ar_3$ (unit: ° C.) which is a range where two phases of the austenite and the ferrite exist (two-phase temperature range). Accordingly, the texture of the steel sheet is developed, and the anisotropy and the local deformability of the steel sheet significantly deteriorate. Here, when the rolling finish temperature of the second-hot-rolling is T1 or more, the anisotropy may be further decreased by decreasing an amount of the strain in the temperature range lower than T1, and as a result, the local deformability may be further increased. Therefore, the rolling finish temperature of the second-hot-rolling may be T1 or more.

Here, the reduction can be obtained by measurements or calculations from a rolling force, a thickness, or the like. Moreover, the rolling temperature (for example, the above each temperature range) can be obtained by measurements using a thermometer between stands, by calculations using a simulation in consideration of deformation heating, line speed, the reduction, or the like, or by both (measurements and calculations). Moreover, the above reduction per one pass is a percentage of a reduced thickness per one pass (a difference between an inlet thickness before passing a rolling stand and an outlet thickness after passing the rolling stand) to the inlet thickness before passing the rolling stand. The cumulative reduction is a percentage of a cumulatively reduced thickness (a difference between an inlet thickness before a first pass in the rolling in each temperature range and an outlet thickness after a final pass in the rolling in each temperature range) to the reference which is the inlet thickness before the first pass in the rolling in each temperature range. $Ar_3$, which is a ferritic transformation temperature from the austenite during the cooling, is obtained by a following Expression 6 in unit of ° C. Moreover, although it is difficult to quantitatively show the effects as described above, Al and Co also influence $Ar_3$.

$$Ar_3=879.4-516.1\times[C]-65.7\times[Mn]+38.0\times[Si]+274.7\times[P] \quad \text{(Expression 6)}$$

In the Expression 6, [C], [Mn], [Si] and [P] represent mass percentages of C, Mn, Si and P respectively.

First-Cooling Process

In the first-cooling process, after a final pass among the large reduction passes whose reduction per one pass is 30% or more in the temperature range of T1+30° C. to T1+200° C. is finished, when a waiting time from the finish of the final pass to a start of the cooling is defined as tin unit of second, the steel sheet is subjected to the cooling so that the waiting time t satisfies a following Expression 7. Here, t1 in the Expression 7 can be obtained from a following Expression 8. In the Expression 8, Tf represents a temperature (unit: ° C.) of the steel sheet at the finish of the final pass among the large reduction passes, and P1 represents a reduction (unit: %) at the final pass among the large reduction passes.

$$t\leq 2.5\times t1 \quad \text{(Expression 7)}$$

$$t1=0.001\times((Tf-T1)\times P1/100)^2-0.109\times((Tf-T1)\times P1/100)+3.1 \quad \text{(Expression 8)}$$

The first-cooling after the final large reduction pass significantly influences the grain size of the finally obtained cold-rolled steel sheet. Moreover, by the first-cooling, the austenite can be controlled to be a metallographic structure in which the grains are equiaxial and the coarse grains rarely are included (namely, uniform sizes). Accordingly, the finally obtained cold-rolled steel sheet has the metallographic structure in which the grains are equiaxial and the coarse grains rarely are included (namely, uniform sizes), and the texture, the Lankford-value, or the like can be controlled. In addition, the ratio of the major axis to the minor axis of the martensite, the average size of the martensite, the average distance between the martensite, and the like may be preferably controlled.

The right side value (2.5×t1) of the Expression 7 represents a time at which the recrystallization of the austenite is substantially finished. When the waiting time t is more than the right side value (2.5×t1) of the Expression 7, the recrystallized grains are significantly grown, and the grain size is increased. Accordingly, the strength, the uniform deformability, the local deformability, the fatigue properties, or the like of the steel sheet are decreased. Therefore, the waiting time t is to be 2.5×t1 seconds or less. In a case where runnability (for example, shape straightening or controllability of a second-cooling) is considered, the first-cooling may be conducted between rolling stands. Moreover, a lower limit of the waiting time t is to be 0 seconds or more.

Moreover, when the waiting time t is limited to 0 second to shorter than t1 seconds so that $0\leq t<t1$ is satisfied, it may be possible to significantly suppress the grain growth. In the case, the volume average diameter of the finally obtained cold-rolled steel sheet may be controlled to 30 μm or less. As a result, even if the recrystallization of the austenite does not sufficiently progress, the properties of the steel sheet, particularly, the uniform deformability, the fatigue properties, or the like may be preferably improved.

Moreover, when the waiting time t is limited to t1 seconds to 2.5×t1 seconds so that $t1\leq t\leq 2.5\times t1$ is satisfied, it may be possible to suppress the development of the texture. In the case, although the volume average diameter may be increased because the waiting time t is prolonged as compared with the case where the waiting time t is shorter than t1 seconds, the crystal orientation may be randomized because the recrystallization of the austenite sufficiently progresses. As a result, the r value, the anisotropy, the local deformability, or the like of the steel sheet may be preferably improved.

Moreover, the above-described first-cooling may be conducted at an interval between the rolling stands in the temperature range of T1+30° C. to T1+200° C., or may be conducted after a final rolling stand in the temperature range. Specifically, as long as the waiting time t satisfies the condition, a rolling whose reduction per one pass is 30% or less may be further conducted in the temperature range of T1+30° C. to T1+200° C. and between the finish of the final pass among the large reduction passes and the start of the first-cooling. Moreover, after the first-cooling is conducted, as long as the reduction per one pass is 30% or less, the rolling may be further conducted in the temperature range of T1+30° C. to T1+200° C. Similarly, after the first-cooling is conducted, as long as the cumulative reduction is 30% or less, the rolling may be further conducted in the temperature range of $Ar_3$° C. to T1+30° C. (or $Ar_3$° C. to Tf° C.). As described above, as long as the waiting time t after the large reduction pass satisfies the condition, in order to control the metallographic structure of the finally obtained hot-rolled steel sheet, the above-described first-cooling may be conducted either at the interval between the rolling stands or after the rolling stand.

In the first-cooling, it is preferable that a cooling temperature change which is a difference between a steel sheet temperature (steel temperature) at the cooling start and a steel sheet temperature (steel temperature) at the cooling finish is 40° C. to 140° C. When the cooling temperature change is 40° C. or higher, the growth of the recrystallized austenite grains may be further suppressed. When the cooling temperature change is 140° C. or lower, the recrystallization may more sufficiently progress, and the pole density may be preferably improved. Moreover, by limiting the cooling temperature change to 140° C. or lower, in addition to the comparatively easy control of the temperature of the steel sheet, variant selection (variant limitation) may be more effectively controlled, and the development of the recrystallized texture may be preferably controlled. Accordingly, in the case, the isotropy may be further increased, and the orientation dependence of the formability may be further decreased. When the cooling temperature change is higher than 140° C., the progress of the recrystallization may be insufficient, the intended texture may not be obtained, the ferrite may not be easily obtained, and the hardness of the obtained ferrite is increased. Accordingly, the uniform deformability and the local deformability of the steel sheet may be decreased.

Moreover, it is preferable that the steel sheet temperature T2 at the first-cooling finish is T1+100° C. or lower. When the steel sheet temperature T2 at the first-cooling finish is T1+100° C. or lower, more sufficient cooling effects are obtained. By the cooling effects, the grain growth may be suppressed, and the growth of the austenite grains may be further suppressed.

Moreover, it is preferable that an average cooling rate in the first-cooling is 50° C./second or faster. When the average cooling rate in the first-cooling is 50° C./second or faster, the growth of the recrystallized austenite grains may be further suppressed. On the other hand, it is not particularly necessary to prescribe an upper limit of the average cooling rate. However, from a viewpoint of the sheet shape, the average cooling rate may be 200° C./second or slower.

Second-Cooling Process

In the second-cooling process, the steel sheet after the second-hot-rolling and after the first-cooling process is cooled to a temperature range of the room temperature to 600° C. Preferably, the steel sheet may be cooled to the temperature range of the room temperature to 600° C. under the average cooling rate of 10° C./second to 300° C./second. When a second-cooling stop temperature is 600° C. or higher or the average cooling rate is 10° C./second or slower, the surface qualities may deteriorate due to surface oxidation of the steel sheet. Moreover, the anisotropy of the cold-rolled steel sheet may be increased, and the local deformability may be significantly decreased. The reason why the steel sheet is cooled under the average cooling rate of 300° C./second or slower is the following. When the steel sheet is cooled under the average cooling rate of faster than 300° C./second, the martensite transformation may be promoted, the strength may be significantly increased, and the cold-rolling may not be easily conducted. Moreover, it is not particularly necessary to prescribe a lower limit of the cooling stop temperature of the second-cooling process. However, in a case where water cooling is conducted, the lower limit may be the room temperature. In addition, it is preferable to start the second-cooling within 3 seconds after finishing the second-hot-rolling or after the first-cooling process. When the second-cooling start exceeds 3 seconds, coarsening of the austenite may occur.

Coiling Process

In the coiling process, after the hot-rolled steel sheet is obtained as described above, the steel sheet is coiled in the temperature range of the room temperature to 600° C. When the steel sheet is coiled at the temperature of 600° C. or higher, the anisotropy of the steel sheet after the cold-rolling may be increased, and the local deformability may be significantly decreased. The steel sheet after the coiling process has the metallographic structure which is uniform, fine, and equiaxial, the texture which is random orientation, and the excellent Lankford-value. By producing the cold-rolled steel sheet using the steel sheet, it is possible to obtain the cold-rolled steel sheet which simultaneously has the high-strength, the excellent uniform deformability, the excellent local deformability, and the excellent Lankford-value. Moreover, the metallographic structure of the steel sheet after the coiling process mainly includes the ferrite, the bainite, the martensite, the residual austenite, or the like.

Pickling Process

In the pickling process, in order to remove surface scales of the steel sheet after the coiling process, the pickling is conducted. A pickling method is not particularly limited, and a general pickling method such as sulfuric acid, or nitric acid may be applied.

Cold-Rolling Process

In the cold-rolling process, the steel sheet after the pickling process is subjected to the cold-rolling in which the cumulative reduction is 30% to 70%. When the cumulative reduction is 30% or less, in a heating-and-holding (annealing) process which is the post process, the recrystallization is hardly occurred, the area fraction of the equiaxial grains is decreased, and the grains after the annealing are coarsened. When the cumulative reduction is 70% or more, in the heating-and-holding (annealing) process which is the post process, the texture is developed, the anisotropy of the steel sheet is increased, and the local deformability or the Lankford-value deteriorates.

After the cold-rolling process, a skin pass rolling may be conducted as necessary. By the skin pass rolling, it may be possible to suppress a stretcher strain which is formed during working of the steel sheet, or to straighten the shape of the steel sheet.

Heating-and-Holding (Annealing) Process

In the heating-and-holding (annealing) process, the steel sheet after the cold-rolling process is subjected to the heating-and-holding in a temperature range of 750° C. to 900° C. for 1 second to 1000 seconds. When the heating-and-holding of lower than 750° C. or shorter than 1 second is conducted, a reverse transformation from the ferrite to the austenite does not sufficiently progress, and the martensite which is the secondary phase cannot be obtained in the cooling process which is the post process. Accordingly, the strength and the uniform deformability of the cold-rolled steel sheet are decreased. On the other hand, when the heating-and-holding of higher than 900° C. or longer than 1000 seconds is conducted, the austenite grains are coarsened. Therefore, the area fraction of the coarse grains of the cold-rolled steel sheet is increased.

Third-Cooling Process

In the third-cooling process, the steel sheet after the heating-and-holding (annealing) process is cooled to a temperature range of 580° C. to 720° C. under an average cooling rate of 1° C./second to 12° C./second. When the average cooling rate is slower than 1° C./second or the third-cooling is finished at a temperature lower than 580° C./second, the ferritic transformation may be excessively promoted, and the intended area fractions of the bainite and the martensite may not be obtained. Moreover, the pearlite may be excessively formed. When the average cooling rate is faster than 12° C./second or the third-cooling is finished at a temperature higher than 720° C., the ferritic transformation may be insufficient. Accordingly, the area fraction of the martensite of the finally obtained cold-rolled steel sheet may be more than 70%. By decreasing the average cooling rate and decreasing the cooling stop temperature within the above-described range, the area fraction of the ferrite can be preferably increased.

Fourth-Cooling Process

In the fourth-cooling process, the steel sheet after the third-cooling process is cooled to a temperature range of 200° C. to 600° C. under an average cooling rate of 4° C./second to 300° C./second. When the average cooling rate is slower than 4° C./second or the fourth-cooling is finished at a temperature higher than 600° C./second, a large amount of the pearlite may be formed, and the martensite of 1% or more in unit of area % may not be finally obtained. When the average cooling rate is faster than 300° C./second or the fourth-cooling is finished at a temperature lower than 200° C., the area fraction of the martensite may be more than 70%. By decreasing the average cooling rate within the above-described range of the average cooling rate, the area fraction of the bainite may be increased. On the other hand, by increasing the average cooling rate within the above-described range of the average cooling rate, the area fraction of the martensite may be increased. In addition, the grain size of the bainite is also refined.

Overageing Treatment Process

In the overageing treatment, when an overageing temperature is defined as T2 in unit of ° C. and an overageing holding time dependent on the overageing temperature T2 is defined as t2 in unit of second, the steel sheet after the fourth-cooling process is held so that the overageing temperature T2 is within a temperature range of 200° C. to 600° C. and the overageing holding time t2 satisfies a following Expression 9. As a result of investigation in detail by the inventors, it is found that the balance between the strength and the ductility (deformability) of the finally obtained cold-rolled steel sheet is improved when the following Expression 9 is satisfied. The reason seems to relate to a rate of bainitic transformation. Moreover, when the Expression 9 is satisfied, the area fraction of the martensite may be preferably controlled to 1% to 70%. Moreover, the Expression 9 is a common logarithm to the base 10.

$$\log(t2) \leq 0.0002 \times (T2-425)^2 + 1.18 \quad \text{(Expression 9)}$$

In accordance with properties required for the cold-rolled steel sheet, the area fractions of the ferrite and the bainite which are the primary phase may be controlled, and the area fraction of the martensite which is the second phase may be controlled. As described above, the ferrite can be mainly controlled in the third-cooling process, and the bainite and the martensite can be mainly controlled in the fourth-cooling process and in the overageing treatment process. In addition, the grain sizes or the morphologies of the ferrite and the bainite which are the primary phase and of the martensite which is the secondary phase significantly depend on the grain size or the morphology of the austenite at the hot-rolling. Moreover, the grain sizes or the morphologies also depend on the processes after the cold-rolling process. Accordingly, for example, the value of TS/fM×dis/dia, which is the relationship of the area fraction fM of the martensite, the average size dia of the martensite, the average distance dis between the martensite, and the tensile strength TS of the steel sheet, may be satisfied by multiply controlling the above-described production processes.

After the overageing treatment process, as necessary, the steel sheet may be coiled. As described above, the cold-rolled steel sheet according to the embodiment can be produced.

Since the cold-rolled steel sheet produced as described above has the metallographic structure which is uniform, fine, and equiaxial and has the texture which is the random orientation, the cold-rolled steel sheet simultaneously has the high-strength, the excellent uniform deformability, the excellent local deformability, and the excellent Lankford-value.

As necessary, the steel sheet after the overageing treatment process may be subjected to a galvanizing. Even if the galvanizing is conducted, the uniform deformability and the local deformability of the cold-rolled steel sheet are sufficiently maintained.

In addition, as necessary, as an alloying treatment, the steel sheet after the galvanizing may be subjected to a heat treatment in a temperature range of 450° C. to 600° C. The reason why the alloying treatment is conducted in the temperature range of 450° C. to 600° C. is the following. When the alloying treatment is conducted at a temperature lower than 450° C., the alloying may be insufficient. Moreover, when the alloying treatment is conducted at a temperature higher than 600° C., the alloying may be excessive, and the corrosion resistance deteriorates.

Moreover, the obtained cold-rolled steel sheet may be subjected to a surface treatment. For example, the surface treatment such as the electro coating, the evaporation coating, the alloying treatment after the coating, the organic film formation, the film laminating, the organic salt and inorganic salt treatment, or the non-chromate treatment may be applied to the obtained cold-rolled steel sheet. Even if the surface treatment is conducted, the uniform deformability and the local deformability are sufficiently maintained.

Moreover, as necessary, a tempering treatment may be conducted as a reheating treatment. By the treatment, the martensite may be softened as the tempered martensite. As a result, the hardness difference between the ferrite and the bainite which are the primary phase and the martensite which is the secondary phase is decreased, and the local deformability such as the hole expansibility or the bendability is improved. The effects of the reheating treatment may be also obtained by heating for the hot dip coating, the alloying treatment, or the like.

EXAMPLE

Hereinafter, the technical features of the aspect of the present invention will be described in detail with reference to the following examples. However, the condition in the examples is an example condition employed to confirm the operability and the effects of the present invention, and therefore, the present invention is not limited to the example condition. The present invention can employ various conditions as long as the conditions do not depart from the scope of the present invention and can achieve the object of the present invention.

Steels S1 to S135 including chemical compositions (the balance consists of Fe and unavoidable impurities) shown in Tables 1 to 6 were examined, and the results are described. After the steels were melt and cast, or after the steels were cooled once to the room temperature, the steels were reheated to the temperature range of 900° C. to 1300° C. Thereafter, the hot-rolling, the cold-rolling, and the temperature control (cooling, heating-and-holding, or the like) were conducted under production conditions shown in Tables 7 to 16, and cold-rolled steel sheets having the thicknesses of 2 to 5 mm were obtained.

In Tables 17 to 26, the characteristics such as the metallographic structure, the texture, or the mechanical properties are shown. Moreover, in Tables, the average pole density of the orientation group of {100}<011> to {223}<110> is shown as D1 and the pole density of the crystal orientation {332}<113> is shown as D2. In addition, the area fractions of the ferrite, the bainite, the martensite, the pearlite, and the residual austenite are shown as F, B, fM, P, and γ respectively. Moreover, the average size of the martensite is shown as dia, and the average distance between the martensite is shown as dis. Moreover, in Tables, the standard deviation ratio of hardness represents a value dividing the standard deviation of the hardness by the average of the hardness with respect to the phase having higher area fraction among the ferrite and the bainite.

As a parameter of the local deformability, the hole expansion ratio λ and the critical bend radius (d/RmC) by 90° V-shape bending of the final product were used. The bending test was conducted to C-direction bending. Moreover, the tensile test (measurement of TS, u-EL and EL), the bending test, and the hole expansion test were respectively conducted based on JIS Z 2241, JIS Z 2248 (V block 90° bending test) and Japan Iron and Steel Federation Standard JFS T1001. Moreover, by using the above-described EBSD, the pole densities were measured by a measurement step of 0.5 μm in the thickness central portion which was the range of ⅝ to ⅜ of the thickness-cross-section (the normal vector thereof corresponded to the normal direction) which was parallel to the rolling direction at ¼ position of the transverse direction. Moreover, the r values (Lankford-values) of each direction were measured based on JIS Z 2254 (2008) (ISO 10113 (2006)). Moreover, the underlined value in the Tables indicates out of the range of the present invention, and the blank column indicates that no alloying element was intentionally added.

Production Nos. P1 to P30 and P112 to P214 are the examples which satisfy the conditions of the present invention. In the examples, since all conditions of TS≥440 (unit: MPa), TS×u−EL≥7000 (unit: MPa·%), TS×λ≥30000 (unit: MPa·%), and d/RmC≥1 (no unit) were simultaneously satisfied, it can be said that the cold-rolled steel sheets have the high-strength, the excellent uniform deformability, and the excellent local deformability.

On the other hand, P31 to P111 are the comparative examples which do not satisfy the conditions of the present invention. In the comparative examples, at least one condition of TS≥440 (unit: MPa), TS×u−EL 7000 (unit: MPa·%), TS×λ≥30000 (unit: MPa·%), and d/RmC≥1 (no unit) was not satisfied.

TABLE 1

| STEEL | CHEMICAL COMPOSITION/mass % | | | | | | | | | | | | | | |
|---|---|---|---|---|---|---|---|---|---|---|---|---|---|---|---|
| No. | C | Si | Mn | Al | P | S | N | O | Mo | Cr | Ni | Cu | B | Nb | Tl |
| S1 | 0.070 | 0.080 | 1.300 | 0.040 | 0.015 | 0.004 | 0.0026 | 0.0032 | | | | | | | |
| S2 | 0.008 | 0.080 | 1.300 | 0.040 | 0.015 | 0.004 | 0.0026 | 0.0032 | | | | | | | |
| S3 | 0.401 | 0.080 | 1.300 | 0.040 | 0.015 | 0.004 | 0.0026 | 0.0032 | | | | | | | |
| S4 | 0.070 | 0.0009 | 1.300 | 0.040 | 0.015 | 0.004 | 0.0026 | 0.0032 | | | | | | | |
| S5 | 0.070 | 2.510 | 1.300 | 0.040 | 0.015 | 0.004 | 0.0026 | 0.0032 | | | | | | | |
| S6 | 0.070 | 0.080 | 0.0009 | 0.040 | 0.015 | 0.004 | 0.0026 | 0.0032 | | | | | | | |
| S7 | 0.070 | 0.080 | 4.010 | 0.040 | 0.015 | 0.004 | 0.0026 | 0.0032 | | | | | | | |
| S8 | 0.070 | 0.080 | 1.300 | 0.0009 | 0.015 | 0.004 | 0.0026 | 0.0110 | | | | | | | |
| S9 | 0.070 | 0.080 | 1.300 | 2.010 | 0.015 | 0.004 | 0.0026 | 0.0032 | | | | | | | |
| S10 | 0.070 | 0.080 | 1.300 | 0.040 | 0.151 | 0.004 | 0.0026 | 0.0032 | | | | | | | |
| S11 | 0.070 | 0.080 | 1.300 | 0.040 | 0.015 | 0.031 | 0.0026 | 0.0032 | | | | | | | |
| S12 | 0.070 | 0.080 | 1.300 | 0.040 | 0.015 | 0.004 | 0.0110 | 0.0032 | | | | | | | |
| S13 | 0.070 | 0.080 | 1.300 | 0.040 | 0.015 | 0.004 | 0.0026 | 0.0110 | | | | | | | |
| S14 | 0.070 | 0.080 | 1.300 | 0.040 | 0.015 | 0.004 | 0.0026 | 0.0032 | 1.010 | | | | | | |
| S15 | 0.070 | 0.080 | 1.300 | 0.040 | 0.015 | 0.004 | 0.0026 | 0.0032 | | 2.010 | | | | | |
| S16 | 0.070 | 0.080 | 1.300 | 0.040 | 0.015 | 0.004 | 0.0026 | 0.0032 | | | 2.010 | | | | |
| S17 | 0.070 | 0.080 | 1.300 | 0.040 | 0.015 | 0.004 | 0.0026 | 0.0032 | | | | 2.010 | | | |
| S18 | 0.070 | 0.080 | 1.300 | 0.040 | 0.015 | 0.004 | 0.0026 | 0.0032 | | | | | 0.0051 | | |
| S19 | 0.070 | 0.080 | 1.300 | 0.040 | 0.015 | 0.004 | 0.0026 | 0.0032 | | | | | | 0.201 | |
| S20 | 0.070 | 0.080 | 1.300 | 0.040 | 0.015 | 0.004 | 0.0026 | 0.0032 | | | | | | | 0.201 |
| S21 | 0.070 | 0.080 | 1.300 | 0.040 | 0.015 | 0.004 | 0.0026 | 0.0032 | | | | | | | |
| S22 | 0.070 | 0.080 | 1.300 | 0.040 | 0.015 | 0.004 | 0.0026 | 0.0032 | | | | | | | |
| S23 | 0 070 | 0.080 | 1.300 | 0.040 | 0.015 | 0.004 | 0.0026 | 0.0032 | | | | | | | |
| S24 | 0.070 | 0.080 | 1.300 | 0.040 | 0.015 | 0.004 | 0.0026 | 0.0032 | | | | | | | |
| S25 | 0.070 | 0.080 | 1.300 | 0.040 | 0.015 | 0.004 | 0.0026 | 0.0032 | | | | | | | |
| S26 | 0.070 | 0.080 | 1.300 | 0.040 | 0.015 | 0.004 | 0.0026 | 0.0032 | | | | | | | |
| S27 | 0.070 | 0.080 | 1.300 | 0.040 | 0.015 | 0.004 | 0.0026 | 0.0032 | | | | | | | |
| S28 | 0.070 | 0.080 | 1.300 | 0.040 | 0.015 | 0.004 | 0.0026 | 0.0032 | | | | | | | |
| S29 | 0.070 | 0.080 | 1.300 | 0.040 | 0.015 | 0.004 | 0.0026 | 0.0032 | | | | | | | |
| S30 | 0.070 | 0.080 | 1.300 | 0.040 | 0.015 | 0.004 | 0.0026 | 0.0032 | | | | | | | |
| S31 | 0.070 | 0.080 | 1.300 | 0.040 | 0.015 | 0.004 | 0.0026 | 0.0032 | | | | | | | |
| S32 | 0.070 | 0.080 | 1.300 | 0.040 | 0.015 | 0.004 | 0.0026 | 0.0032 | | | | | | | |
| S33 | 0.010 | 0.080 | 1.300 | 0.040 | 0.015 | 0.004 | 0.0026 | 0.0032 | | | | | | | |
| S34 | 0.030 | 0.080 | 1.300 | 0.040 | 0.015 | 0.004 | 0.0026 | 0.0032 | | | | | | | |
| S35 | 0.050 | 0.080 | 1.300 | 0.040 | 0.015 | 0.004 | 0.0026 | 0.0032 | | | | | | | |
| S36 | 0.120 | 0.080 | 1.300 | 0.040 | 0.015 | 0.004 | 0.0026 | 0.0032 | | | | | | | |
| S37 | 0.180 | 0.080 | 1.300 | 0.040 | 0.015 | 0.004 | 0.0026 | 0.0032 | | | | | | | |
| S38 | 0.250 | 0.080 | 1.300 | 0.040 | 0.015 | 0.004 | 0.0026 | 0.0032 | | | | | | | |
| S39 | 0.280 | 0.080 | 1.300 | 0.040 | 0.015 | 0.004 | 0.0026 | 0.0032 | | | | | | | |
| S40 | 0.300 | 0.080 | 1.300 | 0.040 | 0.015 | 0.004 | 0.0026 | 0.0032 | | | | | | | |
| S41 | 0.400 | 0.080 | 1.300 | 0.040 | 0.015 | 0.004 | 0.0026 | 0.0032 | | | | | | | |
| S42 | 0.070 | 0.001 | 1.300 | 0.040 | 0.015 | 0.004 | 0.0026 | 0.0032 | | | | | | | |
| S43 | 0.070 | 0.050 | 1.300 | 0.040 | 0.015 | 0.004 | 0.0026 | 0.0032 | | | | | | | |
| S44 | 0.070 | 0.500 | 1.300 | 0.040 | 0.015 | 0.004 | 0.0026 | 0.0032 | | | | | | | |
| S45 | 0.070 | 1.500 | 1.300 | 0.040 | 0.015 | 0.004 | 0.0026 | 0.0032 | | | | | | | |

TABLE 2

| STEEL No. | V | W | Ca | Mg | Zr | REM | As | Co | Sn | Pb | Y | Hf | REMARKS |
|---|---|---|---|---|---|---|---|---|---|---|---|---|---|
| S1 | | | | | | | | | | | | | EXAMPLE |
| S2 | | | | | | | | | | | | | COMPARATIVE EXAMPLE |
| S3 | | | | | | | | | | | | | COMPARATIVE EXAMPLE |
| S4 | | | | | | | | | | | | | COMPARATIVE EXAMPLE |
| S5 | | | | | | | | | | | | | COMPARATIVE EXAMPLE |
| S6 | | | | | | | | | | | | | COMPARATIVE EXAMPLE |
| S7 | | | | | | | | | | | | | COMPARATIVE EXAMPLE |
| S8 | | | | | | | | | | | | | COMPARATIVE EXAMPLE |
| S9 | | | | | | | | | | | | | COMPARATIVE EXAMPLE |
| S10 | | | | | | | | | | | | | COMPARATIVE EXAMPLE |
| S11 | | | | | | | | | | | | | COMPARATIVE EXAMPLE |
| S12 | | | | | | | | | | | | | COMPARATIVE EXAMPLE |
| S13 | | | | | | | | | | | | | COMPARATIVE EXAMPLE |
| S14 | | | | | | | | | | | | | COMPARATIVE EXAMPLE |
| S15 | | | | | | | | | | | | | COMPARATIVE EXAMPLE |
| S16 | | | | | | | | | | | | | COMPARATIVE EXAMPLE |
| S17 | | | | | | | | | | | | | COMPARATIVE EXAMPLE |
| S18 | | | | | | | | | | | | | COMPARATIVE EXAMPLE |
| S19 | | | | | | | | | | | | | COMPARATIVE EXAMPLE |
| S20 | | | | | | | | | | | | | COMPARATIVE EXAMPLE |
| S21 | 1.010 | | | | | | | | | | | | COMPARATIVE EXAMPLE |
| S22 | | 1.010 | | | | | | | | | | | COMPARATIVE EXAMPLE |
| S23 | | | 0.0110 | | | | | | | | | | COMPARATIVE EXAMPLE |
| S24 | | | | 0.0110 | | | | | | | | | COMPARATIVE EXAMPLE |
| S25 | | | | | 0.2010 | | | | | | | | COMPARATIVE EXAMPLE |
| S26 | | | | | | 0.1010 | | | | | | | COMPARATIVE EXAMPLE |
| S27 | | | | | | | 0.5010 | | | | | | COMPARATIVE EXAMPLE |
| S28 | | | | | | | | 1.0100 | | | | | COMPARATIVE EXAMPLE |
| S29 | | | | | | | | | 0.2010 | | | | COMPARATIVE EXAMPLE |
| S30 | | | | | | | | | | 0.2010 | | | COMPARATIVE EXAMPLE |
| S31 | | | | | | | | | | | 0.2010 | | COMPARATIVE EXAMPLE |
| S32 | | | | | | | | | | | | 0.2010 | COMPARATIVE EXAMPLE |
| S33 | | | | | | | | | | | | | EXAMPLE |
| S34 | | | | | | | | | | | | | EXAMPLE |
| S35 | | | | | | | | | | | | | EXAMPLE |
| S36 | | | | | | | | | | | | | EXAMPLE |
| S37 | | | | | | | | | | | | | EXAMPLE |
| S38 | | | | | | | | | | | | | EXAMPLE |
| S39 | | | | | | | | | | | | | EXAMPLE |
| S40 | | | | | | | | | | | | | EXAMPLE |
| S41 | | | | | | | | | | | | | EXAMPLE |
| S42 | | | | | | | | | | | | | EXAMPLE |
| S43 | | | | | | | | | | | | | EXAMPLE |
| S44 | | | | | | | | | | | | | EXAMPLE |
| S45 | | | | | | | | | | | | | EXAMPLE |

| STEEL No. | T1/ ° C. | $Ar_3$/ ° C. | CALCULATED VALUE OF HARDNESS OF FERRITE/— | REMARKS |
|---|---|---|---|---|
| S1 | 851 | 765 | 234 | EXAMPLE |
| S2 | 850 | 797 | 234 | COMPARATIVE EXAMPLE |
| S3 | 855 | 594 | 234 | COMPARATIVE EXAMPLE |
| S4 | 851 | 762 | 231 | COMPARATIVE EXAMPLE |
| S5 | 851 | 857 | 307 | COMPARATIVE EXAMPLE |
| S6 | 850 | 850 | 206 | COMPARATIVE EXAMPLE |
| S7 | 853 | 587 | 291 | COMPARATIVE EXAMPLE |
| S8 | 851 | 765 | 234 | COMPARATIVE EXAMPLE |
| S9 | 851 | 842 | 234 | COMPARATIVE EXAMPLE |
| S10 | 851 | 802 | 270 | COMPARATIVE EXAMPLE |
| S11 | 851 | 765 | 234 | COMPARATIVE EXAMPLE |
| S12 | 851 | 765 | 234 | COMPARATIVE EXAMPLE |
| S13 | 851 | 765 | 234 | COMPARATIVE EXAMPLE |
| S14 | 952 | 765 | 234 | COMPARATIVE EXAMPLE |
| S15 | 871 | 765 | 234 | COMPARATIVE EXAMPLE |
| S16 | 851 | 765 | 234 | COMPARATIVE EXAMPLE |
| S17 | 851 | 765 | 234 | COMPARATIVE EXAMPLE |
| S18 | 851 | 765 | 234 | COMPARATIVE EXAMPLE |
| S19 | 921 | 765 | 269 | COMPARATIVE EXAMPLE |
| S20 | 901 | 765 | 282 | COMPARATIVE EXAMPLE |
| S21 | 952 | 765 | 234 | COMPARATIVE EXAMPLE |
| S22 | 851 | 765 | 234 | COMPARATIVE EXAMPLE |
| S23 | 851 | 765 | 234 | COMPARATIVE EXAMPLE |
| S24 | 851 | 765 | 234 | COMPARATIVE EXAMPLE |
| S25 | 851 | 765 | 234 | COMPARATIVE EXAMPLE |
| S26 | 851 | 765 | 234 | COMPARATIVE EXAMPLE |

TABLE 2-continued

| | | | | |
|---|---|---|---|---|
| S27 | 851 | 765 | 234 | COMPARATIVE EXAMPLE |
| S28 | 851 | 842 | 234 | COMPARATIVE EXAMPLE |
| S29 | 851 | 765 | 234 | COMPARATIVE EXAMPLE |
| S30 | 851 | 765 | 234 | COMPARATIVE EXAMPLE |
| S31 | 851 | 765 | 234 | COMPARATIVE EXAMPLE |
| S32 | 851 | 765 | 234 | COMPARATIVE EXAMPLE |
| S33 | 850 | 796 | 234 | EXAMPLE |
| S34 | 850 | 786 | 234 | EXAMPLE |
| S35 | 851 | 775 | 234 | EXAMPLE |
| S36 | 852 | 739 | 234 | EXAMPLE |
| S37 | 852 | 708 | 234 | EXAMPLE |
| S38 | 853 | 672 | 234 | EXAMPLE |
| S39 | 854 | 657 | 234 | EXAMPLE |
| S40 | 854 | 646 | 234 | EXAMPLE |
| S41 | 855 | 595 | 234 | EXAMPLE |
| S42 | 851 | 762 | 231 | EXAMPLE |
| S43 | 851 | 764 | 233 | EXAMPLE |
| S44 | 851 | 781 | 246 | EXAMPLE |
| S45 | 851 | 819 | 276 | EXAMPLE |

TABLE 3

| STEEL | CHEMICAL COMPOSITION/mass % | | | | | | | | | | | | | | |
|---|---|---|---|---|---|---|---|---|---|---|---|---|---|---|---|
| No. | C | Si | Mn | Al | P | S | N | O | Mo | Cr | Ni | Cu | B | Nb | Ti |
| S46 | 0.070 | 2.500 | 1.300 | 0.040 | 0.015 | 0.004 | 0.0026 | 0.0032 | | | | | | | |
| S47 | 0.070 | 0.080 | 0.001 | 0.040 | 0.015 | 0.004 | 0.0026 | 0.0032 | | | | | | | |
| S48 | 0.070 | 0.080 | 0.050 | 0.040 | 0.015 | 0.004 | 0.0026 | 0.0032 | | | | | | | |
| S49 | 0.070 | 0.080 | 0.500 | 0.040 | 0.015 | 0.004 | 0.0026 | 0.0032 | | | | | | | |
| S50 | 0.070 | 0.080 | 1.500 | 0.040 | 0.015 | 0.004 | 0.0026 | 0.0032 | | | | | | | |
| S51 | 0.070 | 0.080 | 2.500 | 0.040 | 0.015 | 0.004 | 0.0026 | 0.0032 | | | | | | | |
| S52 | 0.070 | 0.080 | 3.000 | 0.040 | 0.015 | 0.004 | 0.0026 | 0.0032 | | | | | | | |
| S53 | 0.070 | 0.080 | 3.300 | 0.040 | 0.015 | 0.004 | 0.0026 | 0.0032 | | | | | | | |
| S54 | 0.070 | 0.080 | 3.500 | 0.040 | 0.015 | 0.004 | 0.0026 | 0.0032 | | | | | | | |
| S55 | 0.070 | 0.080 | 4.000 | 0.040 | 0.015 | 0.004 | 0.0026 | 0.0032 | | | | | | | |
| S56 | 0.070 | 0.080 | 1.300 | 0.001 | 0.015 | 0.004 | 0.0026 | 0.0032 | | | | | | | |
| S57 | 0.070 | 0.080 | 1.300 | 0.050 | 0.015 | 0.004 | 0.0026 | 0.0032 | | | | | | | |
| S58 | 0.070 | 0.080 | 1.300 | 0.500 | 0.015 | 0.004 | 0.0026 | 0.0032 | | | | | | | |
| S59 | 0.070 | 0.080 | 1.300 | 1.500 | 0.015 | 0.004 | 0.0026 | 0.0032 | | | | | | | |
| S60 | 0.070 | 0.080 | 1.300 | 2.000 | 0.015 | 0.004 | 0.0026 | 0.0032 | | | | | | | |
| S61 | 0.070 | 0.080 | 1.300 | 0.040 | 0.0005 | 0.004 | 0.0026 | 0.0032 | | | | | | | |
| S62 | 0.070 | 0.080 | 1.300 | 0.040 | 0.030 | 0.004 | 0.0026 | 0.0032 | | | | | | | |
| S63 | 0.070 | 0.080 | 1.300 | 0.040 | 0.050 | 0.004 | 0.0026 | 0.0032 | | | | | | | |
| S64 | 0.070 | 0.080 | 1.300 | 0.040 | 0.100 | 0.004 | 0.0026 | 0.0032 | | | | | | | |
| S65 | 0.070 | 0.080 | 1.300 | 0.040 | 0.150 | 0.004 | 0.0026 | 0.0032 | | | | | | | |
| S66 | 0.070 | 0.080 | 1.300 | 0.040 | 0.015 | 0.0005 | 0.0026 | 0.0032 | | | | | | | |
| S67 | 0.070 | 0.080 | 1.300 | 0.040 | 0.015 | 0.010 | 0.0026 | 0.0032 | | | | | | | |
| S68 | 0.070 | 0.080 | 1.300 | 0.040 | 0.015 | 0.030 | 0.0026 | 0.0032 | | | | | | | |
| S69 | 0.070 | 0.080 | 1.300 | 0.040 | 0.015 | 0.004 | 0.0005 | 0.0032 | | | | | | | |
| S70 | 0.070 | 0.080 | 1.300 | 0.040 | 0.015 | 0.004 | 0.0050 | 0.0032 | | | | | | | |
| S71 | 0.070 | 0.080 | 1.300 | 0.040 | 0.015 | 0.004 | 0.0100 | 0.0032 | | | | | | | |
| S72 | 0.070 | 0.080 | 1.300 | 0.040 | 0.015 | 0.004 | 0.0026 | 0.0005 | | | | | | | |
| S73 | 0.070 | 0.080 | 1.300 | 0.040 | 0.015 | 0.004 | 0.0026 | 0.0050 | | | | | | | |
| S74 | 0.070 | 0.080 | 1.300 | 0.040 | 0.015 | 0.004 | 0.0026 | 0.0100 | | | | | | | |
| S75 | 0.070 | 0.080 | 1.300 | 0.040 | 0.015 | 0.004 | 0.0026 | 0.0032 | | | | | | | 0.0009 |
| S76 | 0.070 | 0.080 | 1.300 | 0.040 | 0.015 | 0.004 | 0.0026 | 0.0032 | | | | | | | 0.003 |
| S77 | 0.070 | 0.080 | 1.300 | 0.040 | 0.015 | 0.004 | 0.0026 | 0.0032 | | | | | | | 0.144 |
| S78 | 0.070 | 0.080 | 1.300 | 0.040 | 0.015 | 0.004 | 0.0026 | 0.0032 | | | | | | 0.0009 | |
| S79 | 0.070 | 0.080 | 1.300 | 0.040 | 0.015 | 0.004 | 0.0026 | 0.0032 | | | | | | 0.003 | |
| S80 | 0.070 | 0.080 | 1.300 | 0.040 | 0.015 | 0.004 | 0.0026 | 0.0032 | | | | | | 0.150 | |
| S81 | 0.070 | 0.080 | 1.300 | 0.040 | 0.015 | 0.004 | 0.0026 | 0.0032 | | | | | 0.00009 | | |
| S82 | 0.070 | 0.080 | 1.300 | 0.040 | 0.015 | 0.004 | 0.0026 | 0.0032 | | | | | 0.0008 | | |
| S83 | 0.070 | 0.080 | 1.300 | 0.040 | 0.015 | 0.004 | 0.0026 | 0.0032 | | | | | 0.0030 | | |
| S84 | 0.070 | 0.080 | 1.300 | 0.040 | 0.015 | 0.004 | 0.0026 | 0.0032 | | | | | 0.0050 | | |
| S85 | 0.070 | 0.080 | 1.300 | 0.040 | 0.015 | 0.004 | 0.0026 | 0.0032 | | | | | | | |
| S86 | 0.070 | 0.080 | 1.300 | 0.040 | 0.015 | 0.004 | 0.0026 | 0.0032 | | | | | | | |
| S87 | 0.070 | 0.080 | 1.300 | 0.040 | 0.015 | 0.004 | 0.0026 | 0.0032 | | | | | | | |
| S88 | 0.070 | 0.080 | 1.300 | 0.040 | 0.015 | 0.004 | 0.0026 | 0.0032 | | | | | | | |
| S89 | 0.070 | 0.080 | 1.300 | 0.040 | 0.015 | 0.004 | 0.0026 | 0.0032 | | | | | | | |
| S90 | 0.070 | 0.080 | 1.300 | 0.040 | 0.015 | 0.004 | 0.0026 | 0.0032 | | | | | | | |

TABLE 4

| STEEL No. | V | W | Ca | Mg | Zr | REM | As | Co | Sn | Pb | Y | Hf | REMARKS |
|---|---|---|---|---|---|---|---|---|---|---|---|---|---|
| S46 | | | | | | | | | | | | | EXAMPLE |
| S47 | | | | | | | | | | | | | EXAMPLE |
| S48 | | | | | | | | | | | | | EXAMPLE |
| S49 | | | | | | | | | | | | | EXAMPLE |
| S50 | | | | | | | | | | | | | EXAMPLE |
| S51 | | | | | | | | | | | | | EXAMPLE |
| S52 | | | | | | | | | | | | | EXAMPLE |
| S53 | | | | | | | | | | | | | EXAMPLE |
| S54 | | | | | | | | | | | | | EXAMPLE |
| S55 | | | | | | | | | | | | | EXAMPLE |
| S56 | | | | | | | | | | | | | EXAMPLE |
| S57 | | | | | | | | | | | | | EXAMPLE |
| S58 | | | | | | | | | | | | | EXAMPLE |
| S59 | | | | | | | | | | | | | EXAMPLE |
| S60 | | | | | | | | | | | | | EXAMPLE |
| S61 | | | | | | | | | | | | | EXAMPLE |
| S62 | | | | | | | | | | | | | EXAMPLE |
| S63 | | | | | | | | | | | | | EXAMPLE |
| S64 | | | | | | | | | | | | | EXAMPLE |
| S65 | | | | | | | | | | | | | EXAMPLE |
| S66 | | | | | | | | | | | | | EXAMPLE |
| S67 | | | | | | | | | | | | | EXAMPLE |
| S68 | | | | | | | | | | | | | EXAMPLE |
| S69 | | | | | | | | | | | | | EXAMPLE |
| S70 | | | | | | | | | | | | | EXAMPLE |
| S71 | | | | | | | | | | | | | EXAMPLE |
| S72 | | | | | | | | | | | | | EXAMPLE |
| S73 | | | | | | | | | | | | | EXAMPLE |
| S74 | | | | | | | | | | | | | EXAMPLE |
| S75 | | | | | | | | | | | | | EXAMPLE |
| S76 | | | | | | | | | | | | | EXAMPLE |
| S77 | | | | | | | | | | | | | EXAMPLE |
| S78 | | | | | | | | | | | | | EXAMPLE |
| S79 | | | | | | | | | | | | | EXAMPLE |
| S80 | | | | | | | | | | | | | EXAMPLE |
| S81 | | | | | | | | | | | | | EXAMPLE |
| S82 | | | | | | | | | | | | | EXAMPLE |
| S83 | | | | | | | | | | | | | EXAMPLE |
| S84 | | | | | | | | | | | | | EXAMPLE |
| S85 | | | | 0.00009 | | | | | | | | | EXAMPLE |
| S86 | | | | 0.0003 | | | | | | | | | EXAMPLE |
| S87 | | | | 0.0050 | | | | | | | | | EXAMPLE |
| S88 | | | | | | 0.00009 | | | | | | | EXAMPLE |
| S89 | | | | | | 0.0005 | | | | | | | EXAMPLE |
| S90 | | | | | | 0.0050 | | | | | | | EXAMPLE |

| STEEL No. | T1/ ° C. | $Ar_3$/ ° C. | CALCULATED VALUE OF HARDNESS OF FERRITE/— | REMARKS |
|---|---|---|---|---|
| S46 | 851 | 857 | 306 | EXAMPLE |
| S47 | 850 | 850 | 206 | EXAMPLE |
| S48 | 850 | 847 | 208 | EXAMPLE |
| S49 | 850 | 818 | 217 | EXAMPLE |
| S50 | 851 | 752 | 238 | EXAMPLE |
| S51 | 852 | 686 | 259 | EXAMPLE |
| S52 | 852 | 653 | 269 | EXAMPLE |
| S53 | 852 | 634 | 276 | EXAMPLE |
| S54 | 853 | 620 | 280 | EXAMPLE |
| S55 | 853 | 588 | 290 | EXAMPLE |
| S56 | 851 | 765 | 234 | EXAMPLE |
| S57 | 851 | 767 | 234 | EXAMPLE |
| S58 | 851 | 784 | 234 | EXAMPLE |
| S59 | 851 | 822 | 234 | EXAMPLE |
| S60 | 851 | 842 | 234 | EXAMPLE |
| S61 | 851 | 761 | 230 | EXAMPLE |
| S62 | 851 | 769 | 238 | EXAMPLE |
| S63 | 851 | 775 | 243 | EXAMPLE |
| S64 | 851 | 788 | 257 | EXAMPLE |
| S65 | 851 | 802 | 270 | EXAMPLE |
| S66 | 851 | 765 | 234 | EXAMPLE |
| S67 | 851 | 765 | 234 | EXAMPLE |
| S68 | 851 | 765 | 234 | EXAMPLE |
| S69 | 851 | 765 | 234 | EXAMPLE |
| S70 | 851 | 765 | 234 | EXAMPLE |
| S71 | 851 | 765 | 234 | EXAMPLE |

TABLE 4-continued

| | | | | |
|---|---|---|---|---|
| S72 | 851 | 765 | 234 | EXAMPLE |
| S73 | 851 | 765 | 234 | EXAMPLE |
| S74 | 851 | 765 | 234 | EXAMPLE |
| S75 | 851 | 765 | 237 | EXAMPLE |
| S76 | 852 | 765 | 240 | EXAMPLE |
| S77 | 887 | 765 | 275 | EXAMPLE |
| S78 | 851 | 765 | 236 | EXAMPLE |
| S79 | 852 | 765 | 238 | EXAMPLE |
| S80 | 903 | 765 | 264 | EXAMPLE |
| S81 | 851 | 765 | 234 | EXAMPLE |
| S82 | 851 | 765 | 234 | EXAMPLE |
| S83 | 851 | 765 | 234 | EXAMPLE |
| S84 | 851 | 765 | 234 | EXAMPLE |
| S85 | 851 | 765 | 234 | EXAMPLE |
| S86 | 851 | 765 | 234 | EXAMPLE |
| S87 | 851 | 765 | 234 | EXAMPLE |
| S88 | 851 | 765 | 234 | EXAMPLE |
| S89 | 851 | 765 | 234 | EXAMPLE |
| S90 | 851 | 765 | 234 | EXAMPLE |

TABLE 5

| STEEL | CHEMICAL COMPOSITION/mass % | | | | | | | | | | | | | | |
|---|---|---|---|---|---|---|---|---|---|---|---|---|---|---|---|
| No. | C | Si | Mn | Al | P | S | N | O | Mo | Cr | Ni | Cu | B | Nb | Ti |
| S91 | 0.070 | 0.080 | 1.300 | 0.040 | 0.015 | 0.004 | 0.0026 | 0.0032 | | | | | | | |
| S92 | 0.070 | 0.080 | 1.300 | 0.040 | 0.015 | 0.004 | 0.0026 | 0.0032 | | | | | | | |
| S93 | 0.070 | 0.080 | 1.300 | 0.040 | 0.015 | 0.004 | 0.0026 | 0.0032 | | | | | | | |
| S94 | 0.070 | 0.080 | 1.300 | 0.040 | 0.015 | 0.004 | 0.0026 | 0.0032 | 0.0009 | | | | | | |
| S95 | 0.070 | 0.080 | 1.300 | 0.040 | 0.015 | 0.004 | 0.0026 | 0.0032 | 0.003 | | | | | | |
| S96 | 0.070 | 0.080 | 1.300 | 0.040 | 0.015 | 0.004 | 0.0026 | 0.0032 | 0.060 | | | | | | |
| S97 | 0.070 | 0.080 | 1.300 | 0.040 | 0.015 | 0.004 | 0.0026 | 0.0032 | | 0.0009 | | | | | |
| S98 | 0.070 | 0.080 | 1.300 | 0.040 | 0.015 | 0.004 | 0.0026 | 0.0032 | | 0.005 | | | | | |
| S99 | 0.070 | 0.080 | 1.300 | 0.040 | 0.015 | 0.004 | 0.0026 | 0.0032 | | 0.499 | | | | | |
| S100 | 0.070 | 0.080 | 1.300 | 0.040 | 0.015 | 0.004 | 0.0026 | 0.0032 | | | 0.0009 | | | | |
| S101 | 0.070 | 0.080 | 1.300 | 0.040 | 0.015 | 0.004 | 0.0026 | 0.0032 | | | 0.005 | | | | |
| S102 | 0.070 | 0.080 | 1.300 | 0.040 | 0.015 | 0.004 | 0.0026 | 0.0032 | | | 0.500 | | | | |
| S103 | 0.070 | 0.080 | 1.300 | 0.040 | 0.015 | 0.004 | 0.0026 | 0.0032 | | | | | | | |
| S104 | 0.070 | 0.080 | 1.300 | 0.040 | 0.015 | 0.004 | 0.0026 | 0.0032 | | | | | | | |
| S105 | 0.070 | 0.080 | 1.300 | 0.040 | 0.015 | 0.004 | 0.0026 | 0.0032 | | | | | | | |
| S106 | 0.070 | 0.080 | 1.300 | 0.040 | 0.015 | 0.004 | 0.0026 | 0.0032 | | | | | | | |
| S107 | 0.070 | 0.080 | 1.300 | 0.040 | 0.015 | 0.004 | 0.0026 | 0.0032 | | | | | | | |
| S108 | 0.070 | 0.080 | 1.300 | 0.040 | 0.015 | 0.004 | 0.0026 | 0.0032 | | | | | | | |
| S109 | 0.070 | 0.080 | 1.300 | 0.040 | 0.015 | 0.004 | 0.0026 | 0.0032 | | | | | | | |
| S110 | 0.070 | 0.080 | 1.300 | 0.040 | 0.015 | 0.004 | 0.0026 | 0.0032 | | | | | | | |
| S111 | 0.070 | 0.080 | 1.300 | 0.040 | 0.015 | 0.004 | 0.0026 | 0.0032 | | | | | | | |
| S112 | 0.070 | 0.080 | 1.300 | 0.040 | 0.015 | 0.004 | 0.0026 | 0.0032 | | | | | | | |
| S113 | 0.070 | 0.080 | 1.300 | 0.040 | 0.015 | 0.004 | 0.0026 | 0.0032 | | | | | | | |
| S114 | 0.070 | 0.080 | 1.300 | 0.040 | 0.015 | 0.004 | 0.0026 | 0.0032 | | | | | | | |
| S115 | 0.070 | 0.080 | 1.300 | 0.040 | 0.015 | 0.004 | 0.0026 | 0.0032 | | | | 0.0009 | | | |
| S116 | 0.070 | 0.080 | 1.300 | 0.040 | 0.015 | 0.004 | 0.0026 | 0.0032 | | | | 0.005 | | | |
| S117 | 0.070 | 0.080 | 1.300 | 0.040 | 0.015 | 0.004 | 0.0026 | 0.0032 | | | | 0.500 | | | |
| S118 | 0.070 | 0.080 | 1.300 | 0.040 | 0.015 | 0.004 | 0.0026 | 0.0032 | | | | | | | |
| S119 | 0.070 | 0.080 | 1.300 | 0.040 | 0.015 | 0.004 | 0.0026 | 0.0032 | | | | | | | |
| S120 | 0.070 | 0.080 | 1.300 | 0.040 | 0.015 | 0.004 | 0.0026 | 0.0032 | | | | | | | |
| S121 | 0.070 | 0.080 | 1.300 | 0.040 | 0.015 | 0.004 | 0.0026 | 0.0032 | | | | | | | |
| S122 | 0.070 | 0.080 | 1.300 | 0.040 | 0.015 | 0.004 | 0.0026 | 0.0032 | | | | | | | |
| S123 | 0.070 | 0.080 | 1.300 | 0.040 | 0.015 | 0.004 | 0.0026 | 0.0032 | | | | | | | |
| S124 | 0.070 | 0.080 | 1.300 | 0.040 | 0.015 | 0.004 | 0.0026 | 0.0032 | | | | | | | |
| S125 | 0.070 | 0.080 | 1.300 | 0.040 | 0.015 | 0.004 | 0.0026 | 0.0032 | | | | | | | |
| S126 | 0.070 | 0.080 | 1.300 | 0.040 | 0.015 | 0.004 | 0.0026 | 0.0032 | | | | | | | |
| S127 | 0.070 | 0.080 | 1.300 | 0.040 | 0.015 | 0.004 | 0.0026 | 0.0032 | | | | | | | |
| S128 | 0.070 | 0.080 | 1.300 | 0.040 | 0.015 | 0.004 | 0.0026 | 0.0032 | | | | | | | |
| S129 | 0.070 | 0.080 | 1.300 | 0.040 | 0.015 | 0.004 | 0.0026 | 0.0032 | | | | | | | |
| S130 | 0.070 | 0.080 | 1.300 | 0.040 | 0.015 | 0.004 | 0.0026 | 0.0032 | | | | | | | |
| S131 | 0.070 | 0.080 | 1.300 | 0.040 | 0.015 | 0.004 | 0.0026 | 0.0032 | | | | | | | |
| S132 | 0.070 | 0.080 | 1.300 | 0.040 | 0.015 | 0.004 | 0.0026 | 0.0032 | | | | | | | |
| S133 | 0.070 | 0.080 | 1.300 | 0.040 | 0.015 | 0.004 | 0.0026 | 0.0032 | | | | | | | |
| S134 | 0.070 | 0.080 | 1.300 | 0.040 | 0.015 | 0.004 | 0.0026 | 0.0032 | | | | | | | |
| S135 | 0.070 | 0.080 | 1.300 | 0.040 | 0.015 | 0.004 | 0.0026 | 0.0032 | | | | | | | |

TABLE 6

| STEEL No. | V | W | Ca | Mg | Zr | REM | As | Co | Sn | Pb | Y | Hf | REMARKS |
|---|---|---|---|---|---|---|---|---|---|---|---|---|---|
| S91 | | | 0.00009 | | | | | | | | | | EXAMPLE |
| S92 | | | 0.0004 | | | | | | | | | | EXAMPLE |
| S93 | | | 0.0010 | | | | | | | | | | EXAMPLE |
| S94 | | | | | | | | | | | | | EXAMPLE |
| S95 | | | | | | | | | | | | | EXAMPLE |
| S96 | | | | | | | | | | | | | EXAMPLE |
| S97 | | | | | | | | | | | | | EXAMPLE |
| S98 | | | | | | | | | | | | | EXAMPLE |
| S99 | | | | | | | | | | | | | EXAMPLE |
| S100 | | | | | | | | | | | | | EXAMPLE |
| S101 | | | | | | | | | | | | | EXAMPLE |
| S102 | | | | | | | | | | | | | EXAMPLE |
| S103 | | 0.0009 | | | | | | | | | | | EXAMPLE |
| S104 | | 0.005 | | | | | | | | | | | EXAMPLE |
| S105 | | 0.500 | | | | | | | | | | | EXAMPLE |
| S106 | | | | | 0.00009 | | | | | | | | EXAMPLE |
| S107 | | | | | 0.0100 | | | | | | | | EXAMPLE |
| S108 | | | | | 0.150 | | | | | | | | EXAMPLE |
| S109 | | | | | | | 0.00009 | | | | | | EXAMPLE |
| S110 | | | | | | | 0.0010 | | | | | | EXAMPLE |
| S111 | 0.0009 | | | | | | | | | | | | EXAMPLE |
| S112 | 0.005 | | | | | | | | | | | | EXAMPLE |
| S113 | 0.500 | | | | | | | | | | | | EXAMPLE |
| S114 | 0.800 | | | | | | | | | | | | EXAMPLE |
| S115 | | | | | | | | | | | | | EXAMPLE |
| S116 | | | | | | | | | | | | | EXAMPLE |
| S117 | | | | | | | | | | | | | EXAMPLE |
| S118 | | | | | | | | 0.00009 | | | | | EXAMPLE |
| S119 | | | | | | | | 0.00050 | | | | | EXAMPLE |
| S120 | | | | | | | | 0.0500 | | | | | EXAMPLE |
| S121 | | | | | | | | 0.5000 | | | | | EXAMPLE |
| S122 | | | | | | | | | 0.00009 | | | | EXAMPLE |
| S123 | | | | | | | | | 0.0100 | | | | EXAMPLE |
| S124 | | | | | | | | | 0.1000 | | | | EXAMPLE |
| S125 | | | | | | | | | 0.1500 | | | | EXAMPLE |
| S126 | | | | | | | | | | 0.00009 | | | EXAMPLE |
| S127 | | | | | | | | | | 0.0050 | | | EXAMPLE |
| S128 | | | | | | | | | | 0.0100 | | | EXAMPLE |
| S129 | | | | | | | | | | 0.1500 | | | EXAMPLE |
| S130 | | | | | | | | | | | 0.00009 | | EXAMPLE |
| S131 | | | | | | | | | | | 0.0500 | | EXAMPLE |
| S132 | | | | | | | | | | | 0.1500 | | EXAMPLE |
| S133 | | | | | | | | | | | | 0.00009 | EXAMPLE |
| S134 | | | | | | | | | | | | 0.0500 | EXAMPLE |
| S135 | | | | | | | | | | | | 0.1500 | EXAMPLE |

| STEEL No. | T1/ ° C. | $Ar_3$/ ° C. | CALCULATED VALUE OF HARDNESS OF FERRITE/— | REMARKS |
|---|---|---|---|---|
| S91 | 851 | 765 | 234 | EXAMPLE |
| S92 | 851 | 765 | 234 | EXAMPLE |
| S93 | 851 | 765 | 234 | EXAMPLE |
| S94 | 851 | 765 | 234 | EXAMPLE |
| S95 | 851 | 765 | 234 | EXAMPLE |
| S96 | 857 | 765 | 234 | EXAMPLE |
| S97 | 851 | 765 | 234 | EXAMPLE |
| S98 | 851 | 765 | 234 | EXAMPLE |
| S99 | 856 | 765 | 234 | EXAMPLE |
| S100 | 851 | 765 | 234 | EXAMPLE |
| S101 | 851 | 765 | 234 | EXAMPLE |
| S102 | 851 | 765 | 234 | EXAMPLE |
| S103 | 851 | 765 | 234 | EXAMPLE |
| S104 | 851 | 765 | 234 | EXAMPLE |
| S105 | 851 | 765 | 234 | EXAMPLE |
| S106 | 851 | 765 | 234 | EXAMPLE |
| S107 | 851 | 765 | 234 | EXAMPLE |
| S108 | 851 | 765 | 234 | EXAMPLE |
| S109 | 851 | 765 | 234 | EXAMPLE |
| S110 | 851 | 765 | 234 | EXAMPLE |
| S111 | 851 | 765 | 234 | EXAMPLE |
| S112 | 851 | 765 | 234 | EXAMPLE |
| S113 | 901 | 765 | 234 | EXAMPLE |
| S114 | 931 | 765 | 234 | EXAMPLE |
| S115 | 851 | 765 | 234 | EXAMPLE |
| S116 | 851 | 765 | 234 | EXAMPLE |

TABLE 6-continued

| | | | | |
|---|---|---|---|---|
| S117 | 851 | 765 | 234 | EXAMPLE |
| S118 | 851 | 765 | 234 | EXAMPLE |
| S119 | 851 | 765 | 234 | EXAMPLE |
| S120 | 851 | 769 | 234 | EXAMPLE |
| S121 | 851 | 803 | 234 | EXAMPLE |
| S122 | 851 | 765 | 234 | EXAMPLE |
| S123 | 851 | 765 | 234 | EXAMPLE |
| S124 | 851 | 765 | 234 | EXAMPLE |
| S125 | 851 | 765 | 234 | EXAMPLE |
| S126 | 851 | 765 | 234 | EXAMPLE |
| S127 | 851 | 765 | 234 | EXAMPLE |
| S128 | 851 | 765 | 234 | EXAMPLE |
| S129 | 851 | 765 | 234 | EXAMPLE |
| S130 | 851 | 765 | 234 | EXAMPLE |
| S131 | 851 | 765 | 234 | EXAMPLE |
| S132 | 851 | 765 | 234 | EXAMPLE |
| S133 | 851 | 765 | 234 | EXAMPLE |
| S134 | 851 | 765 | 234 | EXAMPLE |
| S135 | 851 | 765 | 234 | EXAMPLE |

TABLE 7

| | | ROLLING IN RANGE OF 1000° C. TO 1200° C. | | | ROLLING IN RANGE OF T1 + 30° C. to T1 + 200° C. | | | | | | |
|---|---|---|---|---|---|---|---|---|---|---|---|
| STEEL No. | PRODUCTION No. | FREQUENCY OF REDUCTION OF 40% OR MORE/— | EACH REDUCTION OF 40% OR MORE/% | GRAIN SIZE OF AUSTENITE/ μm | CUMULATIVE REDUCTION/% | FREQUENCY OF REDUCTION/— | FREQUENCY OF REDUCTION OF 30% OR MORE/— | EACH REDUCTION/% | P1/% | Tf/° C. | MAXIMUM OF TEMPERATURE RISE BETWEEN PASSES/° C. |
| S1 | P1 | 1 | 45 | 180 | 55 | 4 | 1 | 13/13/15/30 | 30 | 935 | 20 |
| S1 | P2 | 1 | 45 | 180 | 55 | 4 | 1 | 13/13/15/30 | 30 | 935 | 17 |
| S1 | P3 | 1 | 45 | 180 | 55 | 4 | 1 | 13/13/15/30 | 30 | 935 | 17 |
| S1 | P4 | 1 | 45 | 180 | 55 | 4 | 1 | 13/13/15/30 | 30 | 935 | 20 |
| S1 | P5 | 2 | 45/45 | 90 | 55 | 4 | 1 | 13/13/15/30 | 30 | 935 | 17 |
| S1 | P6 | 2 | 45/45 | 90 | 75 | 5 | 1 | 20/20/25/25/30 | 30 | 935 | 17 |
| S1 | P7 | 2 | 45/45 | 90 | 80 | 6 | 2 | 20/20/20/20/30/30 | 30 | 935 | 17 |
| S1 | P8 | 2 | 45/45 | 90 | 80 | 6 | 2 | 30/30/20/20/20/20 | 30 | 935 | 17 |
| S1 | P9 | 2 | 45/45 | 90 | 80 | 6 | 2 | 15/15/18/20/30/40 | 40 | 915 | 17 |
| S1 | P10 | 2 | 45/45 | 90 | 80 | 6 | 2 | 20/20/20/20/30/30 | 30 | 935 | 17 |
| S1 | P11 | 2 | 45/45 | 90 | 80 | 6 | 2 | 20/20/20/20/30/30 | 30 | 935 | 17 |
| S1 | P12 | 2 | 45/45 | 90 | 80 | 6 | 2 | 30/30/20/20/20/20 | 30 | 935 | 17 |
| S1 | P13 | 2 | 45/45 | 90 | 80 | 6 | 2 | 15/15/18/20/30/40 | 40 | 915 | 17 |
| S1 | P14 | 2 | 45/45 | 90 | 80 | 6 | 2 | 15/15/18/20/30/40 | 40 | 915 | 17 |
| S1 | P15 | 2 | 45/45 | 90 | 80 | 6 | 2 | 15/15/18/20/30/40 | 40 | 915 | 17 |
| S1 | P16 | 2 | 45/45 | 90 | 80 | 6 | 2 | 15/15/18/20/30/40 | 40 | 915 | 17 |
| S1 | P17 | 1 | 45 | 180 | 55 | 4 | 1 | 13/13/15/30 | 30 | 935 | 20 |
| S1 | P18 | 1 | 45 | 180 | 55 | 4 | 1 | 13/13/15/30 | 30 | 935 | 20 |
| S1 | P19 | 2 | 45/45 | 90 | 55 | 4 | 1 | 13/13/15/30 | 30 | 935 | 17 |
| S1 | P20 | 2 | 45/45 | 90 | 75 | 5 | 1 | 20/20/25/25/30 | 30 | 935 | 17 |
| S1 | P21 | 2 | 45/45 | 90 | 80 | 6 | 2 | 20/20/20/20/30/30 | 30 | 935 | 17 |
| S1 | P22 | 2 | 45/45 | 90 | 80 | 6 | 2 | 30/30/20/20/20/20 | 30 | 935 | 17 |
| S1 | P23 | 2 | 45/45 | 90 | 80 | 6 | 2 | 15/15/18/20/30/40 | 40 | 915 | 17 |
| S1 | P24 | 2 | 45/45 | 90 | 80 | 6 | 2 | 20/20/20/20/30/30 | 30 | 935 | 17 |
| S1 | P25 | 2 | 45/45 | 90 | 80 | 6 | 2 | 20/20/20/20/30/30 | 30 | 935 | 17 |
| S1 | P26 | 2 | 45/45 | 90 | 80 | 6 | 2 | 30/30/20/20/20/20 | 30 | 935 | 17 |
| S1 | P27 | 2 | 45/45 | 90 | 80 | 6 | 2 | 15/15/18/20/30/40 | 40 | 915 | 17 |
| S1 | P28 | 2 | 45/45 | 90 | 80 | 6 | 2 | 15/15/18/20/30/40 | 40 | 915 | 17 |
| S1 | P29 | 2 | 45/45 | 90 | 80 | 6 | 2 | 15/15/18/20/30/40 | 40 | 915 | 17 |
| S1 | P30 | 2 | 45/45 | 90 | 80 | 6 | 2 | 15/15/18/20/30/40 | 40 | 915 | 17 |
| S1 | P31 | 0 | — | 250 | 55 | 4 | 1 | 13/13/15/30 | 30 | 935 | 20 |
| S1 | P32 | 1 | 45 | 180 | 45 | 4 | 1 | 7/7/8/30 | 30 | 935 | 20 |
| S1 | P33 | 1 | 45 | 180 | 55 | 4 | 0 | 12/20/20/20 | — | — | 20 |
| S1 | P34 | 1 | 45 | 180 | 55 | 4 | 1 | 13/13/15/30 | 30 | 935 | 20 |
| S1 | P35 | 1 | 45 | 180 | 55 | 4 | 1 | 13/13/15/30 | 30 | 760 | 20 |
| S1 | P36 | 1 | 45 | 180 | 55 | 4 | 1 | 13/13/15/30 | 30 | 935 | 20 |
| S1 | P37 | 1 | 45 | 180 | 55 | 4 | 1 | 13/13/15/30 | 30 | 935 | 20 |
| S1 | P38 | 1 | 45 | 180 | 55 | 4 | 1 | 13/13/15/30 | 30 | 935 | 20 |
| S1 | P39 | 1 | 45 | 180 | 55 | 4 | 1 | 13/13/15/30 | 30 | 995 | 20 |
| S1 | P40 | 1 | 45 | 180 | 55 | 4 | 1 | 13/13/15/30 | 30 | 935 | 20 |
| S1 | P41 | 1 | 45 | 180 | 55 | 4 | 1 | 13/13/15/30 | 30 | 935 | 20 |
| S1 | P42 | 1 | 45 | 180 | 55 | 4 | 1 | 13/13/15/30 | 30 | 935 | 20 |
| S1 | P43 | 1 | 45 | 180 | 55 | 4 | 1 | 13/13/15/30 | 30 | 935 | 20 |

TABLE 7-continued

| | | ROLLING IN RANGE OF $Ar_3$ TO LOWER THAN T1 + 30° C. | | FIRST-COOLING | | | | | | |
|---|---|---|---|---|---|---|---|---|---|---|
| STEEL No. | PRODUCTION No. | CUMULATIVE REDUCTION/% | ROLLING FINISH TEMPERATURE/° C. | t1/s | 2.5 × t1/s | t/s | t/t1/— | AVERAGE COOLING RATE/° C./second | COOLING TEMPERATURE CHANGE/° C. | TEMPERATURE AT COOLING FINISH/° C. |
| S1 | P1 | 0 | 935 | 0.99 | 2.47 | 0.90 | 0.91 | 113 | 90 | 842 |
| S1 | P2 | 0 | 935 | 0.99 | 2.47 | 0.90 | 0.91 | 113 | 90 | 842 |
| S1 | P3 | 0 | 935 | 0.99 | 2.47 | 0.90 | 0.91 | 113 | 90 | 842 |
| S1 | P4 | 0 | 935 | 0.99 | 2.47 | 0.10 | 0.10 | 113 | 90 | 845 |
| S1 | P5 | 0 | 935 | 0.99 | 2.47 | 0.90 | 0.91 | 113 | 90 | 842 |
| S1 | P6 | 0 | 935 | 0.99 | 2.47 | 0.90 | 0.91 | 113 | 90 | 842 |
| S1 | P7 | 0 | 935 | 0.99 | 2.47 | 0.90 | 0.91 | 113 | 90 | 842 |
| S1 | P8 | 0 | 880 | 0.99 | 2.47 | 0.90 | 0.91 | 113 | 90 | 787 |
| S1 | P9 | 0 | 915 | 0.96 | 2.41 | 0.90 | 0.93 | 113 | 90 | 822 |
| S1 | P10 | 20 | 890 | 0.99 | 2.47 | 0.90 | 0.91 | 113 | 90 | 797 |
| S1 | P11 | 8 | 890 | 0.99 | 2.47 | 0.90 | 0.91 | 113 | 90 | 797 |
| S1 | P12 | 0 | 830 | 0.99 | 2.47 | 0.90 | 0.91 | 113 | 45 | 782 |
| S1 | P13 | 0 | 915 | 0.96 | 2.41 | 0.90 | 0.93 | 113 | 90 | 822 |
| S1 | P14 | 0 | 915 | 0.96 | 2.41 | 0.90 | 0.93 | 113 | 90 | 822 |
| S1 | P15 | 0 | 915 | 0.96 | 2.41 | 0.90 | 0.93 | 113 | 90 | 822 |
| S1 | P16 | 0 | 915 | 0.96 | 2.41 | 0.50 | 0.52 | 113 | 90 | 824 |
| S1 | P17 | 0 | 935 | 0.99 | 2.47 | 1.10 | 1.11 | 113 | 90 | 842 |
| S1 | P18 | 0 | 935 | 0.99 | 2.47 | 2.40 | 2.43 | 113 | 90 | 838 |
| S1 | P19 | 0 | 935 | 0.99 | 2.47 | 1.10 | 1.11 | 113 | 90 | 842 |
| S1 | P20 | 0 | 935 | 0.99 | 2.47 | 1.10 | 1.11 | 113 | 90 | 842 |
| S1 | P21 | 0 | 935 | 0.99 | 2.47 | 1.10 | 1.11 | 113 | 90 | 842 |
| S1 | P22 | 0 | 880 | 0.99 | 2.47 | 1.10 | 1.11 | 113 | 90 | 787 |
| S1 | P23 | 0 | 915 | 0.96 | 2.41 | 1.10 | 1.14 | 113 | 90 | 822 |
| S1 | P24 | 20 | 890 | 0.99 | 2.47 | 1.10 | 1.11 | 113 | 90 | 797 |
| S1 | P25 | 8 | 890 | 0.99 | 2.47 | 1.10 | 1.11 | 113 | 90 | 797 |
| S1 | P26 | 0 | 830 | 0.99 | 2.47 | 1.10 | 1.11 | 113 | 45 | 782 |
| S1 | P27 | 0 | 915 | 0.96 | 2.41 | 1.10 | 1.14 | 113 | 90 | 822 |
| S1 | P28 | 0 | 915 | 0.96 | 2.41 | 1.10 | 1.14 | 113 | 90 | 822 |
| S1 | P29 | 0 | 915 | 0.96 | 2.41 | 1.10 | 1.14 | 113 | 90 | 822 |
| S1 | P30 | 0 | 915 | 0.96 | 2.41 | 1.50 | 1.56 | 113 | 90 | 821 |
| S1 | P31 | 0 | 935 | 0.99 | 2.47 | 0.90 | 0.91 | 113 | 90 | 842 |
| S1 | P32 | 0 | 935 | 0.99 | 2.47 | 0.90 | 0.91 | 113 | 90 | 842 |
| S1 | P33 | 0 | 935 | — | — | 0.90 | — | 113 | 90 | 842 |
| S1 | P34 | 35 | 890 | 0.99 | 2.47 | 0.90 | 0.91 | 113 | 90 | 797 |
| S1 | P35 | 0 | 760 | 6.82 | 17.05 | 6.20 | 0.91 | 113 | 45 | 696 |
| S1 | P36 | 0 | 935 | 0.99 | 2.47 | 0.90 | 0.91 | 45 | 90 | 842 |
| S1 | P37 | 0 | 935 | 0.99 | 2.47 | 0.90 | 0.91 | 113 | 35 | 897 |
| S1 | P38 | 0 | 935 | 0.99 | 2.47 | 0.90 | 0.91 | 113 | 145 | 787 |
| S1 | P39 | 0 | 995 | 0.26 | 0.64 | 0.24 | 0.91 | 50 | 40 | 954 |
| S1 | P40 | 0 | 935 | 0.99 | 2.47 | 0.90 | 0.91 | 113 | 90 | 842 |
| S1 | P41 | 0 | 935 | 0.99 | 2.47 | 0.90 | 0.91 | 113 | 90 | 842 |
| S1 | P42 | 0 | 935 | 0.99 | 2.47 | 0.90 | 0.91 | 113 | 90 | 842 |
| S1 | P43 | 0 | 935 | 0.99 | 2.47 | 0.90 | 0.91 | 113 | 90 | 842 |

TABLE 8

| | | ROLLING IN RANGE OF 1000° C. TO 1200° C. | | | ROLLING IN RANGE OF T1 + 30° C. to T1 + 200° C. | | | | | | |
|---|---|---|---|---|---|---|---|---|---|---|---|
| STEEL No. | PRODUCTION No. | FREQUENCY OF REDUCTION OF 40% OR MORE/— | EACH REDUCTION OF 40% OR MORE/% | GRAIN SIZE OF AUSTENITE/ μm | CUMULATIVE REDUCTION/% | FREQUENCY OF REDUCTION/— | FREQUENCY OF REDUCTION OF 30% OR MORE/— | EACH REDUCTION/% | P1/% | Tf/° C. | MAXIMUM OF TEMPERATURE RISE BETWEEN PASSES/° C. |
| S1 | P44 | 1 | 45 | 180 | 55 | 4 | 1 | 13/13/15/30 | 30 | 935 | 20 |
| S1 | P45 | 1 | 45 | 180 | 55 | 4 | 1 | 13/13/15/30 | 30 | 935 | 20 |
| S1 | P46 | 1 | 45 | 180 | 55 | 4 | 1 | 13/13/15/30 | 30 | 935 | 20 |
| S1 | P47 | 1 | 45 | 180 | 55 | 4 | 1 | 13/13/15/30 | 30 | 935 | 20 |
| S1 | P48 | 1 | 45 | 180 | 55 | 4 | 1 | 13/13/15/30 | 30 | 935 | 20 |
| S1 | P49 | 1 | 45 | 180 | 55 | 4 | 1 | 13/13/15/30 | 30 | 935 | 20 |
| S1 | P50 | 1 | 45 | 180 | 55 | 4 | 1 | 13/13/15/30 | 30 | 935 | 20 |
| S1 | P51 | 1 | 45 | 180 | 55 | 4 | 1 | 13/13/15/30 | 30 | 935 | 20 |
| S1 | P52 | 1 | 45 | 180 | 55 | 4 | 1 | 13/13/15/30 | 30 | 935 | 20 |
| S1 | P53 | 1 | 45 | 180 | 55 | 4 | 1 | 13/13/15/30 | 30 | 935 | 20 |
| S1 | P54 | 1 | 45 | 180 | 55 | 4 | 1 | 13/13/15/30 | 30 | 935 | 20 |
| S1 | P55 | 1 | 45 | 180 | 55 | 4 | 1 | 13/13/15/30 | 30 | 935 | 20 |
| S1 | P56 | 0 | — | 250 | 55 | 4 | 1 | 13/13/15/30 | 30 | 935 | 20 |
| S1 | P57 | 1 | 45 | 180 | 45 | 4 | 1 | 7/7/8/30 | 30 | 935 | 20 |
| S1 | P58 | 1 | 45 | 180 | 55 | 4 | 1 | 13/13/15/30 | 30 | 935 | 20 |
| S1 | P59 | 1 | 45 | 180 | 55 | 4 | 1 | 13/13/15/30 | 30 | 760 | 20 |
| S1 | P60 | 1 | 45 | 180 | 55 | 4 | 1 | 13/13/15/30 | 30 | 935 | 20 |
| S1 | P61 | 1 | 45 | 180 | 55 | 4 | 1 | 13/13/15/30 | 30 | 935 | 20 |
| S1 | P62 | 1 | 45 | 180 | 55 | 4 | 1 | 13/13/15/30 | 30 | 935 | 20 |
| S1 | P63 | 1 | 45 | 180 | 55 | 4 | 1 | 13/13/15/30 | 30 | 935 | 20 |
| S1 | P64 | 1 | 45 | 180 | 55 | 4 | 1 | 13/13/15/30 | 30 | 935 | 20 |
| S1 | P65 | 1 | 45 | 180 | 55 | 4 | 1 | 13/13/15/30 | 30 | 935 | 20 |
| S1 | P66 | 1 | 45 | 180 | 55 | 4 | 1 | 13/13/15/30 | 30 | 935 | 20 |
| S1 | P67 | 1 | 45 | 180 | 55 | 4 | 1 | 13/13/15/30 | 30 | 935 | 20 |
| S1 | P68 | 1 | 45 | 180 | 55 | 4 | 1 | 13/13/15/30 | 30 | 935 | 20 |
| S1 | P69 | 1 | 45 | 180 | 55 | 4 | 1 | 13/13/15/30 | 30 | 935 | 20 |
| S1 | P70 | 1 | 45 | 180 | 55 | 4 | 1 | 13/13/15/30 | 30 | 935 | 20 |
| S1 | P71 | 1 | 45 | 180 | 55 | 4 | 1 | 13/13/15/30 | 30 | 935 | 20 |
| S1 | P72 | 1 | 45 | 180 | 55 | 4 | 1 | 13/13/15/30 | 30 | 935 | 20 |
| S1 | P73 | 1 | 45 | 180 | 55 | 4 | 1 | 13/13/15/30 | 30 | 935 | 20 |
| S1 | P74 | 1 | 45 | 180 | 55 | 4 | 1 | 13/13/15/30 | 30 | 935 | 20 |
| S1 | P75 | 1 | 45 | 180 | 55 | 4 | 1 | 13/13/15/30 | 30 | 935 | 20 |
| S1 | P76 | 1 | 45 | 180 | 55 | 4 | 1 | 13/13/15/30 | 30 | 935 | 20 |
| S1 | P77 | 1 | 45 | 180 | 55 | 4 | 1 | 13/13/15/30 | 30 | 935 | 20 |
| S1 | P78 | 1 | 45 | 180 | 55 | 4 | 1 | 13/13/15/30 | 30 | 935 | 20 |
| S1 | P79 | 1 | 45 | 180 | 55 | 4 | 1 | 13/13/15/30 | 30 | 935 | 20 |
| S1 | P80 | 1 | 45 | 180 | 55 | 4 | 1 | 13/13/15/30 | 30 | 935 | 20 |
| S2 | P81 | 1 | 45 | 180 | 55 | 4 | 1 | 13/13/15/30 | 30 | 935 | 20 |
| S3 | P82 | 1 | 45 | 180 | 55 | 4 | 1 | 13/13/15/30 | 30 | 935 | 20 |
| S4 | P83 | 1 | 45 | 180 | 55 | 4 | 1 | 13/13/15/30 | 30 | 935 | 20 |
| S5 | P84 | 1 | 45 | 180 | 55 | 4 | 1 | 13/13/15/30 | 30 | 935 | 20 |
| S6 | P85 | 1 | 45 | 180 | 55 | 4 | 1 | 13/13/15/30 | 30 | 935 | 20 |
| S7 | P86 | 1 | 45 | 180 | 55 | 4 | 1 | 13/13/15/30 | 30 | 935 | 20 |

TABLE 8-continued

| STEEL No. | PRODUCTION No. | ROLLING IN RANGE OF $Ar_3$ TO LOWER THAN T1 + 30° C. CUMULATIVE REDUCTION/% | ROLLING FINISH TEMPERATURE/° C. | FIRST-COOLING t1/s | 2.5 × t1/s | t/s | t/t1/— | AVERAGE COOLING RATE/° C./second | COOLING TEMPERATURE CHANGE/° C. | TEMPERATURE AT COOLING FINISH/° C. |
|---|---|---|---|---|---|---|---|---|---|---|
| S1 | P44 | 0 | 935 | 0.99 | 2.47 | 0.90 | 0.91 | 113 | 90 | 842 |
| S1 | P45 | 0 | 935 | 0.99 | 2.47 | 0.90 | 0.91 | 113 | 90 | 842 |
| S1 | P46 | 0 | 935 | 0.99 | 2.47 | 0.90 | 0.91 | 113 | 90 | 842 |
| S1 | P47 | 0 | 935 | 0.99 | 2.47 | 0.90 | 0.91 | 113 | 90 | 842 |
| S1 | P48 | 0 | 935 | 0.99 | 2.47 | 0.90 | 0.91 | 113 | 90 | 842 |
| S1 | P49 | 0 | 935 | 0.99 | 2.47 | 0.90 | 0.91 | 113 | 90 | 842 |
| S1 | P50 | 0 | 935 | 0.99 | 2.47 | 0.90 | 0.91 | 113 | 90 | 842 |
| S1 | P51 | 0 | 935 | 0.99 | 2.47 | 0.90 | 0.91 | 113 | 90 | 842 |
| S1 | P52 | 0 | 935 | 0.99 | 2.47 | 0.90 | 0.91 | 113 | 90 | 842 |
| S1 | P53 | 0 | 935 | 0.99 | 2.47 | 0.90 | 0.91 | 113 | 90 | 842 |
| S1 | P54 | 0 | 935 | 0.99 | 2.47 | 0.90 | 0.91 | 113 | 90 | 842 |
| S1 | P55 | 0 | 935 | 0.99 | 2.47 | 0.90 | 0.91 | 113 | 90 | 842 |
| S1 | P56 | 0 | 935 | 0.99 | 2.47 | 1.10 | 1.11 | 113 | 90 | 842 |
| S1 | P57 | 0 | 935 | 0.99 | 2.47 | 1.10 | 1.11 | 113 | 90 | 842 |
| S1 | P58 | 35 | 890 | 0.99 | 2.47 | 1.10 | 1.11 | 113 | 90 | 797 |
| S1 | P59 | 0 | 760 | 6.82 | 17.05 | 7.60 | 1.11 | 113 | 45 | 692 |
| S1 | P60 | 0 | 935 | 0.99 | 2.47 | 2.50 | 2.53 | 113 | 90 | 838 |
| S1 | P61 | 0 | 935 | 0.99 | 2.47 | 1.10 | 1.11 | 45 | 90 | 842 |
| S1 | P62 | 0 | 935 | 0.99 | 2.47 | 1.10 | 1.11 | 113 | 35 | 897 |
| S1 | P63 | 0 | 935 | 0.99 | 2.47 | 1.10 | 1.11 | 113 | 145 | 787 |
| S1 | P64 | 0 | 995 | 0.26 | 0.64 | 0.29 | 1.11 | 50 | 40 | 954 |
| S1 | P65 | 0 | 935 | 0.99 | 2.47 | 1.10 | 1.11 | 113 | 90 | 842 |
| S1 | P66 | 0 | 935 | 0.99 | 2.47 | 1.10 | 1.11 | 113 | 90 | 842 |
| S1 | P67 | 0 | 935 | 0.99 | 2.47 | 1.10 | 1.11 | 113 | 90 | 842 |
| S1 | P68 | 0 | 935 | 0.99 | 2.47 | 1.10 | 1.11 | 113 | 90 | 842 |
| S1 | P69 | 0 | 935 | 0.99 | 2.47 | 1.10 | 1.11 | 113 | 90 | 842 |
| S1 | P70 | 0 | 935 | 0.99 | 2.47 | 1.10 | 1.11 | 113 | 90 | 842 |
| S1 | P71 | 0 | 935 | 0.99 | 2.47 | 1.10 | 1.11 | 113 | 90 | 842 |
| S1 | P72 | 0 | 935 | 0.99 | 2.47 | 1.10 | 1.11 | 113 | 90 | 842 |
| S1 | P73 | 0 | 935 | 0.99 | 2.47 | 1.10 | 1.11 | 113 | 90 | 842 |
| S1 | P74 | 0 | 935 | 0.99 | 2.47 | 1.10 | 1.11 | 113 | 90 | 842 |
| S1 | P75 | 0 | 935 | 0.99 | 2.47 | 1.10 | 1.11 | 113 | 90 | 842 |
| S1 | P76 | 0 | 935 | 0.99 | 2.47 | 1.10 | 1.11 | 113 | 90 | 842 |
| S1 | P77 | 0 | 935 | 0.99 | 2.47 | 1.10 | 1.11 | 113 | 90 | 842 |
| S1 | P78 | 0 | 935 | 0.99 | 2.47 | 1.10 | 1.11 | 113 | 90 | 842 |
| S1 | P79 | 0 | 935 | 0.99 | 2.47 | 1.10 | 1.11 | 113 | 90 | 842 |
| S1 | P80 | 0 | 935 | 0.99 | 2.47 | 1.10 | 1.11 | 113 | 90 | 842 |
| S2 | P81 | 0 | 935 | 0.97 | 2.43 | 0.90 | 0.92 | 113 | 90 | 842 |
| S3 | P82 | 0 | 935 | 1.06 | 2.66 | 0.90 | 0.85 | 113 | 90 | 842 |
| S4 | P83 | 0 | 935 | 0.99 | 2.47 | 0.90 | 0.91 | 113 | 90 | 842 |
| S5 | P84 | 0 | 935 | 0.99 | 2.47 | 0.90 | 0.91 | 113 | 90 | 842 |
| S6 | P85 | 0 | 935 | 0.97 | 2.43 | 0.90 | 0.93 | 113 | 90 | 842 |
| S7 | P86 | 0 | 935 | 1.02 | 2.56 | 0.90 | 0.88 | 113 | 90 | 842 |

TABLE 9

| | | ROLLING IN RANGE OF 1000° C. TO 1200° C. | | | ROLLING IN RANGE OF T1 + 30° C. to T1 + 200° C. | | | | | | |
|---|---|---|---|---|---|---|---|---|---|---|---|
| STEEL No. | PRODUCTION No. | FREQUENCY OF REDUCTION OF 40% OR MORE/— | EACH REDUCTION OF 40% OR MORE/% | GRAIN SIZE OF AUSTENITE/ μm | CUMULATIVE REDUCTION/% | FREQUENCY OF REDUCTION/— | FREQUENCY OF REDUCTION OF 30% OR MORE/— | EACH REDUCTION/% | P1/% | Tf/° C. | MAXIMUM OF TEMPERATURE RISE BETWEEN PASSES/° C. |
| S8 | P87 | 1 | 45 | 180 | 55 | 4 | 1 | 13/13/15/30 | 30 | 935 | 20 |
| S9 | P88 | 1 | 45 | 180 | 55 | 4 | 1 | 13/13/15/30 | 30 | 935 | 20 |
| S10 | P89 | | | | Cracks occur during Hot rolling | | | | | | |
| S11 | P90 | 1 | 45 | 180 | 55 | 4 | 1 | 13/13/15/30 | 30 | 935 | 20 |
| S12 | P91 | 1 | 45 | 180 | 55 | 4 | 1 | 13/13/15/30 | 30 | 935 | 20 |
| S13 | P92 | 1 | 45 | 180 | 55 | 4 | 1 | 13/13/15/30 | 30 | 935 | 20 |
| S14 | P93 | 1 | 45 | 180 | 55 | 4 | 1 | 13/13/15/30 | 30 | 935 | 20 |
| S15 | P94 | 1 | 45 | 180 | 55 | 4 | 1 | 13/13/15/30 | 30 | 935 | 20 |
| S16 | P95 | 1 | 45 | 180 | 55 | 4 | 1 | 13/13/15/30 | 30 | 935 | 20 |
| S17 | P96 | 1 | 45 | 180 | 55 | 4 | 1 | 13/13/15/30 | 30 | 935 | 20 |
| S18 | P97 | 1 | 45 | 180 | 55 | 4 | 1 | 13/13/15/30 | 30 | 935 | 20 |
| S19 | P98 | 1 | 45 | 180 | 55 | 4 | 1 | 13/13/15/30 | 30 | 935 | 20 |
| S20 | P99 | 1 | 45 | 180 | 55 | 4 | 1 | 13/13/15/30 | 30 | 935 | 20 |
| S21 | P100 | 1 | 45 | 180 | 55 | 4 | 1 | 13/13/15/30 | 30 | 935 | 20 |
| S22 | P101 | 1 | 45 | 180 | 55 | 4 | 1 | 13/13/15/30 | 30 | 935 | 20 |
| S23 | P102 | 1 | 45 | 180 | 55 | 4 | 1 | 13/13/15/30 | 30 | 935 | 20 |
| S24 | P103 | 1 | 45 | 180 | 55 | 4 | 1 | 13/13/15/30 | 30 | 935 | 20 |
| S25 | P104 | 1 | 45 | 180 | 55 | 4 | 1 | 13/13/15/30 | 30 | 935 | 20 |
| S26 | P105 | 1 | 45 | 180 | 55 | 4 | 1 | 13/13/15/30 | 30 | 935 | 20 |
| S27 | P106 | 1 | 45 | 180 | 55 | 4 | 1 | 13/13/15/30 | 30 | 935 | 20 |
| S28 | P107 | 1 | 45 | 180 | 55 | 4 | 1 | 13/13/15/30 | 30 | 935 | 20 |
| S29 | P108 | | | | Cracks occur during Hot rolling | | | | | | |
| S30 | P109 | | | | Cracks occur during Hot rolling | | | | | | |
| S31 | P110 | 1 | 45 | 180 | 55 | 4 | 1 | 13/13/15/30 | 30 | 935 | 20 |
| S32 | P111 | 1 | 45 | 180 | 55 | 4 | 1 | 13/13/15/30 | 30 | 935 | 20 |
| S33 | P112 | 1 | 45 | 180 | 55 | 4 | 1 | 13/13/15/30 | 30 | 935 | 20 |
| S34 | P113 | 1 | 45 | 180 | 55 | 4 | 1 | 13/13/15/30 | 30 | 935 | 20 |
| S35 | P114 | 1 | 45 | 180 | 55 | 4 | 1 | 13/13/15/30 | 30 | 935 | 20 |
| S36 | P115 | 1 | 45 | 180 | 55 | 4 | 1 | 13/13/15/30 | 30 | 935 | 20 |
| S37 | P116 | 1 | 45 | 180 | 55 | 4 | 1 | 13/13/15/30 | 30 | 935 | 20 |
| S38 | P117 | 1 | 45 | 180 | 55 | 4 | 1 | 13/13/15/30 | 30 | 935 | 20 |
| S39 | P118 | 1 | 45 | 180 | 55 | 4 | 1 | 13/13/15/30 | 30 | 935 | 20 |
| S40 | P119 | 1 | 45 | 180 | 55 | 4 | 1 | 13/13/15/30 | 30 | 935 | 20 |
| S41 | P120 | 1 | 45 | 180 | 55 | 4 | 1 | 13/13/15/30 | 30 | 935 | 20 |
| S42 | P121 | 1 | 45 | 180 | 55 | 4 | 1 | 13/13/15/30 | 30 | 935 | 20 |
| S43 | P122 | 1 | 45 | 180 | 55 | 4 | 1 | 13/13/15/30 | 30 | 935 | 20 |
| S44 | P123 | 1 | 45 | 180 | 55 | 4 | 1 | 13/13/15/30 | 30 | 935 | 20 |
| S45 | P124 | 1 | 45 | 180 | 55 | 4 | 1 | 13/13/15/30 | 30 | 935 | 20 |
| S46 | P125 | 1 | 45 | 180 | 55 | 4 | 1 | 13/13/15/30 | 30 | 935 | 20 |
| S47 | P126 | 1 | 45 | 180 | 55 | 4 | 1 | 13/13/15/30 | 30 | 935 | 20 |
| S48 | P127 | 1 | 45 | 180 | 55 | 4 | 1 | 13/13/15/30 | 30 | 935 | 20 |
| S49 | P128 | 1 | 45 | 180 | 55 | 4 | 1 | 13/13/15/30 | 30 | 935 | 20 |
| S50 | P129 | 1 | 45 | 180 | 55 | 4 | 1 | 13/13/15/30 | 30 | 935 | 20 |

TABLE 9-continued

| STEEL No. | PRODUCTION No. | ROLLING IN RANGE OF $Ar_3$ TO LOWER THAN T1 + 30° C. CUMULATIVE REDUCTION/% | ROLLING FINISH TEMPERATURE/° C. | FIRST-COOLING t1/s | 2.5 × t1/s | t/s | t/t1/— | AVERAGE COOLING RATE/° C./second | COOLING TEMPERATURE CHANGE/° C. | TEMPERATURE AT COOLING FINISH/° C. |
|---|---|---|---|---|---|---|---|---|---|---|
| S8 | P87 | 0 | 935 | 0.99 | 2.47 | 0.90 | 0.91 | 113 | 90 | 842 |
| S9 | P88 | 0 | 935 | 0.99 | 2.47 | 0.90 | 0.91 | 113 | 90 | 842 |
| S10 | P89 | | | | | Cracks occur during Hot rolling | | | | |
| S11 | P90 | 0 | 935 | 0.99 | 2.47 | 0.90 | 0.91 | 113 | 90 | 842 |
| S12 | P91 | 0 | 935 | 0.99 | 2.47 | 0.90 | 0.91 | 113 | 90 | 842 |
| S13 | P92 | 0 | 935 | 0.99 | 2.47 | 0.90 | 0.91 | 113 | 90 | 842 |
| S14 | P93 | 0 | 935 | 3.68 | 9.20 | 0.90 | 0.24 | 113 | 90 | 842 |
| S15 | P94 | 0 | 935 | 1.38 | 3.44 | 0.90 | 0.65 | 113 | 90 | 842 |
| S16 | P95 | 0 | 935 | 0.99 | 2.47 | 0.90 | 0.91 | 113 | 90 | 842 |
| S17 | P96 | 0 | 935 | 0.99 | 2.47 | 0.90 | 0.91 | 113 | 90 | 842 |
| S18 | P97 | 0 | 935 | 0.99 | 2.48 | 0.90 | 0.91 | 113 | 90 | 842 |
| S19 | P98 | 0 | 935 | 2.67 | 6.67 | 0.90 | 0.34 | 113 | 90 | 842 |
| S20 | P99 | 0 | 935 | 2.10 | 5.24 | 0.90 | 0.43 | 113 | 90 | 842 |
| S21 | P100 | 0 | 935 | 3.68 | 9.20 | 0.90 | 0.24 | 113 | 90 | 842 |
| S22 | P101 | 0 | 935 | 0.99 | 2.47 | 0.90 | 0.91 | 113 | 90 | 842 |
| S23 | P102 | 0 | 935 | 0.99 | 2.47 | 0.90 | 0.91 | 113 | 90 | 842 |
| S24 | P103 | 0 | 935 | 0.99 | 2.47 | 0.90 | 0.91 | 113 | 90 | 842 |
| S25 | P104 | 0 | 935 | 0.99 | 2.47 | 0.90 | 0.91 | 113 | 90 | 842 |
| S26 | P105 | 0 | 935 | 0.99 | 2.47 | 0.90 | 0.91 | 113 | 90 | 842 |
| S27 | P106 | 0 | 935 | 0.99 | 2.47 | 0.90 | 0.91 | 113 | 90 | 842 |
| S28 | P107 | 0 | 935 | 0.99 | 2.47 | 0.90 | 0.91 | 113 | 90 | 842 |
| S29 | P108 | | | | | Cracks occur during Hot rolling | | | | |
| S30 | P109 | | | | | Cracks occur during Hot rolling | | | | |
| S31 | P110 | 0 | 935 | 0.99 | 2.47 | 0.90 | 0.91 | 113 | 90 | 842 |
| S32 | P111 | 0 | 935 | 0.99 | 2.47 | 0.90 | 0.91 | 113 | 90 | 842 |
| S33 | P112 | 0 | 935 | 0.97 | 2.43 | 1.10 | 1.13 | 113 | 90 | 842 |
| S34 | P113 | 0 | 935 | 0.98 | 2.45 | 1.10 | 1.12 | 113 | 90 | 842 |
| S35 | P114 | 0 | 935 | 0.98 | 2.46 | 1.10 | 1.12 | 113 | 90 | 842 |
| S36 | P115 | 0 | 935 | 1.00 | 2.50 | 1.10 | 1.10 | 113 | 90 | 842 |
| S37 | P116 | 0 | 935 | 1.01 | 2.53 | 1.10 | 1.09 | 113 | 90 | 842 |
| S38 | P117 | 0 | 935 | 1.03 | 2.57 | 1.10 | 1.07 | 113 | 90 | 842 |
| S39 | P118 | 0 | 935 | 1.04 | 2.59 | 1.10 | 1.06 | 113 | 90 | 842 |
| S40 | P119 | 0 | 935 | 1.04 | 2.60 | 1.10 | 1.06 | 113 | 90 | 842 |
| S41 | P120 | 0 | 935 | 1.06 | 2.66 | 1.10 | 1.03 | 113 | 90 | 842 |
| S42 | P121 | 0 | 935 | 0.99 | 2.47 | 1.10 | 1.11 | 113 | 90 | 842 |
| S43 | P122 | 0 | 935 | 0.99 | 2.47 | 1.10 | 1.11 | 113 | 90 | 842 |
| S44 | P123 | 0 | 935 | 0.99 | 2.47 | 1.10 | 1.11 | 113 | 90 | 842 |
| S45 | P124 | 0 | 935 | 0.99 | 2.47 | 1.10 | 1.11 | 113 | 90 | 842 |
| S46 | P125 | 0 | 935 | 0.99 | 2.47 | 1.10 | 1.11 | 113 | 90 | 842 |
| S47 | P126 | 0 | 935 | 0.97 | 2.43 | 1.10 | 1.13 | 113 | 90 | 842 |
| S48 | P127 | 0 | 935 | 0.97 | 2.43 | 1.10 | 1.13 | 113 | 90 | 842 |
| S49 | P128 | 0 | 935 | 0.98 | 2.44 | 1.10 | 1.13 | 113 | 90 | 842 |
| S50 | P129 | 0 | 935 | 0.99 | 2.47 | 1.10 | 1.11 | 113 | 90 | 842 |

TABLE 10

| | | ROLLING IN RANGE OF 1000° C. TO 1200° C. | | | ROLLING IN RANGE OF T1 + 30° C. to T1 + 200° C. | | | | | | |
|---|---|---|---|---|---|---|---|---|---|---|---|
| STEEL No. | PRODUCTION No. | FREQUENCY OF REDUCTION OF 40% OR MORE/— | EACH REDUCTION OF 40% OR MORE/% | GRAIN SIZE OF AUSTENITE/ μm | CUMULATIVE REDUCTION/% | FREQUENCY OF REDUCTION/— | FREQUENCY OF REDUCTION OF 30% OR MORE/— | EACH REDUCTION/% | P1/% | Tf/° C. | MAXIMUM OF TEMPERATURE RISE BETWEEN PASSES/° C. |
| S51 | P130 | 1 | 45 | 180 | 55 | 4 | 1 | 13/13/15/30 | 30 | 935 | 20 |
| S52 | P131 | 1 | 45 | 180 | 55 | 4 | 1 | 13/13/15/30 | 30 | 935 | 20 |
| S53 | P132 | 1 | 45 | 180 | 55 | 4 | 1 | 13/13/15/30 | 30 | 935 | 20 |
| S54 | P133 | 1 | 45 | 180 | 55 | 4 | 1 | 13/13/15/30 | 30 | 935 | 20 |
| S55 | P134 | 1 | 45 | 180 | 55 | 4 | 1 | 13/13/15/30 | 30 | 935 | 20 |
| S56 | P135 | 1 | 45 | 180 | 55 | 4 | 1 | 13/13/15/30 | 30 | 935 | 20 |
| S57 | P136 | 1 | 45 | 180 | 55 | 4 | 1 | 13/13/15/30 | 30 | 935 | 20 |
| S58 | P137 | 1 | 45 | 180 | 55 | 4 | 1 | 13/13/15/30 | 30 | 935 | 20 |
| S59 | P138 | 1 | 45 | 180 | 55 | 4 | 1 | 13/13/15/30 | 30 | 935 | 20 |
| S60 | P139 | 1 | 45 | 180 | 55 | 4 | 1 | 13/13/15/30 | 30 | 935 | 20 |
| S61 | P140 | 1 | 45 | 180 | 55 | 4 | 1 | 13/13/15/30 | 30 | 935 | 20 |
| S62 | P141 | 1 | 45 | 180 | 55 | 4 | 1 | 13/13/15/30 | 30 | 935 | 20 |
| S63 | P142 | 1 | 45 | 180 | 55 | 4 | 1 | 13/13/15/30 | 30 | 935 | 20 |
| S64 | P143 | 1 | 45 | 180 | 55 | 4 | 1 | 13/13/15/30 | 30 | 935 | 20 |
| S65 | P144 | 1 | 45 | 180 | 55 | 4 | 1 | 13/13/15/30 | 30 | 935 | 20 |
| S66 | P145 | 1 | 45 | 180 | 55 | 4 | 1 | 13/13/15/30 | 30 | 935 | 20 |
| S67 | P146 | 1 | 45 | 180 | 55 | 4 | 1 | 13/13/15/30 | 30 | 935 | 20 |
| S68 | P147 | 1 | 45 | 180 | 55 | 4 | 1 | 13/13/15/30 | 30 | 935 | 20 |
| S69 | P148 | 1 | 45 | 180 | 55 | 4 | 1 | 13/13/15/30 | 30 | 935 | 20 |
| S70 | P149 | 1 | 45 | 180 | 55 | 4 | 1 | 13/13/15/30 | 30 | 935 | 20 |
| S71 | P150 | 1 | 45 | 180 | 55 | 4 | 1 | 13/13/15/30 | 30 | 935 | 20 |
| S72 | P151 | 1 | 45 | 180 | 55 | 4 | 1 | 13/13/15/30 | 30 | 935 | 20 |
| S73 | P152 | 1 | 45 | 180 | 55 | 4 | 1 | 13/13/15/30 | 30 | 935 | 20 |
| S74 | P153 | 1 | 45 | 180 | 55 | 4 | 1 | 13/13/15/30 | 30 | 935 | 20 |
| S75 | P154 | 1 | 45 | 180 | 55 | 4 | 1 | 13/13/15/30 | 30 | 935 | 20 |
| S76 | P155 | 1 | 45 | 180 | 55 | 4 | 1 | 13/13/15/30 | 30 | 935 | 20 |
| S77 | P156 | 1 | 45 | 180 | 55 | 4 | 1 | 13/13/15/30 | 30 | 935 | 20 |
| S78 | P157 | 1 | 45 | 180 | 55 | 4 | 1 | 13/13/15/30 | 30 | 935 | 20 |
| S79 | P158 | 1 | 45 | 180 | 55 | 4 | 1 | 13/13/15/30 | 30 | 935 | 20 |
| S80 | P159 | 1 | 45 | 180 | 55 | 4 | 1 | 13/13/15/30 | 30 | 935 | 20 |
| S81 | P160 | 1 | 45 | 180 | 55 | 4 | 1 | 13/13/15/30 | 30 | 935 | 20 |
| S82 | P161 | 1 | 45 | 180 | 55 | 4 | 1 | 13/13/15/30 | 30 | 935 | 20 |
| S83 | P162 | 1 | 45 | 180 | 55 | 4 | 1 | 13/13/15/30 | 30 | 935 | 20 |
| S84 | P163 | 1 | 45 | 180 | 55 | 4 | 1 | 13/13/15/30 | 30 | 935 | 20 |
| S85 | P164 | 1 | 45 | 180 | 55 | 4 | 1 | 13/13/15/30 | 30 | 935 | 20 |
| S86 | P165 | 1 | 45 | 180 | 55 | 4 | 1 | 13/13/15/30 | 30 | 935 | 20 |
| S87 | P166 | 1 | 45 | 180 | 55 | 4 | 1 | 13/13/15/30 | 30 | 935 | 20 |
| S88 | P167 | 1 | 45 | 180 | 55 | 4 | 1 | 13/13/15/30 | 30 | 935 | 20 |
| S89 | P168 | 1 | 45 | 180 | 55 | 4 | 1 | 13/13/15/30 | 30 | 935 | 20 |
| S90 | P169 | 1 | 45 | 180 | 55 | 4 | 1 | 13/13/15/30 | 30 | 935 | 20 |
| S91 | P170 | 1 | 45 | 180 | 55 | 4 | 1 | 13/13/15/30 | 30 | 935 | 20 |
| S92 | P171 | 1 | 45 | 180 | 55 | 4 | 1 | 13/13/15/30 | 30 | 935 | 20 |
| S93 | P172 | 1 | 45 | 180 | 55 | 4 | 1 | 13/13/15/30 | 30 | 935 | 20 |

TABLE 10-continued

| | | ROLLING IN RANGE OF $Ar_3$ TO LOWER THAN T1 + 30° C. | | FIRST-COOLING | | | | | | |
|---|---|---|---|---|---|---|---|---|---|---|
| STEEL No. | PRODUCTION No. | CUMULATIVE REDUCTION/% | ROLLING FINISH TEMPERATURE/° C. | t1/s | 2.5 × t1/s | t/s | t/t1/— | AVERAGE COOLING RATE/° C./second | COOLING TEMPERATURE CHANGE/° C. | TEMPERATURE AT COOLING FINISH/° C. |
| S51 | P130 | 0 | 935 | 1.00 | 2.51 | 1.10 | 1.10 | 113 | 90 | 842 |
| S52 | P131 | 0 | 935 | 1.01 | 2.52 | 1.10 | 1.09 | 113 | 90 | 842 |
| S53 | P132 | 0 | 935 | 1.01 | 2.53 | 1.10 | 1.09 | 113 | 90 | 842 |
| S54 | P133 | 0 | 935 | 1.02 | 2.54 | 1.10 | 1.08 | 113 | 90 | 842 |
| S55 | P134 | 0 | 935 | 1.02 | 2.56 | 1.10 | 1.08 | 113 | 90 | 842 |
| S56 | P135 | 0 | 935 | 0.99 | 2.47 | 1.10 | 1.11 | 113 | 90 | 842 |
| S57 | P136 | 0 | 935 | 0.99 | 2.47 | 1.10 | 1.11 | 113 | 90 | 842 |
| S58 | P137 | 0 | 935 | 0.99 | 2.47 | 1.10 | 1.11 | 113 | 90 | 842 |
| S59 | P138 | 0 | 935 | 0.99 | 2.47 | 1.10 | 1.11 | 113 | 90 | 842 |
| S60 | P139 | 0 | 935 | 0.99 | 2.47 | 1.10 | 1.11 | 113 | 90 | 842 |
| S61 | P140 | 0 | 935 | 0.99 | 2.47 | 1.10 | 1.11 | 113 | 90 | 842 |
| S62 | P141 | 0 | 935 | 0.99 | 2.47 | 1.10 | 1.11 | 113 | 90 | 842 |
| S63 | P142 | 0 | 935 | 0.99 | 2.47 | 1.10 | 1.11 | 113 | 90 | 842 |
| S64 | P143 | 0 | 935 | 0.99 | 2.47 | 1.10 | 1.11 | 113 | 90 | 842 |
| S65 | P144 | 0 | 935 | 0.99 | 2.47 | 1.10 | 1.11 | 113 | 90 | 842 |
| S66 | P145 | 0 | 935 | 0.99 | 2.47 | 1.10 | 1.11 | 113 | 90 | 842 |
| S67 | P146 | 0 | 935 | 0.99 | 2.47 | 1.10 | 1.11 | 113 | 90 | 842 |
| S68 | P147 | 0 | 935 | 0.99 | 2.47 | 1.10 | 1.11 | 113 | 90 | 842 |
| S69 | P148 | 0 | 935 | 0.99 | 2.47 | 1.10 | 1.11 | 113 | 90 | 842 |
| S70 | P149 | 0 | 935 | 0.99 | 2.47 | 1.10 | 1.11 | 113 | 90 | 842 |
| S71 | P150 | 0 | 935 | 0.99 | 2.47 | 1.10 | 1.11 | 113 | 90 | 842 |
| S72 | P151 | 0 | 935 | 0.99 | 2.47 | 1.10 | 1.11 | 113 | 90 | 842 |
| S73 | P152 | 0 | 935 | 0.99 | 2.47 | 1.10 | 1.11 | 113 | 90 | 842 |
| S74 | P153 | 0 | 935 | 0.99 | 2.47 | 1.10 | 1.11 | 113 | 90 | 842 |
| S75 | P154 | 0 | 935 | 0.99 | 2.48 | 1.10 | 1.11 | 113 | 90 | 842 |
| S76 | P155 | 0 | 935 | 1.00 | 2.50 | 1.10 | 1.10 | 113 | 90 | 842 |
| S77 | P156 | 0 | 935 | 1.74 | 4.34 | 1.91 | 1.10 | 113 | 90 | 839 |
| S78 | P157 | 0 | 935 | 0.99 | 2.48 | 1.10 | 1.11 | 113 | 90 | 842 |
| S79 | P158 | 0 | 935 | 1.01 | 2.51 | 1.10 | 1.09 | 113 | 90 | 842 |
| S80 | P159 | 0 | 935 | 2.16 | 5.39 | 2.35 | 1.09 | 113 | 90 | 838 |
| S81 | P160 | 0 | 935 | 0.99 | 2.47 | 1.10 | 1.11 | 113 | 90 | 842 |
| S82 | P161 | 0 | 935 | 0.99 | 2.47 | 1.10 | 1.11 | 113 | 90 | 842 |
| S83 | P162 | 0 | 935 | 0.99 | 2.47 | 1.10 | 1.11 | 113 | 90 | 842 |
| S84 | P163 | 0 | 935 | 0.99 | 2.48 | 1.10 | 1.11 | 113 | 90 | 842 |
| S85 | P164 | 0 | 935 | 0.99 | 2.47 | 1.10 | 1.11 | 113 | 90 | 842 |
| S86 | P165 | 0 | 935 | 0.99 | 2.47 | 1.10 | 1.11 | 113 | 90 | 842 |
| S87 | P166 | 0 | 935 | 0.99 | 2.47 | 1.10 | 1.11 | 113 | 90 | 842 |
| S88 | P167 | 0 | 935 | 0.99 | 2.47 | 1.10 | 1.11 | 113 | 90 | 842 |
| S89 | P168 | 0 | 935 | 0.99 | 2.47 | 1.10 | 1.11 | 113 | 90 | 842 |
| S90 | P169 | 0 | 935 | 0.99 | 2.47 | 1.10 | 1.11 | 113 | 90 | 842 |
| S91 | P170 | 0 | 935 | 0.99 | 2.47 | 1.10 | 1.11 | 113 | 90 | 842 |
| S92 | P171 | 0 | 935 | 0.99 | 2.47 | 1.10 | 1.11 | 113 | 90 | 842 |
| S93 | P172 | 0 | 935 | 0.99 | 2.47 | 1.10 | 1.11 | 113 | 90 | 842 |

TABLE 11

| | | ROLLING IN RANGE OF 1000° C. TO 1200° C. | | | ROLLING IN RANGE OF T1 + 30° C. to T1 + 200° C. | | | | | | |
|---|---|---|---|---|---|---|---|---|---|---|---|
| STEEL No. | PRODUCTION No. | FREQUENCY OF REDUCTION OF 40% OR MORE/— | EACH REDUCTION OF 40% OR MORE/% | GRAIN SIZE OF AUSTENITE/ μm | CUMULATIVE REDUCTION/% | FREQUENCY OF REDUCTION/— | FREQUENCY OF REDUCTION OF 30% OR MORE/— | EACH REDUCTION/% | P1/% | Tf/° C. | MAXIMUM OF TEMPERATURE RISE BETWEEN PASSES/ ° C. |
| S94 | P173 | 1 | 45 | 180 | 55 | 4 | 1 | 13/13/15/30 | 30 | 935 | 20 |
| S95 | P174 | 1 | 45 | 180 | 55 | 4 | 1 | 13/13/15/30 | 30 | 935 | 20 |
| S96 | P175 | 1 | 45 | 180 | 55 | 4 | 1 | 13/13/15/30 | 30 | 935 | 20 |
| S97 | P176 | 1 | 45 | 180 | 55 | 4 | 1 | 13/13/15/30 | 30 | 935 | 20 |
| S98 | P177 | 1 | 45 | 180 | 55 | 4 | 1 | 13/13/15/30 | 30 | 935 | 20 |
| S99 | P178 | 1 | 45 | 180 | 55 | 4 | 1 | 13/13/15/30 | 30 | 935 | 20 |
| S100 | P179 | 1 | 45 | 180 | 55 | 4 | 1 | 13/13/15/30 | 30 | 935 | 20 |
| S101 | P180 | 1 | 45 | 180 | 55 | 4 | 1 | 13/13/15/30 | 30 | 935 | 20 |
| S102 | P181 | 1 | 45 | 180 | 55 | 4 | 1 | 13/13/15/30 | 30 | 935 | 20 |
| S103 | P182 | 1 | 45 | 180 | 55 | 4 | 1 | 13/13/15/30 | 30 | 935 | 20 |
| S104 | P183 | 1 | 45 | 180 | 55 | 4 | 1 | 13/13/15/30 | 30 | 935 | 20 |
| S105 | P184 | 1 | 45 | 180 | 55 | 4 | 1 | 13/13/15/30 | 30 | 935 | 20 |
| S106 | P185 | 1 | 45 | 180 | 55 | 4 | 1 | 13/13/15/30 | 30 | 935 | 20 |
| S107 | P186 | 1 | 45 | 180 | 55 | 4 | 1 | 13/13/15/30 | 30 | 935 | 20 |
| S108 | P187 | 1 | 45 | 180 | 55 | 4 | 1 | 13/13/15/30 | 30 | 935 | 20 |
| S109 | P188 | 1 | 45 | 180 | 55 | 4 | 1 | 13/13/15/30 | 30 | 935 | 20 |
| S110 | P189 | 1 | 45 | 180 | 55 | 4 | 1 | 13/13/15/30 | 30 | 935 | 20 |
| S111 | P190 | 1 | 45 | 180 | 55 | 4 | 1 | 13/13/15/30 | 30 | 935 | 20 |
| S112 | P191 | 1 | 45 | 180 | 55 | 4 | 1 | 13/13/15/30 | 30 | 935 | 20 |
| S113 | P192 | 1 | 45 | 180 | 55 | 4 | 1 | 13/13/15/30 | 30 | 935 | 20 |
| S114 | P193 | 1 | 45 | 180 | 55 | 4 | 1 | 13/13/15/30 | 30 | 935 | 20 |
| S115 | P194 | 1 | 45 | 180 | 55 | 4 | 1 | 13/13/15/30 | 30 | 935 | 20 |
| S116 | P195 | 1 | 45 | 180 | 55 | 4 | 1 | 13/13/15/30 | 30 | 935 | 20 |
| S117 | P196 | 1 | 45 | 180 | 55 | 4 | 1 | 13/13/15/30 | 30 | 935 | 20 |
| S118 | P197 | 1 | 45 | 180 | 55 | 4 | 1 | 13/13/15/30 | 30 | 935 | 20 |
| S119 | P198 | 1 | 45 | 180 | 55 | 4 | 1 | 13/13/15/30 | 30 | 935 | 20 |
| S120 | P199 | 1 | 45 | 180 | 55 | 4 | 1 | 13/13/15/30 | 30 | 935 | 20 |
| S121 | P200 | 1 | 45 | 180 | 55 | 4 | 1 | 13/13/15/30 | 30 | 935 | 20 |
| S122 | P201 | 1 | 45 | 180 | 55 | 4 | 1 | 13/13/15/30 | 30 | 935 | 20 |
| S123 | P202 | 1 | 45 | 180 | 55 | 4 | 1 | 13/13/15/30 | 30 | 935 | 20 |
| S124 | P203 | 1 | 45 | 180 | 55 | 4 | 1 | 13/13/15/30 | 30 | 935 | 20 |
| S125 | P204 | 1 | 45 | 180 | 55 | 4 | 1 | 13/13/15/30 | 30 | 935 | 20 |
| S126 | P205 | 1 | 45 | 180 | 55 | 4 | 1 | 13/13/15/30 | 30 | 935 | 20 |
| S127 | P206 | 1 | 45 | 180 | 55 | 4 | 1 | 13/13/15/30 | 30 | 935 | 20 |
| S128 | P207 | 1 | 45 | 180 | 55 | 4 | 1 | 13/13/15/30 | 30 | 935 | 20 |
| S129 | P208 | 1 | 45 | 180 | 55 | 4 | 1 | 13/13/15/30 | 30 | 935 | 20 |
| S130 | P209 | 1 | 45 | 180 | 55 | 4 | 1 | 13/13/15/30 | 30 | 935 | 20 |
| S131 | P210 | 1 | 45 | 180 | 55 | 4 | 1 | 13/13/15/30 | 30 | 935 | 20 |
| S132 | P211 | 1 | 45 | 180 | 55 | 4 | 1 | 13/13/15/30 | 30 | 935 | 20 |
| S133 | P212 | 1 | 45 | 180 | 55 | 4 | 1 | 13/13/15/30 | 30 | 935 | 20 |
| S134 | P213 | 1 | 45 | 180 | 55 | 4 | 1 | 13/13/15/30 | 30 | 935 | 20 |

TABLE 11-continued

| S135 | P214 | 1 | 45 | 180 | 55 | 4 | 1 | 13/13/15/30 | 30 | 935 | 20 |
|---|---|---|---|---|---|---|---|---|---|---|---|
| | | | ROLLING IN RANGE OF $Ar_3$ TO LOWER THAN T1 + 30° C. | | FIRST-COOLING | | | | | | |
| STEEL No. | PRODUCTION No. | CUMULATIVE REDUCTION/% | ROLLING FINISH TEMPERATURE/ ° C. | t1/s | 2.5 × t1/s | t/s | t/t1/— | AVERAGE COOLING RATE/ ° C./second | COOLING TEMPERATURE CHANGE/ ° C. | TEMPERATURE AT COOLING FINISH/ ° C. | |
| S94 | P173 | 0 | 935 | 0.99 | 2.47 | 1.10 | 1.11 | 113 | 90 | 842 | |
| S95 | P174 | 0 | 935 | 0.99 | 2.48 | 1.10 | 1.11 | 113 | 90 | 842 | |
| S96 | P175 | 0 | 935 | 1.10 | 2.74 | 1.10 | 1.00 | 113 | 90 | 842 | |
| S97 | P176 | 0 | 935 | 0.99 | 2.47 | 1.10 | 1.11 | 113 | 90 | 842 | |
| S98 | P177 | 0 | 935 | 0.99 | 2.47 | 1.10 | 1.11 | 113 | 90 | 842 | |
| S99 | P178 | 0 | 935 | 1.08 | 2.69 | 1.10 | 1.02 | 113 | 90 | 842 | |
| S100 | P179 | 0 | 935 | 0.99 | 2.47 | 1.10 | 1.11 | 113 | 90 | 842 | |
| S101 | P180 | 0 | 935 | 0.99 | 2.47 | 1.10 | 1.11 | 113 | 90 | 842 | |
| S102 | P181 | 0 | 935 | 0.99 | 2.47 | 1.10 | 1.11 | 113 | 90 | 842 | |
| S103 | P182 | 0 | 935 | 0.99 | 2.47 | 1.10 | 1.11 | 113 | 90 | 842 | |
| S104 | P183 | 0 | 935 | 0.99 | 2.47 | 1.10 | 1.11 | 113 | 90 | 842 | |
| S105 | P184 | 0 | 935 | 0.99 | 2.47 | 1.10 | 1.11 | 113 | 90 | 842 | |
| S106 | P185 | 0 | 935 | 0.99 | 2.47 | 1.10 | 1.11 | 113 | 90 | 842 | |
| S107 | P186 | 0 | 935 | 0.99 | 2.47 | 1.10 | 1.11 | 113 | 90 | 842 | |
| S108 | P187 | 0 | 935 | 0.99 | 2.47 | 1.10 | 1.11 | 113 | 90 | 842 | |
| S109 | P188 | 0 | 935 | 0.99 | 2.47 | 1.10 | 1.11 | 113 | 90 | 842 | |
| S110 | P189 | 0 | 935 | 0.99 | 2.47 | 1.10 | 1.11 | 113 | 90 | 842 | |
| S111 | P190 | 0 | 935 | 0.99 | 2.47 | 1.10 | 1.11 | 113 | 90 | 842 | |
| S112 | P191 | 0 | 935 | 1.00 | 2.49 | 1.10 | 1.10 | 113 | 90 | 842 | |
| S113 | P192 | 0 | 935 | 2.09 | 5.23 | 2.30 | 1.10 | 113 | 90 | 838 | |
| S114 | P193 | 0 | 935 | 2.97 | 7.42 | 3.30 | 1.11 | 113 | 90 | 835 | |
| S115 | P194 | 0 | 935 | 0.99 | 2.47 | 1.10 | 1.11 | 113 | 90 | 842 | |
| S116 | P195 | 0 | 935 | 0.99 | 2.47 | 1.10 | 1.11 | 113 | 90 | 842 | |
| S117 | P196 | 0 | 935 | 0.99 | 2.47 | 1.10 | 1.11 | 113 | 90 | 842 | |
| S118 | P197 | 0 | 935 | 0.99 | 2.47 | 1.10 | 1.11 | 113 | 90 | 842 | |
| S119 | P198 | 0 | 935 | 0.99 | 2.47 | 1.10 | 1.11 | 113 | 90 | 842 | |
| S120 | P199 | 0 | 935 | 0.99 | 2.47 | 1.10 | 1.11 | 113 | 90 | 842 | |
| S121 | P200 | 0 | 935 | 0.99 | 2.47 | 1.10 | 1.11 | 113 | 90 | 842 | |
| S122 | P201 | 0 | 935 | 0.99 | 2.47 | 1.10 | 1.11 | 113 | 90 | 842 | |
| S123 | P202 | 0 | 935 | 0.99 | 2.47 | 1.10 | 1.11 | 113 | 90 | 842 | |
| S124 | P203 | 0 | 935 | 0.99 | 2.47 | 1.10 | 1.11 | 113 | 90 | 842 | |
| S125 | P204 | 0 | 935 | 0.99 | 2.47 | 1.10 | 1.11 | 113 | 90 | 842 | |
| S126 | P205 | 0 | 935 | 0.99 | 2.47 | 1.10 | 1.11 | 113 | 90 | 842 | |
| S127 | P206 | 0 | 935 | 0.99 | 2.47 | 1.10 | 1.11 | 113 | 90 | 842 | |
| S128 | P207 | 0 | 935 | 0.99 | 2.47 | 1.10 | 1.11 | 113 | 90 | 842 | |
| S129 | P208 | 0 | 935 | 0.99 | 2.47 | 1.10 | 1.11 | 113 | 90 | 842 | |
| S130 | P209 | 0 | 935 | 0.99 | 2.47 | 1.10 | 1.11 | 113 | 90 | 842 | |
| S131 | P210 | 0 | 935 | 0.99 | 2.47 | 1.10 | 1.11 | 113 | 90 | 842 | |
| S132 | P211 | 0 | 935 | 0.99 | 2.47 | 1.10 | 1.11 | 113 | 90 | 842 | |
| S133 | P212 | 0 | 935 | 0.99 | 2.47 | 1.10 | 1.11 | 113 | 90 | 842 | |
| S134 | P213 | 0 | 935 | 0.99 | 2.47 | 1.10 | 1.11 | 113 | 90 | 842 | |
| S135 | P214 | 0 | 935 | 0.99 | 2.47 | 1.10 | 1.11 | 113 | 90 | 842 | |

TABLE 12

| PRO-DUCTION No. | SECOND-COOLING TIME UNTIL SECOND COOLING START/s | SECOND-COOLING AVERAGE COOLING RATE/ ° C./second | SECOND-COOLING TEM-PERATURE AT COOLING FINISH/ ° C. | COILING TEM-PERATURE/ ° C. | COLD-ROLLING CUMU-LATIVE REDUC-TION/% | HEATING AND HOLDING HEATING TEM-PERATURE/ ° C. | HEATING AND HOLDING HOLDING TIME/s | THIRD-COOLING AVERAGE COOLING RATE/ ° C./second | THIRD-COOLING TEM-PERATURE AT COOLING FINISH/ ° C. |
|---|---|---|---|---|---|---|---|---|---|
| P1 | 3.5 | 70 | 330 | 330 | 50 | 850 | 10.0 | 5 | 650 |
| P2 | 3.5 | 70 | 330 | 330 | 50 | 850 | 10.0 | 5 | 650 |
| P3 | 2.8 | 70 | 330 | 330 | 50 | 850 | 10.0 | 5 | 650 |
| P4 | 3.5 | 70 | 330 | 330 | 50 | 850 | 10.0 | 5 | 650 |
| P5 | 2.8 | 70 | 330 | 330 | 50 | 850 | 10.0 | 5 | 650 |
| P6 | 2.8 | 70 | 330 | 330 | 50 | 850 | 10.0 | 5 | 650 |
| P7 | 2.8 | 70 | 330 | 330 | 50 | 850 | 10.0 | 5 | 650 |
| P8 | 2.8 | 70 | 330 | 330 | 50 | 850 | 10.0 | 5 | 650 |
| P9 | 2.8 | 70 | 330 | 330 | 50 | 850 | 10.0 | 5 | 650 |
| P10 | 2.8 | 70 | 330 | 330 | 50 | 850 | 10.0 | 5 | 650 |
| P11 | 2.8 | 70 | 330 | 330 | 50 | 850 | 10.0 | 5 | 650 |
| P12 | 2.8 | 70 | 330 | 330 | 50 | 850 | 10.0 | 5 | 650 |
| P13 | 2.8 | 70 | 330 | 330 | 50 | 850 | 10.0 | 2 | 610 |
| P14 | 2.8 | 70 | 330 | 330 | 50 | 850 | 10.0 | 10 | 690 |
| P15 | 2.8 | 70 | 330 | 330 | 50 | 850 | 10.0 | 8 | 680 |
| P16 | 2.8 | 70 | 330 | 330 | 50 | 850 | 10.0 | 5 | 650 |
| P17 | 3.5 | 70 | 330 | 330 | 50 | 850 | 10.0 | 5 | 650 |
| P18 | 3.5 | 70 | 330 | 330 | 50 | 850 | 10.0 | 5 | 650 |
| P19 | 2.8 | 70 | 330 | 330 | 50 | 850 | 10.0 | 5 | 650 |
| P20 | 2.8 | 70 | 330 | 330 | 50 | 850 | 10.0 | 5 | 650 |
| P21 | 2.8 | 70 | 330 | 330 | 50 | 850 | 10.0 | 5 | 650 |
| P22 | 2.8 | 70 | 330 | 330 | 50 | 850 | 10.0 | 5 | 650 |
| P23 | 2.8 | 70 | 330 | 330 | 50 | 850 | 10.0 | 5 | 650 |
| P24 | 2.8 | 70 | 330 | 330 | 50 | 850 | 10.0 | 5 | 650 |
| P25 | 2.8 | 70 | 330 | 330 | 50 | 850 | 10.0 | 5 | 650 |
| P26 | 2.8 | 70 | 330 | 330 | 50 | 850 | 10.0 | 5 | 650 |
| P27 | 2.8 | 70 | 330 | 330 | 50 | 850 | 10.0 | 2 | 610 |
| P28 | 2.8 | 70 | 330 | 330 | 50 | 850 | 10.0 | 10 | 690 |
| P29 | 2.8 | 70 | 330 | 330 | 50 | 850 | 10.0 | 8 | 680 |
| P30 | 2.8 | 70 | 330 | 330 | 50 | 850 | 10.0 | 5 | 650 |
| P31 | 3.5 | 70 | 330 | 330 | 50 | 850 | 10.0 | 5 | 650 |
| P32 | 3.5 | 70 | 330 | 330 | 50 | 850 | 10.0 | 5 | 650 |
| P33 | 3.5 | 70 | 330 | 330 | 50 | 850 | 10.0 | 5 | 650 |
| P34 | 3.5 | 70 | 330 | 330 | 50 | 850 | 10.0 | 5 | 650 |
| P35 | 3.5 | 70 | 330 | 330 | 50 | 850 | 10.0 | 5 | 650 |
| P36 | 3.5 | 70 | 330 | 330 | 50 | 850 | 10.0 | 5 | 650 |
| P37 | 3.5 | 70 | 330 | 330 | 50 | 850 | 10.0 | 5 | 650 |
| P38 | 3.5 | 70 | 330 | 330 | 50 | 850 | 10.0 | 5 | 650 |
| P39 | 3.5 | 70 | 330 | 330 | 50 | 850 | 10.0 | 5 | 650 |
| P40 | 3.5 | 70 | 620 | 620 | 50 | 850 | 10.0 | 5 | 650 |
| P41 | 3.5 | 70 | 330 | 330 | 27 | 850 | 10.0 | 5 | 650 |
| P42 | 3.5 | 70 | 330 | 330 | 73 | 850 | 10.0 | 5 | 650 |
| P43 | 3.5 | 70 | 330 | 330 | 50 | 730 | 10.0 | 5 | 650 |

| PRODUCTION No. | FOURTH-COOLING AVERAGE COOLING RATE/ ° C./second | FOURTH-COOLING TEMPERATURE AT COOLING FINISH/ ° C. | OVERAGEING TREATMENT AGEING TEMPERATURE T2/ ° C. | OVERAGEING TREATMENT CALCULATED UPPER VALUE OF t2/s | OVERAGEING TREATMENT AGEING TIME t2/s | COATING TREATMENT GALVANIZING | COATING TREATMENT ALLOYING TREATMENT/ ° C. |
|---|---|---|---|---|---|---|---|
| P1 | 90 | 550 | 550 | 20184 | 120 | unconducted | unconducted |
| P2 | 90 | 550 | 550 | 20184 | 120 | unconducted | unconducted |
| P3 | 90 | 550 | 550 | 20184 | 120 | unconducted | unconducted |
| P4 | 90 | 550 | 550 | 20184 | 120 | unconducted | unconducted |
| P5 | 90 | 550 | 550 | 20184 | 120 | unconducted | unconducted |
| P6 | 90 | 550 | 550 | 20184 | 120 | unconducted | unconducted |
| P7 | 90 | 550 | 550 | 20184 | 120 | unconducted | unconducted |
| P8 | 90 | 550 | 550 | 20184 | 120 | unconducted | unconducted |
| P9 | 90 | 550 | 550 | 20184 | 120 | unconducted | unconducted |
| P10 | 90 | 550 | 550 | 20184 | 120 | unconducted | unconducted |
| P11 | 90 | 550 | 550 | 20184 | 120 | unconducted | unconducted |
| P12 | 90 | 550 | 550 | 20184 | 120 | unconducted | unconducted |
| P13 | 90 | 230 | 230 | 609536897 | 120 | unconducted | unconducted |
| P14 | 10 | 580 | 580 | 966051 | 120 | unconducted | unconducted |
| P15 | 250 | 220 | 220 | 3845917820 | 120 | unconducted | unconducted |
| P16 | 90 | 550 | 550 | 20184 | 120 | unconducted | unconducted |
| P17 | 90 | 550 | 550 | 20184 | 120 | unconducted | unconducted |
| P18 | 90 | 550 | 550 | 20184 | 120 | unconducted | unconducted |

TABLE 12-continued

| | | | | | | | |
|---|---|---|---|---|---|---|---|
| P19 | 90 | 550 | 550 | 20184 | 120 | unconducted | unconducted |
| P20 | 90 | 550 | 550 | 20184 | 120 | unconducted | unconducted |
| P21 | 90 | 550 | 550 | 20184 | 120 | unconducted | unconducted |
| P22 | 90 | 550 | 550 | 20184 | 120 | unconducted | unconducted |
| P23 | 90 | 550 | 550 | 20184 | 120 | unconducted | unconducted |
| P24 | 90 | 550 | 550 | 20184 | 120 | unconducted | unconducted |
| P25 | 90 | 550 | 550 | 20184 | 120 | unconducted | unconducted |
| P26 | 90 | 550 | 550 | 20184 | 120 | unconducted | unconducted |
| P27 | 90 | 230 | 230 | 609536897 | 120 | unconducted | unconducted |
| P28 | 10 | 580 | 580 | 966051 | 120 | unconducted | unconducted |
| P29 | 250 | 220 | 220 | 3845917820 | 120 | unconducted | unconducted |
| P30 | 90 | 550 | 550 | 20184 | 120 | unconducted | unconducted |
| P31 | 90 | 550 | 550 | 20184 | 120 | unconducted | unconducted |
| P32 | 90 | 550 | 550 | 20184 | 120 | unconducted | unconducted |
| P33 | 90 | 550 | 550 | 20184 | 120 | unconducted | unconducted |
| P34 | 90 | 550 | 550 | 20184 | 120 | unconducted | unconducted |
| P35 | 90 | 550 | 550 | 20184 | 120 | unconducted | unconducted |
| P36 | 90 | 550 | 550 | 20184 | 120 | unconducted | unconducted |
| P37 | 90 | 550 | 550 | 20184 | 120 | unconducted | unconducted |
| P38 | 90 | 550 | 550 | 20184 | 120 | unconducted | unconducted |
| P39 | 90 | 550 | 550 | 20184 | 120 | unconducted | unconducted |
| P40 | 90 | 550 | 550 | 20184 | 120 | unconducted | unconducted |
| P41 | 90 | 550 | 550 | 20184 | 120 | unconducted | unconducted |
| P42 | 90 | 550 | 550 | 20184 | 120 | unconducted | unconducted |
| P43 | 90 | 550 | 550 | 20184 | 120 | unconducted | unconducted |

TABLE 13

| | SECOND-COOLING | | | | | | | THIRD-COOLING | |
|---|---|---|---|---|---|---|---|---|---|
| | TIME | | TEM-PERATURE | | COLD-ROLLING | HEATING AND HOLDING | | | TEM-PERATURE |
| PRODUCTION No. | UNTIL SECOND COOLING START/s | AVERAGE COOLING RATE/ ° C./second | AT COOLING FINISH/ ° C. | COILING TEM-PERATURE/ ° C. | CUMU-LATIVE REDUC-TION/% | HEATING TEM-PERATURE/ ° C. | HOLDING TIME/s | AVERAGE COOLING RATE/ ° C./second | AT COOLING FINISH/ ° C. |
| P44 | 3.5 | 70 | 330 | 330 | 50 | 920 | 10.0 | 5 | 650 |
| P45 | 3.5 | 70 | 330 | 330 | 50 | 850 | 0.5 | 5 | 650 |
| P46 | 3.5 | 70 | 330 | 330 | 50 | 850 | 1005.0 | 5 | 650 |
| P47 | 3.5 | 70 | 330 | 330 | 50 | 850 | 10.0 | 0.5 | 650 |
| P48 | 3.5 | 70 | 330 | 330 | 50 | 850 | 10.0 | 13 | 650 |
| P49 | 3.5 | 70 | 330 | 330 | 50 | 850 | 10.0 | 5 | 560 |
| P50 | 3.5 | 70 | 330 | 330 | 50 | 850 | 10.0 | 5 | 740 |
| P51 | 3.5 | 70 | 330 | 330 | 50 | 850 | 10.0 | 5 | 650 |
| P52 | 3.5 | 70 | 330 | 330 | 50 | 850 | 10.0 | 5 | 650 |
| P53 | 3.5 | 70 | 330 | 330 | 50 | 850 | 10.0 | 5 | 650 |
| P54 | 3.5 | 70 | 330 | 330 | 50 | 850 | 10.0 | 5 | 650 |
| P55 | 3.5 | 70 | 330 | 330 | 50 | 850 | 10.0 | 5 | 650 |
| P56 | 3.5 | 70 | 330 | 330 | 50 | 850 | 10.0 | 5 | 650 |
| P57 | 3.5 | 70 | 330 | 330 | 50 | 850 | 10.0 | 5 | 650 |
| P58 | 3.5 | 70 | 330 | 330 | 50 | 850 | 10.0 | 5 | 650 |
| P59 | 3.5 | 70 | 330 | 330 | 50 | 850 | 10.0 | 5 | 650 |
| P60 | 3.5 | 70 | 330 | 330 | 50 | 850 | 10.0 | 5 | 650 |
| P61 | 3.5 | 70 | 330 | 330 | 50 | 850 | 10.0 | 5 | 650 |
| P62 | 3.5 | 70 | 330 | 330 | 50 | 850 | 10.0 | 5 | 650 |
| P63 | 3.5 | 70 | 330 | 330 | 50 | 850 | 10.0 | 5 | 650 |
| P64 | 3.5 | 70 | 330 | 330 | 50 | 850 | 10.0 | 5 | 650 |
| P65 | 3.5 | 70 | 620 | 620 | 50 | 850 | 10.0 | 5 | 650 |
| P66 | 3.5 | 70 | 330 | 330 | 27 | 850 | 10.0 | 5 | 650 |
| P67 | 3.5 | 70 | 330 | 330 | 73 | 850 | 10.0 | 5 | 650 |
| P68 | 3.5 | 70 | 330 | 330 | 50 | 730 | 10.0 | 5 | 650 |
| P69 | 3.5 | 70 | 330 | 330 | 50 | 920 | 10.0 | 5 | 650 |
| P70 | 3.5 | 70 | 330 | 330 | 50 | 850 | 0.5 | 5 | 650 |
| P71 | 3.5 | 70 | 330 | 330 | 50 | 850 | 1005.0 | 5 | 650 |
| P72 | 3.5 | 70 | 330 | 330 | 50 | 850 | 10.0 | 0.5 | 650 |
| P73 | 3.5 | 70 | 330 | 330 | 50 | 850 | 10.0 | 13 | 650 |
| P74 | 3.5 | 70 | 330 | 330 | 50 | 850 | 10.0 | 5 | 560 |
| P75 | 3.5 | 70 | 330 | 330 | 50 | 850 | 10.0 | 5 | 740 |
| P76 | 3.5 | 70 | 330 | 330 | 50 | 850 | 10.0 | 5 | 650 |
| P77 | 3.5 | 70 | 330 | 330 | 50 | 850 | 10.0 | 5 | 650 |
| P78 | 3.5 | 70 | 330 | 330 | 50 | 850 | 10.0 | 5 | 650 |
| P79 | 3.5 | 70 | 330 | 330 | 50 | 850 | 10.0 | 5 | 650 |
| P80 | 3.5 | 70 | 330 | 330 | 50 | 850 | 10.0 | 5 | 650 |
| P81 | 3.5 | 70 | 330 | 330 | 50 | 850 | 10.0 | 5 | 650 |
| P82 | 3.5 | 70 | 330 | 330 | 50 | 850 | 10.0 | 5 | 650 |

TABLE 13-continued

| | | | | | | | | | |
|---|---|---|---|---|---|---|---|---|---|
| P83 | 3.5 | 70 | 330 | 330 | 50 | 850 | 10.0 | 5 | 650 |
| P84 | 3.5 | 70 | 330 | 330 | 50 | 850 | 10.0 | 5 | 650 |
| P85 | 3.5 | 70 | 330 | 330 | 50 | 850 | 10.0 | 5 | 650 |
| P86 | 3.5 | 70 | 330 | 330 | 50 | 850 | 10.0 | 5 | 650 |

| | FOURTH-COOLING | | OVERAGEING TREATMENT | | | COATING TREATMENT | |
|---|---|---|---|---|---|---|---|
| PRODUCTION No. | AVERAGE COOLING RATE/ ° C./second | TEMPERATURE AT COOLING FINISH/ ° C. | AGEING TEMPERATURE T2/ ° C. | CALCULATED UPPER VALUE OF t2/s | AGEING TIME t2/s | GALVANIZING | ALLOYING TREATMENT/ ° C. |
| P44 | 90 | 550 | 550 | 20184 | 120 | unconducted | unconducted |
| P45 | 90 | 550 | 550 | 20184 | 120 | unconducted | unconducted |
| P46 | 90 | 550 | 550 | 20184 | 120 | unconducted | unconducted |
| P47 | 90 | 550 | 550 | 20184 | 120 | unconducted | unconducted |
| P48 | 250 | 220 | 220 | 3845917820 | 120 | unconducted | unconducted |
| P49 | 90 | 550 | 550 | 20184 | 120 | unconducted | unconducted |
| P50 | 250 | 220 | 220 | 3845917820 | 120 | unconducted | unconducted |
| P51 | 2 | 550 | 550 | 20184 | 120 | unconducted | unconducted |
| P52 | 320 | 220 | 220 | 3845917820 | 120 | unconducted | unconducted |
| P53 | 90 | 180 | 180 | 15310874616820 | 120 | unconducted | unconducted |
| P54 | 90 | 620 | 620 | 609536897 | 120 | unconducted | unconducted |
| P55 | 90 | 450 | 450 | 20 | 120 | unconducted | unconducted |
| P56 | 90 | 550 | 550 | 20184 | 120 | unconducted | unconducted |
| P57 | 90 | 550 | 550 | 20184 | 120 | unconducted | unconducted |
| P58 | 90 | 550 | 550 | 20184 | 120 | unconducted | unconducted |
| P59 | 90 | 550 | 550 | 20184 | 120 | unconducted | unconducted |
| P60 | 90 | 550 | 550 | 20184 | 120 | unconducted | unconducted |
| P61 | 90 | 550 | 550 | 20184 | 120 | unconducted | unconducted |
| P62 | 90 | 550 | 550 | 20184 | 120 | unconducted | unconducted |
| P63 | 90 | 550 | 550 | 20184 | 120 | unconducted | unconducted |
| P64 | 90 | 550 | 550 | 20184 | 120 | unconducted | unconducted |
| P65 | 90 | 550 | 550 | 20184 | 120 | unconducted | unconducted |
| P66 | 90 | 550 | 550 | 20184 | 120 | unconducted | unconducted |
| P67 | 90 | 550 | 550 | 20184 | 120 | unconducted | unconducted |
| P68 | 90 | 550 | 550 | 20184 | 120 | unconducted | unconducted |
| P69 | 90 | 550 | 550 | 20184 | 120 | unconducted | unconducted |
| P70 | 90 | 550 | 550 | 20184 | 120 | unconducted | unconducted |
| P71 | 90 | 550 | 550 | 20184 | 120 | unconducted | unconducted |
| P72 | 90 | 550 | 550 | 20184 | 120 | unconducted | unconducted |
| P73 | 250 | 220 | 220 | 3845917820 | 120 | unconducted | unconducted |
| P74 | 90 | 550 | 550 | 20184 | 120 | unconducted | unconducted |
| P75 | 250 | 220 | 220 | 3845917820 | 120 | unconducted | unconducted |
| P76 | 2 | 550 | 550 | 20184 | 120 | unconducted | unconducted |
| P77 | 320 | 220 | 220 | 3845917820 | 120 | unconducted | unconducted |
| P78 | 90 | 180 | 180 | 15310874616820 | 120 | unconducted | unconducted |
| P79 | 90 | 620 | 620 | 609536897 | 120 | unconducted | unconducted |
| P80 | 90 | 450 | 450 | 20 | 120 | unconducted | unconducted |
| P81 | 90 | 550 | 550 | 20184 | 120 | unconducted | unconducted |
| P82 | 90 | 550 | 550 | 20184 | 120 | unconducted | unconducted |
| P83 | 90 | 550 | 550 | 20184 | 120 | unconducted | unconducted |
| P84 | 90 | 550 | 550 | 20184 | 120 | unconducted | unconducted |
| P85 | 90 | 550 | 550 | 20184 | 120 | unconducted | unconducted |
| P86 | 90 | 550 | 550 | 20184 | 120 | unconducted | unconducted |

TABLE 14

| | SECOND-COOLING | | | | COLD-ROLLING | HEATING AND HOLDING | | THIRD-COOLING | |
|---|---|---|---|---|---|---|---|---|---|
| PRODUCTION No. | TIME UNTIL SECOND COOLING START/s | AVERAGE COOLING RATE/ ° C./second | TEMPERATURE AT COOLING FINISH/ ° C. | COILING TEMPERATURE/ ° C. | CUMULATIVE REDUCTION/% | HEATING TEMPERATURE/ ° C. | HOLDING TIME/s | AVERAGE COOLING RATE/ ° C./second | TEMPERATURE AT COOLING FINISH/ ° C. |
| P87 | 3.5 | 70 | 330 | 330 | 50 | 850 | 10.0 | 5 | 650 |
| P88 | 3.5 | 70 | 330 | 330 | 50 | 850 | 10.0 | 5 | 650 |
| P89 | Cracks occur during Hot rolling | | | | | | | | |
| P90 | 3.5 | 70 | 330 | 330 | 50 | 850 | 10.0 | 5 | 650 |
| P91 | 3.5 | 70 | 330 | 330 | 50 | 850 | 10.0 | 5 | 650 |
| P92 | 3.5 | 70 | 330 | 330 | 50 | 850 | 10.0 | 5 | 650 |
| P93 | 3.5 | 70 | 330 | 330 | 50 | 850 | 10.0 | 5 | 650 |
| P94 | 3.5 | 70 | 330 | 330 | 50 | 850 | 10.0 | 5 | 650 |

TABLE 14-continued

| | | | | | | | | | |
|---|---|---|---|---|---|---|---|---|---|
| P95 | 3.5 | 70 | 330 | 330 | 50 | 850 | 10.0 | 5 | 650 |
| P96 | 3.5 | 70 | 330 | 330 | 50 | 850 | 10.0 | 5 | 650 |
| P97 | 3.5 | 70 | 330 | 330 | 50 | 850 | 10.0 | 5 | 650 |
| P98 | 3.5 | 70 | 330 | 330 | 50 | 850 | 10.0 | 5 | 650 |
| P99 | 3.5 | 70 | 330 | 330 | 50 | 850 | 10.0 | 5 | 650 |
| P100 | 3.5 | 70 | 330 | 330 | 50 | 850 | 10.0 | 5 | 650 |
| P101 | 3.5 | 70 | 330 | 330 | 50 | 850 | 10.0 | 5 | 650 |
| P102 | 3.5 | 70 | 330 | 330 | 50 | 850 | 10.0 | 5 | 650 |
| P103 | 3.5 | 70 | 330 | 330 | 50 | 850 | 10.0 | 5 | 650 |
| P104 | 3.5 | 70 | 330 | 330 | 50 | 850 | 10.0 | 5 | 650 |
| P105 | 3.5 | 70 | 330 | 330 | 50 | 850 | 10.0 | 5 | 650 |
| P106 | 3.5 | 70 | 330 | 330 | 50 | 850 | 10.0 | 5 | 650 |
| P107 | 3.5 | 70 | 330 | 330 | 50 | 850 | 10.0 | 5 | 650 |
| P108 | Cracks occur during Hot rolling | | | | | | | | |
| P109 | Cracks occur during Hot rolling | | | | | | | | |
| P110 | 3.5 | 70 | 330 | 330 | 50 | 850 | 10.0 | 5 | 650 |
| P111 | 3.5 | 70 | 330 | 330 | 50 | 850 | 10.0 | 5 | 650 |
| P112 | 3.5 | 70 | 330 | 330 | 50 | 850 | 10.0 | 5 | 650 |
| P113 | 3.5 | 70 | 330 | 330 | 50 | 850 | 10.0 | 5 | 650 |
| P114 | 3.5 | 70 | 330 | 330 | 50 | 850 | 10.0 | 5 | 650 |
| P115 | 3.5 | 70 | 330 | 330 | 50 | 850 | 10.0 | 5 | 650 |
| P116 | 3.5 | 70 | 330 | 330 | 50 | 850 | 10.0 | 5 | 650 |
| P117 | 3.5 | 70 | 330 | 330 | 50 | 850 | 10.0 | 5 | 650 |
| P118 | 3.5 | 70 | 330 | 330 | 50 | 850 | 10.0 | 5 | 650 |
| P119 | 3.5 | 70 | 330 | 330 | 50 | 850 | 10.0 | 5 | 650 |
| P120 | 3.5 | 70 | 330 | 330 | 50 | 850 | 10.0 | 5 | 650 |
| P121 | 3.5 | 70 | 330 | 330 | 50 | 850 | 10.0 | 5 | 650 |
| P122 | 3.5 | 70 | 330 | 330 | 50 | 850 | 10.0 | 5 | 650 |
| P123 | 3.5 | 70 | 330 | 330 | 50 | 850 | 10.0 | 5 | 650 |
| P124 | 3.5 | 70 | 330 | 330 | 50 | 850 | 10.0 | 5 | 650 |
| P125 | 3.5 | 70 | 330 | 330 | 50 | 850 | 10.0 | 5 | 650 |
| P126 | 3.5 | 70 | 330 | 330 | 50 | 850 | 10.0 | 5 | 650 |
| P127 | 3.5 | 70 | 330 | 330 | 50 | 850 | 10.0 | 5 | 650 |
| P128 | 3.5 | 70 | 330 | 330 | 50 | 850 | 10.0 | 5 | 650 |
| P129 | 3.5 | 70 | 330 | 330 | 50 | 850 | 10.0 | 5 | 650 |

| | FOURTH-COOLING | | OVERAGEING TREATMENT | | | COATING | |
|---|---|---|---|---|---|---|---|
| | AVERAGE | TEMPERATURE | AGEING | | | TREATMENT | |
| PRODUCTION No. | COOLING RATE/ ° C./second | AT COOLING FINISH/ ° C. | TEMPERATURE T2/ ° C. | CALCULATED UPPER VALUE OF t2/s | AGEING TIME t2/s | GALVANIZING | ALLOYING TREATMENT/ ° C. |
| P87 | 90 | 550 | 550 | 20184 | 120 | unconducted | unconducted |
| P88 | 90 | 550 | 550 | 20184 | 120 | unconducted | unconducted |
| P89 | Cracks occur during Hot rolling | | | | | | |
| P90 | 90 | 550 | 550 | 20184 | 120 | unconducted | unconducted |
| P91 | 90 | 550 | 550 | 20184 | 120 | unconducted | unconducted |
| P92 | 90 | 550 | 550 | 20184 | 120 | unconducted | unconducted |
| P93 | 90 | 550 | 550 | 20184 | 120 | unconducted | unconducted |
| P94 | 90 | 550 | 550 | 20184 | 120 | unconducted | unconducted |
| P95 | 90 | 550 | 550 | 20184 | 120 | unconducted | unconducted |
| P96 | 90 | 550 | 550 | 20184 | 120 | unconducted | unconducted |
| P97 | 90 | 550 | 550 | 20184 | 120 | unconducted | unconducted |
| P98 | 90 | 550 | 550 | 20184 | 120 | unconducted | unconducted |
| P99 | 90 | 550 | 550 | 20184 | 120 | unconducted | unconducted |
| P100 | 90 | 550 | 550 | 20184 | 120 | unconducted | unconducted |
| P101 | 90 | 550 | 550 | 20184 | 120 | unconducted | unconducted |
| P102 | 90 | 550 | 550 | 20184 | 120 | unconducted | unconducted |
| P103 | 90 | 550 | 550 | 20184 | 120 | unconducted | unconducted |
| P104 | 90 | 550 | 550 | 20184 | 120 | unconducted | unconducted |
| P105 | 90 | 550 | 550 | 20184 | 120 | unconducted | unconducted |
| P106 | 90 | 550 | 550 | 20184 | 120 | unconducted | unconducted |
| P107 | 90 | 550 | 550 | 20184 | 120 | unconducted | unconducted |
| P108 | Cracks occur during Hot rolling | | | | | | |
| P109 | Cracks occur during Hot rolling | | | | | | |
| P110 | 90 | 550 | 550 | 20184 | 120 | unconducted | unconducted |
| P111 | 90 | 550 | 550 | 20184 | 120 | unconducted | unconducted |
| P112 | 90 | 550 | 550 | 20184 | 120 | unconducted | unconducted |
| P113 | 90 | 550 | 550 | 20184 | 120 | unconducted | unconducted |
| P114 | 90 | 550 | 550 | 20184 | 120 | unconducted | unconducted |
| P115 | 90 | 550 | 550 | 20184 | 120 | unconducted | unconducted |
| P116 | 90 | 550 | 550 | 20184 | 120 | unconducted | unconducted |
| P117 | 90 | 550 | 550 | 20184 | 120 | unconducted | unconducted |
| P118 | 90 | 550 | 550 | 20184 | 120 | unconducted | unconducted |
| P119 | 90 | 550 | 550 | 20184 | 120 | unconducted | unconducted |
| P120 | 90 | 550 | 550 | 20184 | 120 | unconducted | unconducted |
| P121 | 90 | 550 | 550 | 20184 | 120 | unconducted | unconducted |
| P122 | 90 | 550 | 550 | 20184 | 120 | unconducted | unconducted |

TABLE 14-continued

| | | | | | | | |
|---|---|---|---|---|---|---|---|
| P123 | 90 | 550 | 550 | 20184 | 120 | unconducted | unconducted |
| P124 | 90 | 550 | 550 | 20184 | 120 | unconducted | unconducted |
| P125 | 90 | 550 | 550 | 20184 | 120 | unconducted | unconducted |
| P126 | 90 | 550 | 550 | 20184 | 120 | unconducted | unconducted |
| P127 | 90 | 550 | 550 | 20184 | 120 | unconducted | unconducted |
| P128 | 90 | 550 | 550 | 20184 | 120 | unconducted | unconducted |
| P129 | 90 | 550 | 550 | 20184 | 120 | unconducted | unconducted |

TABLE 15

| | SECOND-COOLING | | | | | | | THIRD-COOLING | |
|---|---|---|---|---|---|---|---|---|---|
| | TIME | | TEMPERATURE | | COLD-ROLLING | HEATING AND HOLDING | | | TEMPERATURE |
| PRODUCTION No. | UNTIL SECOND COOLING START/s | AVERAGE COOLING RATE/ ° C./second | AT COOLING FINISH/ ° C. | COILING TEMPERATURE/ ° C. | CUMULATIVE REDUCTION/% | HEATING TEMPERATURE/ ° C. | HOLDING TIME/s | AVERAGE COOLING RATE/ ° C./second | AT COOLING FINISH/ ° C. |
| P130 | 3.5 | 70 | 330 | 330 | 50 | 850 | 10.0 | 5 | 650 |
| P131 | 3.5 | 70 | 330 | 330 | 50 | 850 | 10.0 | 5 | 650 |
| P132 | 3.5 | 70 | 330 | 330 | 50 | 850 | 10.0 | 5 | 650 |
| P133 | 3.5 | 70 | 330 | 330 | 50 | 850 | 10.0 | 5 | 650 |
| P134 | 3.5 | 70 | 330 | 330 | 50 | 850 | 10.0 | 5 | 650 |
| P135 | 3.5 | 70 | 330 | 330 | 50 | 850 | 10.0 | 5 | 650 |
| P136 | 3.5 | 70 | 330 | 330 | 50 | 850 | 10.0 | 5 | 650 |
| P137 | 3.5 | 70 | 330 | 330 | 50 | 850 | 10.0 | 5 | 650 |
| P138 | 3.5 | 70 | 330 | 330 | 50 | 850 | 10.0 | 5 | 650 |
| P139 | 3.5 | 70 | 330 | 330 | 50 | 850 | 10.0 | 5 | 650 |
| P140 | 3.5 | 70 | 330 | 330 | 50 | 850 | 10.0 | 5 | 650 |
| P141 | 3.5 | 70 | 330 | 330 | 50 | 850 | 10.0 | 5 | 650 |
| P142 | 3.5 | 70 | 330 | 330 | 50 | 850 | 10.0 | 5 | 650 |
| P143 | 3.5 | 70 | 330 | 330 | 50 | 850 | 10.0 | 5 | 650 |
| P144 | 3.5 | 70 | 330 | 330 | 50 | 850 | 10.0 | 5 | 650 |
| P145 | 3.5 | 70 | 330 | 330 | 50 | 850 | 10.0 | 5 | 650 |
| P146 | 3.5 | 70 | 330 | 330 | 50 | 850 | 10.0 | 5 | 650 |
| P147 | 3.5 | 70 | 330 | 330 | 50 | 850 | 10.0 | 5 | 650 |
| P148 | 3.5 | 70 | 330 | 330 | 50 | 850 | 10.0 | 5 | 650 |
| P149 | 3.5 | 70 | 330 | 330 | 50 | 850 | 10.0 | 5 | 650 |
| P150 | 3.5 | 70 | 330 | 330 | 50 | 850 | 10.0 | 5 | 650 |
| P151 | 3.5 | 70 | 330 | 330 | 50 | 850 | 10.0 | 5 | 650 |
| P152 | 3.5 | 70 | 330 | 330 | 50 | 850 | 10.0 | 5 | 650 |
| P153 | 3.5 | 70 | 330 | 330 | 50 | 850 | 10.0 | 5 | 650 |
| P154 | 3.5 | 70 | 330 | 330 | 50 | 850 | 10.0 | 5 | 650 |
| P155 | 3.5 | 70 | 330 | 330 | 50 | 850 | 10.0 | 5 | 650 |
| P156 | 3.5 | 70 | 330 | 330 | 50 | 850 | 10.0 | 5 | 650 |
| P157 | 3.5 | 70 | 330 | 330 | 50 | 850 | 10.0 | 5 | 650 |
| P158 | 3.5 | 70 | 330 | 330 | 50 | 850 | 10.0 | 5 | 650 |
| P159 | 3.5 | 70 | 330 | 330 | 50 | 850 | 10.0 | 5 | 650 |
| P160 | 3.5 | 70 | 330 | 330 | 50 | 850 | 10.0 | 5 | 650 |
| P161 | 3.5 | 70 | 330 | 330 | 50 | 850 | 10.0 | 5 | 650 |
| P162 | 3.5 | 70 | 330 | 330 | 50 | 850 | 10.0 | 5 | 650 |
| P163 | 3.5 | 70 | 330 | 330 | 50 | 850 | 10.0 | 5 | 650 |
| P164 | 3.5 | 70 | 330 | 330 | 50 | 850 | 10.0 | 5 | 650 |
| P165 | 3.5 | 70 | 330 | 330 | 50 | 850 | 10.0 | 5 | 650 |
| P166 | 3.5 | 70 | 330 | 330 | 50 | 850 | 10.0 | 5 | 650 |
| P167 | 3.5 | 70 | 330 | 330 | 50 | 850 | 10.0 | 5 | 650 |
| P168 | 3.5 | 70 | 330 | 330 | 50 | 850 | 10.0 | 5 | 650 |
| P169 | 3.5 | 70 | 330 | 330 | 50 | 850 | 10.0 | 5 | 650 |
| P170 | 3.5 | 70 | 330 | 330 | 50 | 850 | 10.0 | 5 | 650 |
| P171 | 3.5 | 70 | 330 | 330 | 50 | 850 | 10.0 | 5 | 650 |
| P172 | 3.5 | 70 | 330 | 330 | 50 | 850 | 10.0 | 5 | 650 |

| | FOURTH-COOLING | | OVERAGEING TREATMENT | | | COATING | |
|---|---|---|---|---|---|---|---|
| | AVERAGE | TEMPERATURE | AGEING | | | TREATMENT | |
| PRODUCTION No. | COOLING RATE/ ° C./second | AT COOLING FINISH/ ° C. | TEMPERATURE T2/ ° C. | CALCULATED UPPER VALUE OF t2/s | AGEING TIME t2/s | GALVANIZING | ALLOYING TREATMENT/ ° C. |
| P130 | 90 | 550 | 550 | 20184 | 120 | unconducted | unconducted |
| P131 | 90 | 550 | 550 | 20184 | 120 | unconducted | unconducted |
| P132 | 90 | 550 | 550 | 20184 | 120 | unconducted | unconducted |
| P133 | 90 | 550 | 550 | 20184 | 120 | unconducted | unconducted |
| P134 | 90 | 550 | 550 | 20184 | 120 | unconducted | unconducted |

TABLE 15-continued

| | | | | | | | |
|---|---|---|---|---|---|---|---|
| P135 | 90 | 550 | 550 | 20184 | 120 | unconducted | unconducted |
| P136 | 90 | 550 | 550 | 20184 | 120 | unconducted | unconducted |
| P137 | 90 | 550 | 550 | 20184 | 120 | unconducted | unconducted |
| P138 | 90 | 550 | 550 | 20184 | 120 | unconducted | unconducted |
| P139 | 90 | 550 | 550 | 20184 | 120 | unconducted | unconducted |
| P140 | 90 | 550 | 550 | 20184 | 120 | unconducted | unconducted |
| P141 | 90 | 550 | 550 | 20184 | 120 | unconducted | unconducted |
| P142 | 90 | 550 | 550 | 20184 | 120 | unconducted | unconducted |
| P143 | 90 | 550 | 550 | 20184 | 120 | unconducted | unconducted |
| P144 | 90 | 550 | 550 | 20184 | 120 | unconducted | unconducted |
| P145 | 90 | 550 | 550 | 20184 | 120 | unconducted | unconducted |
| P146 | 90 | 550 | 550 | 20184 | 120 | unconducted | unconducted |
| P147 | 90 | 550 | 550 | 20184 | 120 | unconducted | unconducted |
| P148 | 90 | 550 | 550 | 20184 | 120 | unconducted | unconducted |
| P149 | 90 | 550 | 550 | 20184 | 120 | unconducted | unconducted |
| P150 | 90 | 550 | 550 | 20184 | 120 | unconducted | unconducted |
| P151 | 90 | 550 | 550 | 20184 | 120 | unconducted | unconducted |
| P152 | 90 | 550 | 550 | 20184 | 120 | unconducted | unconducted |
| P153 | 90 | 550 | 550 | 20184 | 120 | unconducted | unconducted |
| P154 | 90 | 550 | 550 | 20184 | 120 | unconducted | unconducted |
| P155 | 90 | 550 | 550 | 20184 | 120 | unconducted | unconducted |
| P156 | 90 | 550 | 550 | 20184 | 120 | unconducted | unconducted |
| P157 | 90 | 550 | 550 | 20184 | 120 | unconducted | unconducted |
| P158 | 90 | 550 | 550 | 20184 | 120 | unconducted | unconducted |
| P159 | 90 | 550 | 550 | 20184 | 120 | unconducted | unconducted |
| P160 | 90 | 550 | 550 | 20184 | 120 | unconducted | unconducted |
| P161 | 90 | 550 | 550 | 20184 | 120 | unconducted | unconducted |
| P162 | 90 | 550 | 550 | 20184 | 120 | unconducted | unconducted |
| P163 | 90 | 550 | 550 | 20184 | 120 | unconducted | unconducted |
| P164 | 90 | 550 | 550 | 20184 | 120 | unconducted | unconducted |
| P165 | 90 | 550 | 550 | 20184 | 120 | unconducted | unconducted |
| P166 | 90 | 550 | 550 | 20184 | 120 | unconducted | unconducted |
| P167 | 90 | 550 | 550 | 20184 | 120 | unconducted | unconducted |
| P168 | 90 | 550 | 550 | 20184 | 120 | unconducted | unconducted |
| P169 | 90 | 550 | 550 | 20184 | 120 | unconducted | unconducted |
| P170 | 90 | 550 | 550 | 20184 | 120 | unconducted | unconducted |
| P171 | 90 | 550 | 550 | 20184 | 120 | unconducted | unconducted |
| P172 | 90 | 550 | 550 | 20184 | 120 | unconducted | unconducted |

TABLE 16

| | SECOND-COOLING | | | | | | | THIRD-COOLING | |
|---|---|---|---|---|---|---|---|---|---|
| | TIME | | TEMPER-ATURE | | | HEATING AND HOLDING | | | TEMPER-ATURE |
| PRO-DUC-TION No. | UNTIL SECOND COOLING START/s | AVERAGE COOLING RATE/ ° C./second | AT COOLING FINISH/ ° C. | COILING TEMPERATURE/ ° C. | COLD-ROLLING CUMULATIVE REDUCTION/% | HEATING TEMPER-ATURE/ ° C. | HOLDING TIME/s | AVERAGE COOLING RATE/ ° C./second | AT COOLING FINISH/ ° C. |
| P173 | 3.5 | 70 | 330 | 330 | 50 | 850 | 10.0 | 5 | 650 |
| P174 | 3.5 | 70 | 330 | 330 | 50 | 850 | 10.0 | 5 | 650 |
| P175 | 3.5 | 70 | 330 | 330 | 50 | 850 | 10.0 | 5 | 650 |
| P176 | 3.5 | 70 | 330 | 330 | 50 | 850 | 10.0 | 5 | 650 |
| P177 | 3.5 | 70 | 330 | 330 | 50 | 850 | 10.0 | 5 | 650 |
| P178 | 3.5 | 70 | 330 | 330 | 50 | 850 | 10.0 | 5 | 650 |
| P179 | 3.5 | 70 | 330 | 330 | 50 | 850 | 10.0 | 5 | 650 |
| P180 | 3.5 | 70 | 330 | 330 | 50 | 850 | 10.0 | 5 | 650 |
| P181 | 3.5 | 70 | 330 | 330 | 50 | 850 | 10.0 | 5 | 650 |
| P182 | 3.5 | 70 | 330 | 330 | 50 | 850 | 10.0 | 5 | 650 |
| P183 | 3.5 | 70 | 330 | 330 | 50 | 850 | 10.0 | 5 | 650 |
| P184 | 3.5 | 70 | 330 | 330 | 50 | 850 | 10.0 | 5 | 650 |
| P185 | 3.5 | 70 | 330 | 330 | 50 | 850 | 10.0 | 5 | 650 |
| P186 | 3.5 | 70 | 330 | 330 | 50 | 850 | 10.0 | 5 | 650 |
| P187 | 3.5 | 70 | 330 | 330 | 50 | 850 | 10.0 | 5 | 650 |
| P188 | 3.5 | 70 | 330 | 330 | 50 | 850 | 10.0 | 5 | 650 |
| P189 | 3.5 | 70 | 330 | 330 | 50 | 850 | 10.0 | 5 | 650 |
| P190 | 3.5 | 70 | 330 | 330 | 50 | 850 | 10.0 | 5 | 650 |
| P191 | 3.5 | 70 | 330 | 330 | 50 | 850 | 10.0 | 5 | 650 |
| P192 | 3.5 | 70 | 330 | 330 | 50 | 850 | 10.0 | 5 | 650 |
| P193 | 3.5 | 70 | 330 | 330 | 50 | 850 | 10.0 | 5 | 650 |
| P194 | 3.5 | 70 | 330 | 330 | 50 | 850 | 10.0 | 5 | 650 |
| P195 | 3.5 | 70 | 330 | 330 | 50 | 850 | 10.0 | 5 | 650 |
| P196 | 3.5 | 70 | 330 | 330 | 50 | 850 | 10.0 | 5 | 650 |
| P197 | 3.5 | 70 | 330 | 330 | 50 | 850 | 10.0 | 5 | 650 |
| P198 | 3.5 | 70 | 330 | 330 | 50 | 850 | 10.0 | 5 | 650 |

TABLE 16-continued

| | | | | | | | | | |
|---|---|---|---|---|---|---|---|---|---|
| P199 | 3.5 | 70 | 330 | 330 | 50 | 850 | 10.0 | 5 | 650 |
| P200 | 3.5 | 70 | 330 | 330 | 50 | 850 | 10.0 | 5 | 650 |
| P201 | 3.5 | 70 | 330 | 330 | 50 | 850 | 10.0 | 5 | 650 |
| P202 | 3.5 | 70 | 330 | 330 | 50 | 850 | 10.0 | 5 | 650 |
| P203 | 3.5 | 70 | 330 | 330 | 50 | 850 | 10.0 | 5 | 650 |
| P204 | 3.5 | 70 | 330 | 330 | 50 | 850 | 10.0 | 5 | 650 |
| P205 | 3.5 | 70 | 330 | 330 | 50 | 850 | 10.0 | 5 | 650 |
| P206 | 3.5 | 70 | 330 | 330 | 50 | 850 | 10.0 | 5 | 650 |
| P207 | 3.5 | 70 | 330 | 330 | 50 | 850 | 10.0 | 5 | 650 |
| P208 | 3.5 | 70 | 330 | 330 | 50 | 850 | 10.0 | 5 | 650 |
| P209 | 3.5 | 70 | 330 | 330 | 50 | 850 | 10.0 | 5 | 650 |
| P210 | 3.5 | 70 | 330 | 330 | 50 | 850 | 10.0 | 5 | 650 |
| P211 | 3.5 | 70 | 330 | 330 | 50 | 850 | 10.0 | 5 | 650 |
| P212 | 3.5 | 70 | 330 | 330 | 50 | 850 | 10.0 | 5 | 650 |
| P213 | 3.5 | 70 | 330 | 330 | 50 | 850 | 10.0 | 5 | 650 |
| P214 | 3.5 | 70 | 330 | 330 | 50 | 850 | 10.0 | 5 | 650 |

| | FOURTH-COOLING | | OVERAGEING TREATMENT | | | COATING TREATMENT | |
|---|---|---|---|---|---|---|---|
| PRODUCTION No. | AVERAGE COOLING RATE/ ° C./second | TEMPERATURE AT COOLING FINISH/ ° C. | AGEING TEMPERATURE T2/ ° C. | CALCULATED UPPER VALUE OF t2/s | AGEING TIME t2/s | GALVANIZING | ALLOYING TREATMENT/ ° C. |
| P173 | 90 | 550 | 550 | 20184 | 120 | unconducted | unconducted |
| P174 | 90 | 550 | 550 | 20184 | 120 | unconducted | unconducted |
| P175 | 90 | 550 | 550 | 20184 | 120 | unconducted | unconducted |
| P176 | 90 | 550 | 550 | 20184 | 120 | unconducted | unconducted |
| P177 | 90 | 550 | 550 | 20184 | 120 | unconducted | unconducted |
| P178 | 90 | 550 | 550 | 20184 | 120 | unconducted | unconducted |
| P179 | 90 | 550 | 550 | 20184 | 120 | unconducted | unconducted |
| P180 | 90 | 550 | 550 | 20184 | 120 | unconducted | unconducted |
| P181 | 90 | 550 | 550 | 20184 | 120 | unconducted | unconducted |
| P182 | 90 | 550 | 550 | 20184 | 120 | unconducted | unconducted |
| P183 | 90 | 550 | 550 | 20184 | 120 | unconducted | unconducted |
| P184 | 90 | 550 | 550 | 20184 | 120 | unconducted | unconducted |
| P185 | 90 | 550 | 550 | 20184 | 120 | unconducted | unconducted |
| P186 | 90 | 550 | 550 | 20184 | 120 | unconducted | unconducted |
| P187 | 90 | 550 | 550 | 20184 | 120 | unconducted | unconducted |
| P188 | 90 | 550 | 550 | 20184 | 120 | unconducted | unconducted |
| P189 | 90 | 550 | 550 | 20184 | 120 | unconducted | unconducted |
| P190 | 90 | 550 | 550 | 20184 | 120 | unconducted | unconducted |
| P191 | 90 | 550 | 550 | 20184 | 120 | unconducted | unconducted |
| P192 | 90 | 550 | 550 | 20184 | 120 | unconducted | unconducted |
| P193 | 90 | 550 | 550 | 20184 | 120 | unconducted | unconducted |
| P194 | 90 | 550 | 550 | 20184 | 120 | unconducted | unconducted |
| P195 | 90 | 550 | 550 | 20184 | 120 | unconducted | unconducted |
| P196 | 90 | 550 | 550 | 20184 | 120 | unconducted | unconducted |
| P197 | 90 | 550 | 550 | 20184 | 120 | unconducted | unconducted |
| P198 | 90 | 550 | 550 | 20184 | 120 | unconducted | unconducted |
| P199 | 90 | 550 | 550 | 20184 | 120 | unconducted | unconducted |
| P200 | 90 | 550 | 550 | 20184 | 120 | unconducted | unconducted |
| P201 | 90 | 550 | 550 | 20184 | 120 | conducted | 570 |
| P202 | 90 | 550 | 550 | 20184 | 120 | conducted | 570 |
| P203 | 90 | 550 | 550 | 20184 | 120 | conducted | 540 |
| P204 | 90 | 550 | 550 | 20184 | 120 | conducted | 530 |
| P205 | 90 | 550 | 550 | 20184 | 120 | conducted | 570 |
| P206 | 90 | 550 | 550 | 20184 | 120 | conducted | 570 |
| P207 | 90 | 550 | 550 | 20184 | 120 | conducted | 540 |
| P208 | 90 | 550 | 550 | 20184 | 120 | conducted | 540 |
| P209 | 90 | 550 | 550 | 20184 | 120 | conducted | 570 |
| P210 | 90 | 550 | 550 | 20184 | 120 | conducted | 540 |
| P211 | 90 | 550 | 550 | 20184 | 120 | conducted | 570 |
| P212 | 90 | 550 | 550 | 20184 | 120 | conducted | 570 |
| P213 | 90 | 550 | 550 | 20184 | 120 | conducted | 540 |
| P214 | 90 | 550 | 550 | 20184 | 120 | conducted | 570 |

TABLE 17

| PRODUCTION | TEXTURE | | AREA FRACTION OF METALLOGRAPHIC STRUCTURE | | | | | | | |
|---|---|---|---|---|---|---|---|---|---|---|
| No. | D1/— | D2/— | F/% | B/% | F + B/% | fM/% | P/% | γ/% | PHASE WITH EXCEPTION OF F, B, AND M/% | AREA FRACTION OF COARSE GRAINS/% |
| P1 | 4.7 | 3.7 | 75.0 | 22.0 | 97.0 | 3.0 | 0.0 | 0.0 | 0.0 | 12.0 |
| P2 | 4.5 | 3.5 | 75.0 | 22.0 | 97.0 | 3.0 | 0.0 | 0.0 | 0.0 | 9.5 |
| P3 | 4.4 | 3.4 | 75.0 | 22.0 | 97.0 | 3.0 | 0.0 | 0.0 | 0.0 | 9.0 |
| P4 | 4.9 | 3.8 | 75.0 | 22.0 | 97.0 | 3.0 | 0.0 | 0.0 | 0.0 | 7.5 |
| P5 | 4.2 | 3.2 | 75.0 | 22.0 | 97.0 | 3.0 | 0.0 | 0.0 | 0.0 | 8.0 |
| P6 | 4.0 | 3.0 | 75.0 | 22.0 | 97.0 | 3.0 | 0.0 | 0.0 | 0.0 | 7.5 |
| P7 | 3.8 | 2.8 | 75.0 | 22.0 | 97.0 | 3.0 | 0.0 | 0.0 | 0.0 | 7.3 |
| P8 | 4.4 | 3.4 | 75.0 | 22.0 | 97.0 | 3.0 | 0.0 | 0.0 | 0.0 | 9.0 |
| P9 | 3.7 | 2.7 | 75.0 | 22.0 | 97.0 | 3.0 | 0.0 | 0.0 | 0.0 | 7.2 |
| P10 | 4.2 | 3.2 | 75.0 | 22.0 | 97.0 | 3.0 | 0.0 | 0.0 | 0.0 | 8.0 |
| P11 | 3.9 | 2.9 | 75.0 | 22.0 | 97.0 | 3.0 | 0.0 | 0.0 | 0.0 | 7.4 |
| P12 | 4.6 | 3.6 | 75.0 | 22.0 | 97.0 | 3.0 | 0.0 | 0.0 | 0.0 | 9.0 |
| P13 | 3.7 | 2.7 | 95.0 | 3.0 | 98.0 | 2.0 | 0.0 | 0.0 | 0.0 | 12.0 |
| P14 | 3.7 | 2.7 | 22.0 | 75.0 | 97.0 | 2.0 | 1.0 | 0.0 | 1.0 | 7.2 |
| P15 | 3.7 | 2.7 | 35.0 | 2.0 | 37.0 | 60.0 | 0.0 | 3.0 | 3.0 | 7.2 |
| P16 | 3.8 | 2.8 | 75.0 | 22.0 | 97.0 | 3.0 | 0.0 | 0.0 | 0.0 | 5.0 |
| P17 | 4.0 | 3.0 | 75.0 | 22.0 | 97.0 | 3.0 | 0.0 | 0.0 | 0.0 | 14.0 |
| P18 | 3.8 | 2.8 | 75.0 | 22.0 | 97.0 | 3.0 | 0.0 | 0.0 | 0.0 | 15.0 |
| P19 | 3.5 | 2.5 | 75.0 | 22.0 | 97.0 | 3.0 | 0.0 | 0.0 | 0.0 | 10.0 |
| P20 | 3.3 | 2.3 | 75.0 | 22.0 | 97.0 | 3.0 | 0.0 | 0.0 | 0.0 | 9.5 |
| P21 | 3.1 | 2.1 | 75.0 | 22.0 | 97.0 | 3.0 | 0.0 | 0.0 | 0.0 | 9.3 |
| P22 | 3.7 | 2.7 | 75.0 | 22.0 | 97.0 | 3.0 | 0.0 | 0.0 | 0.0 | 11.0 |
| P23 | 3.0 | 2.0 | 75.0 | 22.0 | 97.0 | 3.0 | 0.0 | 0.0 | 0.0 | 9.2 |
| P24 | 3.5 | 2.5 | 75.0 | 22.0 | 97.0 | 3.0 | 0.0 | 0.0 | 0.0 | 10.0 |
| P25 | 3.2 | 2.2 | 75.0 | 22.0 | 97.0 | 3.0 | 0.0 | 0.0 | 0.0 | 9.4 |
| P26 | 3.9 | 2.9 | 75.0 | 22.0 | 97.0 | 3.0 | 0.0 | 0.0 | 0.0 | 11.0 |
| P27 | 3.0 | 2.0 | 95.0 | 3.0 | 98.0 | 2.0 | 0.0 | 0.0 | 0.0 | 9.2 |
| P28 | 3.0 | 2.0 | 22.0 | 75.0 | 97.0 | 2.0 | 1.0 | 0.0 | 1.0 | 9.2 |
| P29 | 3.0 | 2.0 | 35.0 | 2.0 | 37.0 | 60.0 | 0.0 | 3.0 | 3.0 | 9.2 |
| P30 | 2.9 | 1.9 | 75.0 | 22.0 | 97.0 | 3.0 | 0.0 | 0.0 | 0.0 | 9.7 |
| P31 | 5.8 | 4.8 | 75.0 | 22.0 | 97.0 | 3.0 | 0.0 | 0.0 | 0.0 | 20.0 |
| P32 | 5.8 | 4.8 | 75.0 | 22.0 | 97.0 | 3.0 | 0.0 | 0.0 | 0.0 | 20.0 |
| P33 | 5.8 | 4.8 | 75.0 | 22.0 | 97.0 | 3.0 | 0.0 | 0.0 | 0.0 | 14.0 |
| P34 | 5.8 | 4.8 | 75.0 | 22.0 | 97.0 | 3.0 | 0.0 | 0.0 | 0.0 | 20.0 |
| P35 | 5.8 | 4.8 | 75.0 | 22.0 | 97.0 | 3.0 | 0.0 | 0.0 | 0.0 | 14.0 |
| P36 | 4.7 | 3.7 | 75.0 | 22.0 | 97.0 | 3.0 | 0.0 | 0.0 | 0.0 | 20.0 |
| P37 | 4.7 | 3.7 | 75.0 | 22.0 | 97.0 | 3.0 | 0.0 | 0.0 | 0.0 | 20.0 |
| P38 | 5.8 | 4.8 | 75.0 | 22.0 | 97.0 | 3.0 | 0.0 | 0.0 | 0.0 | 14.0 |
| P39 | 4.7 | 3.7 | 75.0 | 22.0 | 97.0 | 3.0 | 0.0 | 0.0 | 0.0 | 20.0 |
| P40 | 5.8 | 4.8 | 75.0 | 22.0 | 97.0 | 3.0 | 0.0 | 0.0 | 0.0 | 14.0 |
| P41 | 5.8 | 4.8 | 75.0 | 22.0 | 97.0 | 3.0 | 0.0 | 0.0 | 0.0 | 20.0 |
| P42 | 5.8 | 4.8 | 75.0 | 22.0 | 97.0 | 3.0 | 0.0 | 0.0 | 0.0 | 14.0 |
| P43 | 4.7 | 3.7 | 77.0 | 23.0 | 100.0 | 0.0 | 0.0 | 0.0 | 0.0 | 12.0 |

| PRODUCTION No. | SIZE OF METALLOGRAPHIC STRUCTURE | | | |
|---|---|---|---|---|
| | VOLUME AVERAGE DIAMETER/ μm | dia/ μm | dis/ μm | AREA FRACTION WHERE La/Lb ≤5.0 IS SATISFIED/% |
| P1 | 29.5 | 7.5 | 27.0 | 51.0 |
| P2 | 28.5 | 7.0 | 26.5 | 53.0 |
| P3 | 27.5 | 6.5 | 26.0 | 54.0 |
| P4 | 22.0 | 5.5 | 25.5 | 55.0 |
| P5 | 25.0 | 6.0 | 25.8 | 55.0 |
| P6 | 22.0 | 5.5 | 25.5 | 56.0 |
| P7 | 20.0 | 5.3 | 25.0 | 57.0 |
| P8 | 27.5 | 6.5 | 26.0 | 54.0 |
| P9 | 19.0 | 5.2 | 25.0 | 57.5 |
| P10 | 25.0 | 6.0 | 25.8 | 55.0 |
| P11 | 21.0 | 5.4 | 25.3 | 56.0 |
| P12 | 27.5 | 6.5 | 26.0 | 54.0 |
| P13 | 29.5 | 5.0 | 24.5 | 58.0 |
| P14 | 19.0 | 5.2 | 25.0 | 57.5 |
| P15 | 19.0 | 1.0 | 25.0 | 57.5 |
| P16 | 15.0 | 4.2 | 24.3 | 59.5 |
| P17 | 31.0 | 8.0 | 27.5 | 51.0 |
| P18 | 35.0 | 8.5 | 28.0 | 50.6 |
| P19 | 26.5 | 6.5 | 26.3 | 55.0 |
| P20 | 23.5 | 6.0 | 26.0 | 56.0 |

TABLE 17-continued

| | | | | |
|---|---|---|---|---|
| P21 | 21.5 | 5.8 | 26.5 | 57.0 |
| P22 | 29.0 | 7.0 | 26.5 | 54.0 |
| P23 | 20.5 | 5.7 | 25.5 | 57.5 |
| P24 | 26.5 | 6.5 | 26.3 | 55.0 |
| P25 | 22.5 | 5.9 | 25.8 | 56.0 |
| P26 | 29.0 | 7.0 | 26.5 | 54.0 |
| P27 | 20.5 | 5.5 | 25.0 | 58.0 |
| P28 | 20.5 | 5.7 | 25.5 | 57.5 |
| P29 | 20.5 | 1.0 | 25.0 | 57.5 |
| P30 | 22.5 | 6.0 | 26.2 | 57.3 |
| P31 | 40.0 | 15.0 | 35.0 | 50.0 |
| P32 | 40.0 | 15.0 | 35.0 | 50.0 |
| P33 | 40.0 | 15.0 | 35.0 | 50.0 |
| P34 | 42.0 | 15.0 | 35.0 | 45.0 |
| P35 | 29.5 | 10.0 | 30.0 | 45.0 |
| P36 | 40.0 | 15.0 | 35.0 | 50.0 |
| P37 | 40.0 | 15.0 | 35.0 | 50.0 |
| P38 | 29.5 | 10.0 | 30.0 | 50.0 |
| P39 | 40.0 | 15.0 | 35.0 | 50.0 |
| P40 | 29.5 | 10.0 | 30.0 | 45.0 |
| P41 | 40.0 | 15.0 | 35.0 | 50.0 |
| P42 | 29.5 | 10.0 | 30.0 | 45.0 |
| P43 | 29.5 | — | — | — |

TABLE 18

| PRODUCTION | TEXTURE | | AREA FRACTION OF METALLOGRAPHIC STRUCTURE | | | | | | | |
|---|---|---|---|---|---|---|---|---|---|---|
| No. | D1/— | D2/— | F/% | B/% | F + B/% | fM/% | P/% | γ/% | PHASE WITH EXCEPTION OF F, B, AND M/% | AREA FRACTION OF COARSE GRAINS/% |
| P44 | 4.7 | 3.7 | 75.0 | 22.0 | 97.0 | 3.0 | 0.0 | 0.0 | 0.0 | 20.0 |
| P45 | 4.7 | 3.7 | 77.0 | 23.0 | 100.0 | 0.0 | 0.0 | 0.0 | 0.0 | 12.0 |
| P46 | 4.7 | 3.7 | 75.0 | 22.0 | 97.0 | 3.0 | 0.0 | 0.0 | 0.0 | 20.0 |
| P47 | 5.1 | 4.1 | 78.0 | 1.5 | 79.5 | 0.5 | 20.0 | 0.0 | 20.0 | 12.0 |
| P48 | 4.7 | 3.7 | 21.5 | 2.0 | 23.5 | 71.0 | 0.0 | 5.5 | 5.5 | 12.0 |
| P49 | 5.1 | 4.1 | 78.0 | 1.5 | 79.5 | 0.5 | 20.0 | 0.0 | 20.0 | 12.0 |
| P50 | 4.7 | 3.7 | 21.5 | 2.0 | 23.5 | 71.0 | 0.0 | 5.5 | 5.5 | 12.0 |
| P51 | 5.1 | 4.1 | 78.0 | 1.5 | 79.5 | 0.5 | 20.0 | 0.0 | 20.0 | 12.0 |
| P52 | 4.7 | 3.7 | 21.5 | 2.0 | 23.5 | 71.0 | 0.0 | 5.5 | 5.5 | 12.0 |
| P53 | 4.7 | 3.7 | 21.5 | 2.0 | 23.5 | 71.0 | 0.0 | 5.5 | 5.5 | 12.0 |
| P54 | 5.1 | 4.1 | 78.0 | 1.5 | 79.5 | 0.5 | 20.0 | 0.0 | 20.0 | 12.0 |
| P55 | 4.7 | 3.7 | 75.0 | 22.0 | 97.0 | 3.0 | 0.0 | 0.0 | 0.0 | 12.0 |
| P56 | 5.1 | 4.1 | 75.0 | 22.0 | 97.0 | 3.0 | 0.0 | 0.0 | 0.0 | 22.0 |
| P57 | 5.1 | 4.1 | 75.0 | 22.0 | 97.0 | 3.0 | 0.0 | 0.0 | 0.0 | 22.0 |
| P58 | 5.1 | 4.1 | 75.0 | 22.0 | 97.0 | 3.0 | 0.0 | 0.0 | 0.0 | 22.0 |
| P59 | 5.1 | 4.1 | 75.0 | 22.0 | 97.0 | 3.0 | 0.0 | 0.0 | 0.0 | 16.0 |
| P60 | 5.1 | 4.1 | 75.0 | 22.0 | 97.0 | 3.0 | 0.0 | 0.0 | 0.0 | 18.0 |
| P61 | 4.0 | 3.0 | 75.0 | 22.0 | 97.0 | 3.0 | 0.0 | 0.0 | 0.0 | 22.0 |
| P62 | 4.0 | 3.0 | 75.0 | 22.0 | 97.0 | 3.0 | 0.0 | 0.0 | 0.0 | 22.0 |
| P63 | 5.1 | 4.1 | 75.0 | 22.0 | 97.0 | 3.0 | 0.0 | 0.0 | 0.0 | 16.0 |
| P64 | 4.0 | 3.0 | 75.0 | 22.0 | 97.0 | 3.0 | 0.0 | 0.0 | 0.0 | 22.0 |
| P65 | 5.1 | 4.1 | 75.0 | 22.0 | 97.0 | 3.0 | 0.0 | 0.0 | 0.0 | 16.0 |
| P66 | 5.1 | 4.1 | 75.0 | 22.0 | 97.0 | 3.0 | 0.0 | 0.0 | 0.0 | 22.0 |
| P67 | 5.1 | 4.1 | 75.0 | 22.0 | 97.0 | 3.0 | 0.0 | 0.0 | 0.0 | 16.0 |
| P68 | 4.0 | 3.0 | 77.0 | 23.0 | 100.0 | 0.0 | 0.0 | 0.0 | 0.0 | 14.0 |
| P69 | 4.0 | 3.0 | 75.0 | 22.0 | 97.0 | 3.0 | 0.0 | 0.0 | 0.0 | 22.0 |
| P70 | 4.0 | 3.0 | 77.0 | 23.0 | 100.0 | 0.0 | 0.0 | 0.0 | 0.0 | 14.0 |
| P71 | 4.0 | 3.0 | 75.0 | 22.0 | 97.0 | 3.0 | 0.0 | 0.0 | 0.0 | 22.0 |
| P72 | 5.1 | 4.1 | 78.0 | 1.5 | 79.5 | 0.5 | 20.0 | 0.0 | 20.0 | 14.0 |
| P73 | 4.0 | 3.0 | 21.5 | 2.0 | 23.5 | 71.0 | 0.0 | 5.5 | 5.5 | 14.0 |
| P74 | 5.1 | 4.1 | 78.0 | 1.5 | 79.5 | 0.5 | 20.0 | 0.0 | 20.0 | 14.0 |
| P75 | 4.0 | 3.0 | 21.5 | 2.0 | 23.5 | 71.0 | 0.0 | 5.5 | 5.5 | 14.0 |
| P76 | 5.1 | 4.1 | 78.0 | 1.5 | 79.5 | 0.5 | 20.0 | 0.0 | 20.0 | 14.0 |
| P77 | 4.0 | 3.0 | 21.5 | 2.0 | 23.5 | 71.0 | 0.0 | 5.5 | 5.5 | 14.0 |
| P78 | 4.0 | 3.0 | 21.5 | 2.0 | 23.5 | 71.0 | 0.0 | 5.5 | 5.5 | 14.0 |
| P79 | 5.1 | 4.1 | 78.0 | 1.5 | 79.5 | 0.5 | 20.0 | 0.0 | 20.0 | 14.0 |
| P80 | 4.0 | 3.0 | 75.0 | 22.0 | 97.0 | 3.0 | 0.0 | 0.0 | 0.0 | 14.0 |
| P81 | 4.7 | 3.7 | 76.5 | 23.3 | 99.8 | 0.2 | 0.0 | 0.0 | 0.0 | 12.0 |
| P82 | 4.7 | 3.7 | 75.0 | 22.0 | 97.0 | 3.0 | 0.0 | 0.0 | 0.0 | 12.0 |
| P83 | 4.7 | 3.7 | 75.0 | 22.0 | 97.0 | 3.0 | 0.0 | 0.0 | 0.0 | 12.0 |
| P84 | 4.7 | 3.7 | 75.0 | 22.0 | 97.0 | 3.0 | 0.0 | 0.0 | 0.0 | 12.0 |

TABLE 18-continued

| | | | | | | | | | | |
|---|---|---|---|---|---|---|---|---|---|---|
| P85 | 4.7 | 3.7 | 75.0 | 22.0 | 97.0 | 3.0 | 0.0 | 0.0 | 0.0 | 12.0 |
| P86 | 4.7 | 3.7 | 75.0 | 22.0 | 97.0 | 3.0 | 0.0 | 0.0 | 0.0 | 12.0 |

| | SIZE OF METALLOGRAPHIC STRUCTURE | | | |
|---|---|---|---|---|
| PRODUCTION No. | VOLUME AVERAGE DIAMETER/ μm | dia/ μm | dis/ μm | AREA FRACTION WHERE La/Lb ≤5.0 IS SATISFIED/% |
| P44 | 40.0 | 15.0 | 35.0 | 50.0 |
| P45 | 29.5 | — | — | — |
| P46 | 40.0 | 15.0 | 35.0 | 50.0 |
| P47 | 29.5 | 7.5 | 27.0 | 51.0 |
| P48 | 29.5 | 15.0 | 27.0 | 51.0 |
| P49 | 29.5 | 7.5 | 27.0 | 51.0 |
| P50 | 29.5 | 15.0 | 27.0 | 51.0 |
| P51 | 29.5 | 7.5 | 27.0 | 51.0 |
| P52 | 29.5 | 15.0 | 27.0 | 51.0 |
| P53 | 29.5 | 15.0 | 27.0 | 51.0 |
| P54 | 29.5 | 7.5 | 27.0 | 51.0 |
| P55 | 29.5 | 7.5 | 27.0 | 51.0 |
| P56 | 41.5 | 15.5 | 35.5 | 50.0 |
| P57 | 41.5 | 15.5 | 35.5 | 50.0 |
| P58 | 43.5 | 15.5 | 35.5 | 45.0 |
| P59 | 31.0 | 10.5 | 30.5 | 45.0 |
| P60 | 34.0 | 10.5 | 30.5 | 51.0 |
| P61 | 41.5 | 15.5 | 35.5 | 50.0 |
| P62 | 41.5 | 15.5 | 35.5 | 50.0 |
| P63 | 31.0 | 10.5 | 30.5 | 50.0 |
| P64 | 41.5 | 15.5 | 35.5 | 50.0 |
| P65 | 31.0 | 10.5 | 30.5 | 45.0 |
| P66 | 41.5 | 15.5 | 35.5 | 50.0 |
| P67 | 31.0 | 10.5 | 30.5 | 45.0 |
| P68 | 31.0 | — | — | — |
| P69 | 41.5 | 15.5 | 35.5 | 50.0 |
| P70 | 31.0 | — | — | — |
| P71 | 41.5 | 15.5 | 35.5 | 50.0 |
| P72 | 31.0 | 8.0 | 27.5 | 51.0 |
| P73 | 31.0 | 15.5 | 27.5 | 51.0 |
| P74 | 31.0 | 8.0 | 27.5 | 51.0 |
| P75 | 31.0 | 15.5 | 27.5 | 51.0 |
| P76 | 31.0 | 8.0 | 27.5 | 51.0 |
| P77 | 31.0 | 15.5 | 27.5 | 51.0 |
| P78 | 31.0 | 15.5 | 27.5 | 51.0 |
| P79 | 31.0 | 8.0 | 27.5 | 51.0 |
| P80 | 31.0 | 8.0 | 27.5 | 51.0 |
| P81 | 29.5 | 7.5 | 27.0 | 51.0 |
| P82 | 29.5 | 7.5 | 27.0 | 51.0 |
| P83 | 29.5 | 7.5 | 27.0 | 51.0 |
| P84 | 29.5 | 7.5 | 27.0 | 51.0 |
| P85 | 29.5 | 7.5 | 27.0 | 51.0 |
| P86 | 29.5 | 7.5 | 27.0 | 51.0 |

TABLE 19

| PRODUCTION | TEXTURE | | AREA FRACTION OF METALLOGRAPHIC STRUCTURE | | | | | | | |
|---|---|---|---|---|---|---|---|---|---|---|
| No. | D1/— | D2/— | F/% | B/% | F + B/% | fM/% | P/% | γ/% | PHASE WITH EXCEPTION OF F, B, AND M/% | AREA FRACTION OF COARSE GRAINS/% |
| P87 | 4.7 | 3.7 | 75.0 | 22.0 | 97.0 | 3.0 | 0.0 | 0.0 | 0.0 | 12.0 |
| P88 | 4.7 | 3.7 | 75.0 | 22.0 | 97.0 | 3.0 | 0.0 | 0.0 | 0.0 | 12.0 |
| P89 | Cracks occur during Hot rolling | | | | | | | | | |
| P90 | 4.7 | 3.7 | 75.0 | 22.0 | 97.0 | 3.0 | 0.0 | 0.0 | 0.0 | 12.0 |
| P91 | 4.7 | 3.7 | 75.0 | 22.0 | 97.0 | 3.0 | 0.0 | 0.0 | 0.0 | 12.0 |
| P92 | 4.7 | 3.7 | 75.0 | 22.0 | 97.0 | 3.0 | 0.0 | 0.0 | 0.0 | 12.0 |
| P93 | 4.7 | 3.7 | 75.0 | 22.0 | 97.0 | 3.0 | 0.0 | 0.0 | 0.0 | 12.0 |
| P94 | 4.7 | 3.7 | 75.0 | 22.0 | 97.0 | 3.0 | 0.0 | 0.0 | 0.0 | 12.0 |
| P95 | 4.7 | 3.7 | 75.0 | 22.0 | 97.0 | 3.0 | 0.0 | 0.0 | 0.0 | 12.0 |
| P96 | 4.7 | 3.7 | 75.0 | 22.0 | 97.0 | 3.0 | 0.0 | 0.0 | 0.0 | 12.0 |
| P97 | 5.8 | 4.8 | 75.0 | 22.0 | 97.0 | 3.0 | 0.0 | 0.0 | 0.0 | 12.0 |
| P98 | 5.8 | 4.8 | 75.0 | 22.0 | 97.0 | 3.0 | 0.0 | 0.0 | 0.0 | 12.0 |

TABLE 19-continued

| | | | | | | | | | | |
|---|---|---|---|---|---|---|---|---|---|---|
| P99 | 5.8 | 4.8 | 75.0 | 22.0 | 97.0 | 3.0 | 0.0 | 0.0 | 0.0 | 12.0 |
| P100 | 4.7 | 3.7 | 75.0 | 22.0 | 97.0 | 3.0 | 0.0 | 0.0 | 0.0 | 12.0 |
| P101 | 4.7 | 3.7 | 75.0 | 22.0 | 97.0 | 3.0 | 0.0 | 0.0 | 0.0 | 12.0 |
| P102 | 4.7 | 3.7 | 75.0 | 22.0 | 97.0 | 3.0 | 0.0 | 0.0 | 0.0 | 12.0 |
| P103 | 4.7 | 3.7 | 75.0 | 22.0 | 97.0 | 3.0 | 0.0 | 0.0 | 0.0 | 12.0 |
| P104 | 4.7 | 3.7 | 75.0 | 22.0 | 97.0 | 3.0 | 0.0 | 0.0 | 0.0 | 12.0 |
| P105 | 4.7 | 3.7 | 75.0 | 22.0 | 97.0 | 3.0 | 0.0 | 0.0 | 0.0 | 12.0 |
| P106 | 4.7 | 3.7 | 75.0 | 22.0 | 97.0 | 3.0 | 0.0 | 0.0 | 0.0 | 12.0 |
| P107 | 4.7 | 3.7 | 75.0 | 22.0 | 97.0 | 3.0 | 0.0 | 0.0 | 0.0 | 12.0 |
| P108 | Cracks occur during Hot rolling | | | | | | | | | |
| P109 | Cracks occur during Hot rolling | | | | | | | | | |
| P110 | 4.7 | 3.7 | 75.0 | 22.0 | 97.0 | 3.0 | 0.0 | 0.0 | 0.0 | 12.0 |
| P111 | 4.7 | 3.7 | 75.0 | 22.0 | 97.0 | 3.0 | 0.0 | 0.0 | 0.0 | 12.0 |
| P112 | 4.0 | 3.0 | 75.0 | 22.0 | 97.0 | 3.0 | 0.0 | 0.0 | 0.0 | 14.0 |
| P113 | 4.0 | 3.0 | 75.0 | 22.0 | 97.0 | 3.0 | 0.0 | 0.0 | 0.0 | 14.0 |
| P114 | 4.0 | 3.0 | 75.0 | 22.0 | 97.0 | 3.0 | 0.0 | 0.0 | 0.0 | 14.0 |
| P115 | 4.0 | 3.0 | 75.0 | 22.0 | 97.0 | 3.0 | 0.0 | 0.0 | 0.0 | 14.0 |
| P116 | 4.0 | 3.0 | 75.0 | 22.0 | 97.0 | 3.0 | 0.0 | 0.0 | 0.0 | 14.0 |
| P117 | 4.0 | 3.0 | 75.0 | 22.0 | 97.0 | 3.0 | 0.0 | 0.0 | 0.0 | 14.0 |
| P118 | 4.0 | 3.0 | 75.0 | 22.0 | 97.0 | 3.0 | 0.0 | 0.0 | 0.0 | 14.0 |
| P119 | 4.0 | 3.0 | 75.0 | 22.0 | 97.0 | 3.0 | 0.0 | 0.0 | 0.0 | 14.0 |
| P120 | 4.0 | 3.0 | 75.0 | 22.0 | 97.0 | 3.0 | 0.0 | 0.0 | 0.0 | 14.0 |
| P121 | 4.0 | 3.0 | 75.0 | 22.0 | 97.0 | 3.0 | 0.0 | 0.0 | 0.0 | 14.0 |
| P122 | 4.0 | 3.0 | 75.0 | 22.0 | 97.0 | 3.0 | 0.0 | 0.0 | 0.0 | 14.0 |
| P123 | 4.0 | 3.0 | 75.0 | 22.0 | 97.0 | 3.0 | 0.0 | 0.0 | 0.0 | 14.0 |
| P124 | 4.0 | 3.0 | 75.0 | 22.0 | 97.0 | 3.0 | 0.0 | 0.0 | 0.0 | 14.0 |
| P125 | 4.0 | 3.0 | 75.0 | 22.0 | 97.0 | 3.0 | 0.0 | 0.0 | 0.0 | 14.0 |
| P126 | 4.0 | 3.0 | 75.0 | 22.0 | 97.0 | 3.0 | 0.0 | 0.0 | 0.0 | 14.0 |
| P127 | 4.0 | 3.0 | 75.0 | 22.0 | 97.0 | 3.0 | 0.0 | 0.0 | 0.0 | 14.0 |
| P128 | 4.0 | 3.0 | 75.0 | 22.0 | 97.0 | 3.0 | 0.0 | 0.0 | 0.0 | 14.0 |
| P129 | 4.0 | 3.0 | 75.0 | 22.0 | 97.0 | 3.0 | 0.0 | 0.0 | 0.0 | 14.0 |

| | SIZE OF METALLOGRAPHIC STRUCTURE | | | |
|---|---|---|---|---|
| PRODUCTION No. | VOLUME AVERAGE DIAMETER/ μm | dia/ μm | dis/ μm | AREA FRACTION WHERE La/Lb ≤5.0 IS SATISFIED/% |
| P87 | 29.5 | 7.5 | 27.0 | 51.0 |
| P88 | 29.5 | 7.5 | 27.0 | 51.0 |
| P89 | Cracks occur during Hot rolling | | | |
| P90 | 29.5 | 7.5 | 27.0 | 51.0 |
| P91 | 29.5 | 7.5 | 27.0 | 51.0 |
| P92 | 29.5 | 7.5 | 27.0 | 51.0 |
| P93 | 29.5 | 7.5 | 27.0 | 51.0 |
| P94 | 29.5 | 7.5 | 27.0 | 51.0 |
| P95 | 29.5 | 7.5 | 27.0 | 51.0 |
| P96 | 29.5 | 7.5 | 27.0 | 51.0 |
| P97 | 29.5 | 7.5 | 27.0 | 51.0 |
| P98 | 29.5 | 7.5 | 27.0 | 51.0 |
| P99 | 29.5 | 7.5 | 27.0 | 51.0 |
| P100 | 29.5 | 7.5 | 27.0 | 51.0 |
| P101 | 29.5 | 7.5 | 27.0 | 51.0 |
| P102 | 29.5 | 7.5 | 27.0 | 51.0 |
| P103 | 29.5 | 7.5 | 27.0 | 51.0 |
| P104 | 29.5 | 7.5 | 27.0 | 51.0 |
| P105 | 29.5 | 7.5 | 27.0 | 51.0 |
| P106 | 29.5 | 7.5 | 27.0 | 51.0 |
| P107 | 29.5 | 7.5 | 27.0 | 51.0 |
| P108 | Cracks occur during Hot rolling | | | |
| P109 | Cracks occur during Hot rolling | | | |
| P110 | 29.5 | 7.5 | 27.0 | 51.0 |
| P111 | 29.5 | 7.5 | 27.0 | 51.0 |
| P112 | 31.0 | 8.0 | 27.5 | 51.0 |
| P113 | 31.0 | 8.0 | 27.5 | 51.0 |
| P114 | 31.0 | 8.0 | 27.5 | 51.0 |
| P115 | 31.0 | 8.0 | 27.5 | 51.0 |
| P116 | 31.0 | 8.0 | 27.5 | 51.0 |
| P117 | 31.0 | 8.0 | 27.5 | 51.0 |
| P118 | 31.0 | 8.0 | 27.5 | 51.0 |
| P119 | 31.0 | 8.0 | 27.5 | 51.0 |
| P120 | 31.0 | 8.0 | 27.5 | 51.0 |
| P121 | 31.0 | 8.0 | 27.5 | 51.0 |
| P122 | 31.0 | 8.0 | 27.5 | 51.0 |
| P123 | 31.0 | 8.0 | 27.5 | 51.0 |
| P124 | 31.0 | 8.0 | 27.5 | 51.0 |
| P125 | 31.0 | 8.0 | 27.5 | 51.0 |
| P126 | 31.0 | 8.0 | 27.5 | 51.0 |

TABLE 19-continued

| | | | | |
|---|---|---|---|---|
| P127 | 31.0 | 8.0 | 27.5 | 51.0 |
| P128 | 31.0 | 8.0 | 27.5 | 51.0 |
| P129 | 31.0 | 8.0 | 27.5 | 51.0 |

TABLE 20

| PRODUCTION | TEXTURE | | AREA FRACTION OF METALLOGRAPHIC STRUCTURE | | | | | | | |
|---|---|---|---|---|---|---|---|---|---|---|
| No. | D1/— | D2/— | F/% | B/% | F + B/% | fM/% | P/% | γ/% | PHASE WITH EXCEPTION OF F, B, AND M/% | AREA FRACTION OF COARSE GRAINS/% |
| P130 | 4.0 | 3.0 | 75.0 | 22.0 | 97.0 | 3.0 | 0.0 | 0.0 | 0.0 | 14.0 |
| P131 | 4.0 | 3.0 | 75.0 | 22.0 | 97.0 | 3.0 | 0.0 | 0.0 | 0.0 | 14.0 |
| P132 | 4.0 | 3.0 | 75.0 | 22.0 | 97.0 | 3.0 | 0.0 | 0.0 | 0.0 | 14.0 |
| P133 | 4.0 | 3.0 | 75.0 | 22.0 | 97.0 | 3.0 | 0.0 | 0.0 | 0.0 | 14.0 |
| P134 | 4.0 | 3.0 | 75.0 | 22.0 | 97.0 | 3.0 | 0.0 | 0.0 | 0.0 | 14.0 |
| P135 | 4.0 | 3.0 | 75.0 | 22.0 | 97.0 | 3.0 | 0.0 | 0.0 | 0.0 | 14.0 |
| P136 | 4.0 | 3.0 | 75.0 | 22.0 | 97.0 | 3.0 | 0.0 | 0.0 | 0.0 | 14.0 |
| P137 | 4.0 | 3.0 | 75.0 | 22.0 | 97.0 | 3.0 | 0.0 | 0.0 | 0.0 | 14.0 |
| P138 | 4.0 | 3.0 | 75.0 | 22.0 | 97.0 | 3.0 | 0.0 | 0.0 | 0.0 | 14.0 |
| P139 | 4.0 | 3.0 | 75.0 | 22.0 | 97.0 | 3.0 | 0.0 | 0.0 | 0.0 | 14.0 |
| P140 | 4.0 | 3.0 | 75.0 | 22.0 | 97.0 | 3.0 | 0.0 | 0.0 | 0.0 | 14.0 |
| P141 | 4.0 | 3.0 | 75.0 | 22.0 | 97.0 | 3.0 | 0.0 | 0.0 | 0.0 | 14.0 |
| P142 | 4.0 | 3.0 | 75.0 | 22.0 | 97.0 | 3.0 | 0.0 | 0.0 | 0.0 | 14.0 |
| P143 | 4.0 | 3.0 | 75.0 | 22.0 | 97.0 | 3.0 | 0.0 | 0.0 | 0.0 | 14.0 |
| P144 | 4.0 | 3.0 | 75.0 | 22.0 | 97.0 | 3.0 | 0.0 | 0.0 | 0.0 | 14.0 |
| P145 | 4.0 | 3.0 | 75.0 | 22.0 | 97.0 | 3.0 | 0.0 | 0.0 | 0.0 | 14.0 |
| P146 | 4.0 | 3.0 | 75.0 | 22.0 | 97.0 | 3.0 | 0.0 | 0.0 | 0.0 | 14.0 |
| P147 | 4.0 | 3.0 | 75.0 | 22.0 | 97.0 | 3.0 | 0.0 | 0.0 | 0.0 | 14.0 |
| P148 | 4.0 | 3.0 | 75.0 | 22.0 | 97.0 | 3.0 | 0.0 | 0.0 | 0.0 | 14.0 |
| P149 | 4.0 | 3.0 | 75.0 | 22.0 | 97.0 | 3.0 | 0.0 | 0.0 | 0.0 | 14.0 |
| P150 | 4.0 | 3.0 | 75.0 | 22.0 | 97.0 | 3.0 | 0.0 | 0.0 | 0.0 | 14.0 |
| P151 | 4.0 | 3.0 | 75.0 | 22.0 | 97.0 | 3.0 | 0.0 | 0.0 | 0.0 | 14.0 |
| P152 | 4.0 | 3.0 | 75.0 | 22.0 | 97.0 | 3.0 | 0.0 | 0.0 | 0.0 | 14.0 |
| P153 | 4.0 | 3.0 | 75.0 | 22.0 | 97.0 | 3.0 | 0.0 | 0.0 | 0.0 | 14.0 |
| P154 | 4.0 | 3.0 | 75.0 | 22.0 | 97.0 | 3.0 | 0.0 | 0.0 | 0.0 | 14.0 |
| P155 | 4.0 | 3.0 | 75.0 | 22.0 | 97.0 | 3.0 | 0.0 | 0.0 | 0.0 | 14.0 |
| P156 | 4.0 | 3.0 | 75.0 | 22.0 | 97.0 | 3.0 | 0.0 | 0.0 | 0.0 | 14.0 |
| P157 | 4.0 | 3.0 | 75.0 | 22.0 | 97.0 | 3.0 | 0.0 | 0.0 | 0.0 | 14.0 |
| P158 | 4.0 | 3.0 | 75.0 | 22.0 | 97.0 | 3.0 | 0.0 | 0.0 | 0.0 | 14.0 |
| P159 | 4.0 | 3.0 | 75.0 | 22.0 | 97.0 | 3.0 | 0.0 | 0.0 | 0.0 | 14.0 |
| P160 | 4.0 | 3.0 | 75.0 | 22.0 | 97.0 | 3.0 | 0.0 | 0.0 | 0.0 | 14.0 |
| P161 | 4.0 | 3.0 | 75.0 | 22.0 | 97.0 | 3.0 | 0.0 | 0.0 | 0.0 | 14.0 |
| P162 | 4.0 | 3.0 | 75.0 | 22.0 | 97.0 | 3.0 | 0.0 | 0.0 | 0.0 | 14.0 |
| P163 | 4.0 | 3.0 | 75.0 | 22.0 | 97.0 | 3.0 | 0.0 | 0.0 | 0.0 | 14.0 |
| P164 | 4.0 | 3.0 | 75.0 | 22.0 | 97.0 | 3.0 | 0.0 | 0.0 | 0.0 | 14.0 |
| P165 | 4.0 | 3.0 | 75.0 | 22.0 | 97.0 | 3.0 | 0.0 | 0.0 | 0.0 | 14.0 |
| P166 | 4.0 | 3.0 | 75.0 | 22.0 | 97.0 | 3.0 | 0.0 | 0.0 | 0.0 | 14.0 |
| P167 | 4.0 | 3.0 | 75.0 | 22.0 | 97.0 | 3.0 | 0.0 | 0.0 | 0.0 | 14.0 |
| P168 | 4.0 | 3.0 | 75.0 | 22.0 | 97.0 | 3.0 | 0.0 | 0.0 | 0.0 | 14.0 |
| P169 | 4.0 | 3.0 | 75.0 | 22.0 | 97.0 | 3.0 | 0.0 | 0.0 | 0.0 | 14.0 |
| P170 | 4.0 | 3.0 | 75.0 | 22.0 | 97.0 | 3.0 | 0.0 | 0.0 | 0.0 | 14.0 |
| P171 | 4.0 | 3.0 | 75.0 | 22.0 | 97.0 | 3.0 | 0.0 | 0.0 | 0.0 | 14.0 |
| P172 | 4.0 | 3.0 | 75.0 | 22.0 | 97.0 | 3.0 | 0.0 | 0.0 | 0.0 | 14.0 |

| PRODUCTION No. | SIZE OF METALLOGRAPHIC STRUCTURE | | | |
|---|---|---|---|---|
| | VOLUME AVERAGE DIAMETER/ μm | dia/ μm | dis/ μm | AREA FRACTION WHERE La/Lb ≤5.0 IS SATISFIED/% |
| P130 | 31.0 | 8.0 | 27.5 | 51.0 |
| P131 | 31.0 | 8.0 | 27.5 | 51.0 |
| P132 | 31.0 | 8.0 | 27.5 | 51.0 |
| P133 | 31.0 | 8.0 | 27.5 | 51.0 |
| P134 | 31.0 | 8.0 | 27.5 | 51.0 |
| P135 | 31.0 | 8.0 | 27.5 | 51.0 |
| P136 | 31.0 | 8.0 | 27.5 | 51.0 |
| P137 | 31.0 | 8.0 | 27.5 | 51.0 |
| P138 | 31.0 | 8.0 | 27.5 | 51.0 |
| P139 | 31.0 | 8.0 | 27.5 | 51.0 |
| P140 | 31.0 | 8.0 | 27.5 | 51.0 |

TABLE 20-continued

| | | | | |
|---|---|---|---|---|
| P141 | 31.0 | 8.0 | 27.5 | 51.0 |
| P142 | 31.0 | 8.0 | 27.5 | 51.0 |
| P143 | 31.0 | 8.0 | 27.5 | 51.0 |
| P144 | 31.0 | 8.0 | 27.5 | 51.0 |
| P145 | 31.0 | 8.0 | 27.5 | 51.0 |
| P146 | 31.0 | 8.0 | 27.5 | 51.0 |
| P147 | 31.0 | 8.0 | 27.5 | 51.0 |
| P148 | 31.0 | 8.0 | 27.5 | 51.0 |
| P149 | 31.0 | 8.0 | 27.5 | 51.0 |
| P150 | 31.0 | 8.0 | 27.5 | 51.0 |
| P151 | 31.0 | 8.0 | 27.5 | 51.0 |
| P152 | 31.0 | 8.0 | 27.5 | 51.0 |
| P153 | 31.0 | 8.0 | 27.5 | 51.0 |
| P154 | 31.0 | 8.0 | 27.5 | 51.0 |
| P155 | 31.0 | 8.0 | 27.5 | 51.0 |
| P156 | 31.0 | 8.0 | 27.5 | 51.0 |
| P157 | 31.0 | 8.0 | 27.5 | 51.0 |
| P158 | 31.0 | 8.0 | 27.5 | 51.0 |
| P159 | 31.0 | 8.0 | 27.5 | 51.0 |
| P160 | 31.0 | 8.0 | 27.5 | 51.0 |
| P161 | 31.0 | 8.0 | 27.5 | 51.0 |
| P162 | 31.0 | 8.0 | 27.5 | 51.0 |
| P163 | 31.0 | 8.0 | 27.5 | 51.0 |
| P164 | 31.0 | 8.0 | 27.5 | 51.0 |
| P165 | 31.0 | 8.0 | 27.5 | 51.0 |
| P166 | 31.0 | 8.0 | 27.5 | 51.0 |
| P167 | 31.0 | 8.0 | 27.5 | 51.0 |
| P168 | 31.0 | 8.0 | 27.5 | 51.0 |
| P169 | 31.0 | 8.0 | 27.5 | 51.0 |
| P170 | 31.0 | 8.0 | 27.5 | 51.0 |
| P171 | 31.0 | 8.0 | 27.5 | 51.0 |
| P172 | 31.0 | 8.0 | 27.5 | 51.0 |

TABLE 21

| PRODUCTION | TEXTURE | | AREA FRACTION OF METALLOGRAPHIC STRUCTURE | | | | | | | |
|---|---|---|---|---|---|---|---|---|---|---|
| No. | D1/— | D2/— | F/% | B/% | F + B/% | fM/% | P/% | γ/% | PHASE WITH EXCEPTION OF F, B, AND M/% | AREA FRACTION OF COARSE GRAINS/% |
| P173 | 4.0 | 3.0 | 75.0 | 22.0 | 97.0 | 3.0 | 0.0 | 0.0 | 0.0 | 14.0 |
| P174 | 4.0 | 3.0 | 75.0 | 22.0 | 97.0 | 3.0 | 0.0 | 0.0 | 0.0 | 14.0 |
| P175 | 4.0 | 3.0 | 75.0 | 22.0 | 97.0 | 3.0 | 0.0 | 0.0 | 0.0 | 14.0 |
| P176 | 4.0 | 3.0 | 75.0 | 22.0 | 97.0 | 3.0 | 0.0 | 0.0 | 0.0 | 14.0 |
| P177 | 4.0 | 3.0 | 75.0 | 22.0 | 97.0 | 3.0 | 0.0 | 0.0 | 0.0 | 14.0 |
| P178 | 4.0 | 3.0 | 75.0 | 22.0 | 97.0 | 3.0 | 0.0 | 0.0 | 0.0 | 14.0 |
| P179 | 4.0 | 3.0 | 75.0 | 22.0 | 97.0 | 3.0 | 0.0 | 0.0 | 0.0 | 14.0 |
| P180 | 4.0 | 3.0 | 75.0 | 22.0 | 97.0 | 3.0 | 0.0 | 0.0 | 0.0 | 14.0 |
| P181 | 4.0 | 3.0 | 75.0 | 22.0 | 97.0 | 3.0 | 0.0 | 0.0 | 0.0 | 14.0 |
| P182 | 4.0 | 3.0 | 75.0 | 22.0 | 97.0 | 3.0 | 0.0 | 0.0 | 0.0 | 14.0 |
| P183 | 4.0 | 3.0 | 75.0 | 22.0 | 97.0 | 3.0 | 0.0 | 0.0 | 0.0 | 14.0 |
| P184 | 4.0 | 3.0 | 75.0 | 22.0 | 97.0 | 3.0 | 0.0 | 0.0 | 0.0 | 14.0 |
| P185 | 4.0 | 3.0 | 75.0 | 22.0 | 97.0 | 3.0 | 0.0 | 0.0 | 0.0 | 14.0 |
| P186 | 4.0 | 3.0 | 75.0 | 22.0 | 97.0 | 3.0 | 0.0 | 0.0 | 0.0 | 14.0 |
| P187 | 4.0 | 3.0 | 75.0 | 22.0 | 97.0 | 3.0 | 0.0 | 0.0 | 0.0 | 14.0 |
| P188 | 4.0 | 3.0 | 75.0 | 22.0 | 97.0 | 3.0 | 0.0 | 0.0 | 0.0 | 14.0 |
| P189 | 4.0 | 3.0 | 75.0 | 22.0 | 97.0 | 3.0 | 0.0 | 0.0 | 0.0 | 14.0 |
| P190 | 4.0 | 3.0 | 75.0 | 22.0 | 97.0 | 3.0 | 0.0 | 0.0 | 0.0 | 14.0 |
| P191 | 4.0 | 3.0 | 75.0 | 22.0 | 97.0 | 3.0 | 0.0 | 0.0 | 0.0 | 14.0 |
| P192 | 4.0 | 3.0 | 75.0 | 22.0 | 97.0 | 3.0 | 0.0 | 0.0 | 0.0 | 14.0 |
| P193 | 4.0 | 3.0 | 75.0 | 22.0 | 97.0 | 3.0 | 0.0 | 0.0 | 0.0 | 14.0 |
| P194 | 4.0 | 3.0 | 75.0 | 22.0 | 97.0 | 3.0 | 0.0 | 0.0 | 0.0 | 14.0 |
| P195 | 4.0 | 3.0 | 75.0 | 22.0 | 97.0 | 3.0 | 0.0 | 0.0 | 0.0 | 14.0 |
| P196 | 4.0 | 3.0 | 75.0 | 22.0 | 97.0 | 3.0 | 0.0 | 0.0 | 0.0 | 14.0 |
| P197 | 4.0 | 3.0 | 75.0 | 22.0 | 97.0 | 3.0 | 0.0 | 0.0 | 0.0 | 14.0 |
| P198 | 4.0 | 3.0 | 75.0 | 22.0 | 97.0 | 3.0 | 0.0 | 0.0 | 0.0 | 14.0 |
| P199 | 4.0 | 3.0 | 75.0 | 22.0 | 97.0 | 3.0 | 0.0 | 0.0 | 0.0 | 14.0 |
| P200 | 4.0 | 3.0 | 75.0 | 22.0 | 97.0 | 3.0 | 0.0 | 0.0 | 0.0 | 14.0 |
| P201 | 4.0 | 3.0 | 75.0 | 22.0 | 97.0 | 3.0 | 0.0 | 0.0 | 0.0 | 14.0 |
| P202 | 4.0 | 3.0 | 75.0 | 22.0 | 97.0 | 3.0 | 0.0 | 0.0 | 0.0 | 14.0 |
| P203 | 4.0 | 3.0 | 75.0 | 22.0 | 97.0 | 3.0 | 0.0 | 0.0 | 0.0 | 14.0 |
| P204 | 4.0 | 3.0 | 75.0 | 22.0 | 97.0 | 3.0 | 0.0 | 0.0 | 0.0 | 14.0 |
| P205 | 4.0 | 3.0 | 75.0 | 22.0 | 97.0 | 3.0 | 0.0 | 0.0 | 0.0 | 14.0 |
| P206 | 4.0 | 3.0 | 75.0 | 22.0 | 97.0 | 3.0 | 0.0 | 0.0 | 0.0 | 14.0 |

TABLE 21-continued

| | | | | | | | | | | |
|---|---|---|---|---|---|---|---|---|---|---|
| P207 | 4.0 | 3.0 | 75.0 | 22.0 | 97.0 | 3.0 | 0.0 | 0.0 | 0.0 | 14.0 |
| P208 | 4.0 | 3.0 | 75.0 | 22.0 | 97.0 | 3.0 | 0.0 | 0.0 | 0.0 | 14.0 |
| P209 | 4.0 | 3.0 | 75.0 | 22.0 | 97.0 | 3.0 | 0.0 | 0.0 | 0.0 | 14.0 |
| P210 | 4.0 | 3.0 | 75.0 | 22.0 | 97.0 | 3.0 | 0.0 | 0.0 | 0.0 | 14.0 |
| P211 | 4.0 | 3.0 | 75.0 | 22.0 | 97.0 | 3.0 | 0.0 | 0.0 | 0.0 | 14.0 |
| P212 | 4.0 | 3.0 | 75.0 | 22.0 | 97.0 | 3.0 | 0.0 | 0.0 | 0.0 | 14.0 |
| P213 | 4.0 | 3.0 | 75.0 | 22.0 | 97.0 | 3.0 | 0.0 | 0.0 | 0.0 | 14.0 |
| P214 | 4.0 | 3.0 | 75.0 | 22.0 | 97.0 | 3.0 | 0.0 | 0.0 | 0.0 | 14.0 |

| | SIZE OF METALLOGRAPHIC STRUCTURE | | | |
|---|---|---|---|---|
| PRODUCTION No. | VOLUME AVERAGE DIAMETER/ μm | dia/ μm | dis/ μm | AREA FRACTION WHERE La/Lb ≤5.0 IS SATISFIED/% |
| P173 | 31.0 | 8.0 | 27.5 | 51.0 |
| P174 | 31.0 | 8.0 | 27.5 | 51.0 |
| P175 | 31.0 | 8.0 | 27.5 | 51.0 |
| P176 | 31.0 | 8.0 | 27.5 | 51.0 |
| P177 | 31.0 | 8.0 | 27.5 | 51.0 |
| P178 | 31.0 | 8.0 | 27.5 | 51.0 |
| P179 | 31.0 | 8.0 | 27.5 | 51.0 |
| P180 | 31.0 | 8.0 | 27.5 | 51.0 |
| P181 | 31.0 | 8.0 | 27.5 | 51.0 |
| P182 | 31.0 | 8.0 | 27.5 | 51.0 |
| P183 | 31.0 | 8.0 | 27.5 | 51.0 |
| P184 | 31.0 | 8.0 | 27.5 | 51.0 |
| P185 | 31.0 | 8.0 | 27.5 | 51.0 |
| P186 | 31.0 | 8.0 | 27.5 | 51.0 |
| P187 | 31.0 | 8.0 | 27.5 | 51.0 |
| P188 | 31.0 | 8.0 | 27.5 | 51.0 |
| P189 | 31.0 | 8.0 | 27.5 | 51.0 |
| P190 | 31.0 | 8.0 | 27.5 | 51.0 |
| P191 | 31.0 | 8.0 | 27.5 | 51.0 |
| P192 | 31.0 | 8.0 | 27.5 | 51.0 |
| P193 | 31.0 | 8.0 | 27.5 | 51.0 |
| P194 | 31.0 | 8.0 | 27.5 | 51.0 |
| P195 | 31.0 | 8.0 | 27.5 | 51.0 |
| P196 | 31.0 | 8.0 | 27.5 | 51.0 |
| P197 | 31.0 | 8.0 | 27.5 | 51.0 |
| P198 | 31.0 | 8.0 | 27.5 | 51.0 |
| P199 | 31.0 | 8.0 | 27.5 | 51.0 |
| P200 | 31.0 | 8.0 | 27.5 | 51.0 |
| P201 | 31.0 | 8.0 | 27.5 | 51.0 |
| P202 | 31.0 | 8.0 | 27.5 | 51.0 |
| P203 | 31.0 | 8.0 | 27.5 | 51.0 |
| P204 | 31.0 | 8.0 | 27.5 | 51.0 |
| P205 | 31.0 | 8.0 | 27.5 | 51.0 |
| P206 | 31.0 | 8.0 | 27.5 | 51.0 |
| P207 | 31.0 | 8.0 | 27.5 | 51.0 |
| P208 | 31.0 | 8.0 | 27.5 | 51.0 |
| P209 | 31.0 | 8.0 | 27.5 | 51.0 |
| P210 | 31.0 | 8.0 | 27.5 | 51.0 |
| P211 | 31.0 | 8.0 | 27.5 | 51.0 |
| P212 | 31.0 | 8.0 | 27.5 | 51.0 |
| P213 | 31.0 | 8.0 | 27.5 | 51.0 |
| P214 | 31.0 | 8.0 | 27.5 | 51.0 |

TABLE 22

| PRODUCTION | LANKFORD-VLAUE | | | | |
|---|---|---|---|---|---|
| No. | rL/— | rC/— | r30/— | r60/— | REMARKS |
| P1 | 0.74 | 0.76 | 1.44 | 1.45 | EXAMPLE |
| P2 | 0.76 | 0.78 | 1.42 | 1.43 | EXAMPLE |
| P3 | 0.78 | 0.80 | 1.40 | 1.42 | EXAMPLE |
| P4 | 0.72 | 0.74 | 1.46 | 1.48 | EXAMPLE |
| P5 | 0.84 | 0.85 | 1.35 | 1.36 | EXAMPLE |
| P6 | 0.86 | 0.87 | 1.33 | 1.34 | EXAMPLE |
| P7 | 0.89 | 0.91 | 1.29 | 1.31 | EXAMPLE |
| P8 | 0.78 | 0.80 | 1.40 | 1.42 | EXAMPLE |
| P9 | 0.92 | 0.92 | 1.28 | 1.28 | EXAMPLE |
| P10 | 0.84 | 0.85 | 1.35 | 1.36 | EXAMPLE |
| P11 | 0.86 | 0.87 | 1.33 | 1.34 | EXAMPLE |

TABLE 22-continued

| | | | | | |
|---|---|---|---|---|---|
| P12 | 0.76 | 0.77 | 1.43 | 1.44 | EXAMPLE |
| P13 | 0.92 | 0.92 | 1.28 | 1.28 | EXAMPLE |
| P14 | 0.92 | 0.92 | 1.28 | 1.28 | EXAMPLE |
| P15 | 0.92 | 0.92 | 1.28 | 1.28 | EXAMPLE |
| P16 | 0.90 | 0.92 | 1.28 | 1.29 | EXAMPLE |
| P17 | 0.89 | 0.91 | 1.29 | 1.31 | EXAMPLE |
| P18 | 0.95 | 0.96 | 1.24 | 1.25 | EXAMPLE |
| P19 | 0.98 | 1.00 | 1.20 | 1.22 | EXAMPLE |
| P20 | 1.00 | 1.01 | 1.19 | 1.20 | EXAMPLE |
| P21 | 1.04 | 1.04 | 1.16 | 1.16 | EXAMPLE |
| P22 | 0.92 | 0.94 | 1.26 | 1.28 | EXAMPLE |
| P23 | 1.06 | 1.07 | 1.13 | 1.14 | EXAMPLE |
| P24 | 0.98 | 1.00 | 1.20 | 1.22 | EXAMPLE |
| P25 | 1.00 | 1.01 | 1.19 | 1.20 | EXAMPLE |
| P26 | 0.90 | 0.92 | 1.28 | 1.29 | EXAMPLE |
| P27 | 1.06 | 1.07 | 1.13 | 1.14 | EXAMPLE |
| P28 | 1.06 | 1.07 | 1.13 | 1.14 | EXAMPLE |
| P29 | 1.06 | 1.07 | 1.13 | 1.14 | EXAMPLE |
| P30 | 1.08 | 1.09 | 1.11 | 1.12 | EXAMPLE |
| P31 | 0.52 | 0.56 | 1.66 | 1.69 | COMPARATIVE EXAMPLE |
| P32 | 0.52 | 0.56 | 1.66 | 1.69 | COMPARATIVE EXAMPLE |
| P33 | 0.52 | 0.56 | 1.66 | 1.69 | COMPARATIVE EXAMPLE |
| P34 | 0.52 | 0.56 | 1.66 | 1.69 | COMPARATIVE EXAMPLE |
| P35 | 0.52 | 0.56 | 1.66 | 1.69 | COMPARATIVE EXAMPLE |
| P36 | 0.74 | 0.76 | 1.44 | 1.45 | COMPARATIVE EXAMPLE |
| P37 | 0.74 | 0.76 | 1.44 | 1.45 | COMPARATIVE EXAMPLE |
| P38 | 0.52 | 0.56 | 1.66 | 1.69 | COMPARATIVE EXAMPLE |
| P39 | 0.74 | 0.76 | 1.44 | 1.45 | COMPARATIVE EXAMPLE |
| P40 | 0.52 | 0.56 | 1.66 | 1.69 | COMPARATIVE EXAMPLE |
| P41 | 0.52 | 0.56 | 1.66 | 1.69 | COMPARATIVE EXAMPLE |
| P42 | 0.52 | 0.56 | 1.66 | 1.69 | COMPARATIVE EXAMPLE |
| P43 | 0.74 | 0.76 | 1.44 | 1.45 | COMPARATIVE EXAMPLE |

| | | MECHANICAL PROPERTIES | | | | | | | |
|---|---|---|---|---|---|---|---|---|---|
| PRODUCTION No. | STANDARD DEVIATION RATIO OF HARDNESS/— | TS/ MPa | u-EL/% | EL/% | λ/% | TS × u-EL/ MPa % | TS × EL/ MPa % | TS × λ/ MPa % | REMARKS |
| P1 | 0.23 | 600 | 15 | 29 | 71.0 | 9000 | 17400 | 42600 | EXAMPLE |
| P2 | 0.23 | 610 | 16 | 31 | 73.0 | 9760 | 18910 | 44530 | EXAMPLE |
| P3 | 0.23 | 620 | 17 | 33 | 74.0 | 10540 | 20460 | 45880 | EXAMPLE |
| P4 | 0.23 | 630 | 18 | 34 | 67.0 | 11340 | 21420 | 42210 | EXAMPLE |
| P5 | 0.23 | 625 | 18 | 34 | 79.0 | 11250 | 21250 | 49375 | EXAMPLE |
| P6 | 0.22 | 630 | 19 | 36 | 80.0 | 11970 | 22680 | 50400 | EXAMPLE |
| P7 | 0.21 | 640 | 20 | 37 | 82.0 | 12800 | 23680 | 52480 | EXAMPLE |
| P8 | 0.21 | 620 | 17 | 33 | 74.0 | 10540 | 20460 | 45880 | EXAMPLE |
| P9 | 0.18 | 645 | 21 | 39 | 83.0 | 13545 | 25155 | 53535 | EXAMPLE |
| P10 | 0.21 | 620 | 18 | 34 | 79.0 | 11160 | 21080 | 48980 | EXAMPLE |
| P11 | 0.21 | 640 | 20 | 37 | 81.0 | 12800 | 23680 | 51840 | EXAMPLE |
| P12 | 0.21 | 620 | 17 | 33 | 72.0 | 10540 | 20460 | 44640 | EXAMPLE |
| P13 | 0.18 | 580 | 25 | 45 | 85.0 | 14500 | 26100 | 49300 | EXAMPLE |
| P14 | 0.18 | 900 | 13 | 16 | 75.0 | 11700 | 14400 | 67500 | EXAMPLE |
| P15 | 0.18 | 1220 | 8 | 12 | 35.0 | 9760 | 14640 | 42700 | EXAMPLE |
| P16 | 0.18 | 655 | 23 | 42 | 81.0 | 15065 | 27510 | 53055 | EXAMPLE |
| P17 | 0.23 | 590 | 12 | 26 | 80.0 | 7080 | 15340 | 47200 | EXAMPLE |
| P18 | 0.23 | 560 | 13 | 25 | 81.0 | 7280 | 14000 | 45360 | EXAMPLE |
| P19 | 0.23 | 600 | 14 | 28 | 88.0 | 8400 | 16800 | 52800 | EXAMPLE |
| P20 | 0.22 | 610 | 15 | 29 | 89.0 | 9150 | 17690 | 54290 | EXAMPLE |
| P21 | 0.21 | 620 | 16 | 31 | 91.0 | 9920 | 19220 | 56420 | EXAMPLE |
| P22 | 0.21 | 600 | 13 | 27 | 85.0 | 7800 | 16200 | 51000 | EXAMPLE |
| P23 | 0.18 | 625 | 17 | 33 | 94.0 | 10625 | 20625 | 58750 | EXAMPLE |
| P24 | 0.21 | 600 | 14 | 28 | 88.0 | 8400 | 16800 | 52800 | EXAMPLE |
| P25 | 0.21 | 620 | 16 | 31 | 90.0 | 9920 | 19220 | 55800 | EXAMPLE |
| P26 | 0.21 | 600 | 13 | 27 | 81.0 | 7800 | 16200 | 48600 | EXAMPLE |
| P27 | 0.18 | 560 | 21 | 39 | 94.0 | 11760 | 21840 | 52640 | EXAMPLE |
| P28 | 0.18 | 880 | 14 | 16 | 104.0 | 12320 | 14080 | 91520 | EXAMPLE |
| P29 | 0.18 | 1200 | 8 | 12 | 35.0 | 9600 | 14400 | 42000 | EXAMPLE |
| P30 | 0.18 | 615 | 16 | 31 | 94.5 | 9840 | 19065 | 58118 | EXAMPLE |
| P31 | 0.23 | 460 | 9 | 24 | 55.0 | 4140 | 11040 | 25300 | COMPARATIVE EXAMPLE |
| P32 | 0.24 | 460 | 9 | 24 | 55.0 | 4140 | 11040 | 25300 | COMPARATIVE EXAMPLE |
| P33 | 0.23 | 460 | 9 | 24 | 55.0 | 4140 | 11040 | 25300 | COMPARATIVE EXAMPLE |
| P34 | 0.23 | 470 | 9 | 24 | 55.0 | 4230 | 11280 | 25850 | COMPARATIVE EXAMPLE |
| P35 | 0.23 | 470 | 9 | 24 | 55.0 | 4230 | 11280 | 25850 | COMPARATIVE EXAMPLE |
| P36 | 0.23 | 460 | 9 | 24 | 65.0 | 4140 | 11040 | 29900 | COMPARATIVE EXAMPLE |
| P37 | 0.23 | 460 | 9 | 24 | 65.0 | 4140 | 11040 | 29900 | COMPARATIVE EXAMPLE |
| P38 | 0.23 | 490 | 9 | 24 | 55.0 | 4410 | 11760 | 26950 | COMPARATIVE EXAMPLE |
| P39 | 0.23 | 460 | 9 | 24 | 65.0 | 4140 | 11040 | 29900 | COMPARATIVE EXAMPLE |
| P40 | 0.23 | 470 | 9 | 24 | 55.0 | 4230 | 11280 | 25850 | COMPARATIVE EXAMPLE |

TABLE 22-continued

| | | | | | | | | | |
|---|---|---|---|---|---|---|---|---|---|
| P41 | 0.23 | 460 | 9 | 24 | 55.0 | 4140 | 11040 | 25300 | COMPARATIVE EXAMPLE |
| P42 | 0.23 | 470 | 9 | 24 | 55.0 | 4230 | 11280 | 25850 | COMPARATIVE EXAMPLE |
| P43 | 0.23 | 430 | 7 | 21 | 66.0 | 3010 | 9030 | 28380 | COMPARATIVE EXAMPLE |

| PRODUCTION No. | OTHERS d/RmC/— | Rm45/ RmC/— | TS/fM × dis/dia/— | REMARKS |
|---|---|---|---|---|
| P1 | 1.0 | 1.9 | 720 | EXAMPLE |
| P2 | 1.2 | 1.8 | 770 | EXAMPLE |
| P3 | 1.1 | 1.8 | 827 | EXAMPLE |
| P4 | 1.0 | 2.0 | 974 | EXAMPLE |
| P5 | 1.2 | 1.7 | 896 | EXAMPLE |
| P6 | 1.2 | 1.7 | 974 | EXAMPLE |
| P7 | 1.3 | 1.6 | 1006 | EXAMPLE |
| P8 | 1.1 | 1.8 | 827 | EXAMPLE |
| P9 | 1.3 | 1.6 | 1034 | EXAMPLE |
| P10 | 1.2 | 1.7 | 889 | EXAMPLE |
| P11 | 1.2 | 1.7 | 1000 | EXAMPLE |
| P12 | 1.1 | 1.9 | 827 | EXAMPLE |
| P13 | 1.4 | 1.5 | 1421 | EXAMPLE |
| P14 | 1.6 | 1.3 | 2163 | EXAMPLE |
| P15 | 1.1 | 1.6 | 508 | EXAMPLE |
| P16 | 1.3 | 1.6 | 1263 | EXAMPLE |
| P17 | 1.2 | 1.7 | 676 | EXAMPLE |
| P18 | 1.3 | 1.6 | 615 | EXAMPLE |
| P19 | 1.4 | 1.5 | 809 | EXAMPLE |
| P20 | 1.4 | 1.4 | 881 | EXAMPLE |
| P21 | 1.5 | 1.4 | 909 | EXAMPLE |
| P22 | 1.3 | 1.6 | 757 | EXAMPLE |
| P23 | 1.5 | 1.3 | 932 | EXAMPLE |
| P24 | 1.4 | 1.5 | 809 | EXAMPLE |
| P25 | 1.4 | 1.4 | 904 | EXAMPLE |
| P26 | 1.3 | 1.6 | 757 | EXAMPLE |
| P27 | 1.6 | 1.3 | 1273 | EXAMPLE |
| P28 | 1.8 | 1.0 | 1968 | EXAMPLE |
| P29 | 1.3 | 1.5 | 500 | EXAMPLE |
| P30 | 1.5 | 1.3 | 895 | EXAMPLE |
| P31 | 0.7 | 2.4 | 358 | COMPARATIVE EXAMPLE |
| P32 | 0.7 | 2.4 | 358 | COMPARATIVE EXAMPLE |
| P33 | 0.7 | 2.4 | 358 | COMPARATIVE EXAMPLE |
| P34 | 0.7 | 2.4 | 366 | COMPARATIVE EXAMPLE |
| P35 | 0.7 | 2.4 | 470 | COMPARATIVE EXAMPLE |
| P36 | 1.0 | 2.4 | 358 | COMPARATIVE EXAMPLE |
| P37 | 1.0 | 2.4 | 358 | COMPARATIVE EXAMPLE |
| P38 | 0.7 | 2.4 | 490 | COMPARATIVE EXAMPLE |
| P39 | 1.0 | 2.4 | 358 | COMPARATIVE EXAMPLE |
| P40 | 0.7 | 2.4 | 470 | COMPARATIVE EXAMPLE |
| P41 | 0.7 | 2.4 | 358 | COMPARATIVE EXAMPLE |
| P42 | 0.7 | 2.4 | 470 | COMPARATIVE EXAMPLE |
| P43 | 1.0 | 2.0 | — | COMPARATIVE EXAMPLE |

TABLE 23

| PRODUCTION No. | LANKFORD-VLAUE rL/— | rC/— | r30/— | r60/— | REMARKS |
|---|---|---|---|---|---|
| P44 | 0.74 | 0.76 | 1.44 | 1.45 | COMPARATIVE EXAMPLE |
| P45 | 0.74 | 0.76 | 1.44 | 1.45 | COMPARATIVE EXAMPLE |
| P46 | 0.74 | 0.76 | 1.44 | 1.45 | COMPARATIVE EXAMPLE |
| P47 | 0.68 | 0.66 | 1.52 | 1.54 | COMPARATIVE EXAMPLE |
| P48 | 0.74 | 0.76 | 1.44 | 1.45 | COMPARATIVE EXAMPLE |
| P49 | 0.68 | 0.66 | 1.52 | 1.54 | COMPARATIVE EXAMPLE |
| P50 | 0.74 | 0.76 | 1.44 | 1.45 | COMPARATIVE EXAMPLE |
| P51 | 0.68 | 0.66 | 1.52 | 1.54 | COMPARATIVE EXAMPLE |
| P52 | 0.74 | 0.76 | 1.44 | 1.45 | COMPARATIVE EXAMPLE |
| P53 | 0.74 | 0.76 | 1.44 | 1.45 | COMPARATIVE EXAMPLE |
| P54 | 0.68 | 0.66 | 1.52 | 1.54 | COMPARATIVE EXAMPLE |
| P55 | 0.74 | 0.76 | 1.44 | 1.45 | COMPARATIVE EXAMPLE |
| P56 | 0.68 | 0.66 | 1.52 | 1.54 | COMPARATIVE EXAMPLE |
| P57 | 0.68 | 0.66 | 1.52 | 1.54 | COMPARATIVE EXAMPLE |
| P58 | 0.68 | 0.66 | 1.52 | 1.54 | COMPARATIVE EXAMPLE |
| P59 | 0.68 | 0.66 | 1.52 | 1.54 | COMPARATIVE EXAMPLE |
| P60 | 0.68 | 0.66 | 1.52 | 1.54 | COMPARATIVE EXAMPLE |
| P61 | 0.89 | 0.91 | 1.29 | 1.31 | COMPARATIVE EXAMPLE |

TABLE 23-continued

| | | | | | |
|---|---|---|---|---|---|
| P62 | 0.89 | 0.91 | 1.29 | 1.31 | COMPARATIVE EXAMPLE |
| P63 | 0.68 | 0.66 | 1.52 | 1.54 | COMPARATIVE EXAMPLE |
| P64 | 0.89 | 0.91 | 1.29 | 1.31 | COMPARATIVE EXAMPLE |
| P65 | 0.68 | 0.66 | 1.52 | 1.54 | COMPARATIVE EXAMPLE |
| P66 | 0.68 | 0.66 | 1.52 | 1.54 | COMPARATIVE EXAMPLE |
| P67 | 0.68 | 0.66 | 1.52 | 1.54 | COMPARATIVE EXAMPLE |
| P68 | 0.89 | 0.91 | 1.29 | 1.31 | COMPARATIVE EXAMPLE |
| P69 | 0.89 | 0.91 | 1.29 | 1.31 | COMPARATIVE EXAMPLE |
| P70 | 0.89 | 0.91 | 1.29 | 1.31 | COMPARATIVE EXAMPLE |
| P71 | 0.89 | 0.91 | 1.29 | 1.31 | COMPARATIVE EXAMPLE |
| P72 | 0.68 | 0.66 | 1.52 | 1.54 | COMPARATIVE EXAMPLE |
| P73 | 0.89 | 0.91 | 1.29 | 1.31 | COMPARATIVE EXAMPLE |
| P74 | 0.68 | 0.66 | 1.52 | 1.54 | COMPARATIVE EXAMPLE |
| P75 | 0.89 | 0.91 | 1.29 | 1.31 | COMPARATIVE EXAMPLE |
| P76 | 0.68 | 0.66 | 1.52 | 1.54 | COMPARATIVE EXAMPLE |
| P77 | 0.89 | 0.91 | 1.29 | 1.31 | COMPARATIVE EXAMPLE |
| P78 | 0.89 | 0.91 | 1.29 | 1.31 | COMPARATIVE EXAMPLE |
| P79 | 0.68 | 0.66 | 1.52 | 1.54 | COMPARATIVE EXAMPLE |
| P80 | 0.89 | 0.91 | 1.29 | 1.31 | COMPARATIVE EXAMPLE |
| P81 | 0.74 | 0.76 | 1.44 | 1.45 | COMPARATIVE EXAMPLE |
| P82 | 0.74 | 0.76 | 1.44 | 1.45 | COMPARATIVE EXAMPLE |
| P83 | 0.74 | 0.76 | 1.44 | 1.45 | COMPARATIVE EXAMPLE |
| P84 | 0.74 | 0.76 | 1.44 | 1.45 | COMPARATIVE EXAMPLE |
| P85 | 0.74 | 0.76 | 1.44 | 1.45 | COMPARATIVE EXAMPLE |
| P86 | 0.74 | 0.76 | 1.44 | 1.45 | COMPARATIVE EXAMPLE |

| | MECHANICAL PROPERTIES | | | | | | | | |
|---|---|---|---|---|---|---|---|---|---|
| PRODUCTION No. | STANDARD DEVIATION RATIO OF HARDNESS/— | TS/ MPa | u-EL/% | EL/% | λ/% | TS × u-EL/ MPa % | TS × EL/ MPa % | TS × λ/ MPa % | REMARKS |
| P44 | 0.23 | 460 | 9 | 24 | 65.0 | 4140 | 11040 | 29900 | COMPARATIVE EXAMPLE |
| P45 | 0.23 | 430 | 7 | 21 | 66.0 | 3010 | 9030 | 28380 | COMPARATIVE EXAMPLE |
| P46 | 0.23 | 460 | 9 | 24 | 65.0 | 4140 | 11040 | 29900 | COMPARATIVE EXAMPLE |
| P47 | 0.23 | 500 | 8 | 22 | 55.0 | 4000 | 11000 | 27500 | COMPARATIVE EXAMPLE |
| P48 | 0.23 | 1290 | 1 | 10 | 65.0 | 1290 | 12900 | 83850 | COMPARATIVE EXAMPLE |
| P49 | 0.23 | 500 | 8 | 22 | 55.0 | 4000 | 11000 | 27500 | COMPARATIVE EXAMPLE |
| P50 | 0.23 | 1290 | 1 | 10 | 65.0 | 1290 | 12900 | 83850 | COMPARATIVE EXAMPLE |
| P51 | 0.23 | 500 | 8 | 22 | 55.0 | 4000 | 11000 | 27500 | COMPARATIVE EXAMPLE |
| P52 | 0.23 | 1290 | 1 | 10 | 65.0 | 1290 | 12900 | 83850 | COMPARATIVE EXAMPLE |
| P53 | 0.23 | 1290 | 1 | 10 | 65.0 | 1290 | 12900 | 83850 | COMPARATIVE EXAMPLE |
| P54 | 0.23 | 500 | 8 | 22 | 55.0 | 4000 | 11000 | 27500 | COMPARATIVE EXAMPLE |
| P55 | 0.23 | 430 | 8 | 22 | 65.0 | 3440 | 9460 | 27950 | COMPARATIVE EXAMPLE |
| P56 | 0.23 | 440 | 5 | 19 | 64.0 | 2200 | 8360 | 28160 | COMPARATIVE EXAMPLE |
| P57 | 0.24 | 440 | 5 | 19 | 64.0 | 2200 | 8360 | 28160 | COMPARATIVE EXAMPLE |
| P58 | 0.23 | 450 | 7 | 21 | 64.0 | 3150 | 9450 | 28800 | COMPARATIVE EXAMPLE |
| P59 | 0.23 | 450 | 7 | 21 | 64.0 | 3150 | 9450 | 28800 | COMPARATIVE EXAMPLE |
| P60 | 0.23 | 430 | 8 | 22 | 64.0 | 3440 | 9460 | 27520 | COMPARATIVE EXAMPLE |
| P61 | 0.23 | 440 | 7 | 21 | 75.0 | 3080 | 9240 | 33000 | COMPARATIVE EXAMPLE |
| P62 | 0.23 | 440 | 7 | 21 | 75.0 | 3080 | 9240 | 33000 | COMPARATIVE EXAMPLE |
| P63 | 0.23 | 470 | 5 | 19 | 64.0 | 2350 | 8930 | 30080 | COMPARATIVE EXAMPLE |
| P64 | 0.23 | 440 | 7 | 21 | 75.0 | 3080 | 9240 | 33000 | COMPARATIVE EXAMPLE |
| P65 | 0.23 | 450 | 7 | 21 | 64.0 | 3150 | 9450 | 28800 | COMPARATIVE EXAMPLE |
| P66 | 0.23 | 440 | 5 | 19 | 64.0 | 2200 | 8360 | 28160 | COMPARATIVE EXAMPLE |
| P67 | 0.23 | 450 | 7 | 21 | 64.0 | 3150 | 9450 | 28800 | COMPARATIVE EXAMPLE |
| P68 | 0.23 | 410 | 3 | 17 | 75.0 | 1230 | 6970 | 30750 | COMPARATIVE EXAMPLE |
| P69 | 0.23 | 440 | 7 | 21 | 75.0 | 3080 | 9240 | 33000 | COMPARATIVE EXAMPLE |
| P70 | 0.23 | 410 | 3 | 17 | 75.0 | 1230 | 6970 | 30750 | COMPARATIVE EXAMPLE |
| P71 | 0.23 | 440 | 7 | 21 | 75.0 | 3080 | 9240 | 33000 | COMPARATIVE EXAMPLE |
| P72 | 0.23 | 480 | 4 | 18 | 55.0 | 1920 | 8640 | 26400 | COMPARATIVE EXAMPLE |
| P73 | 0.23 | 1270 | 1 | 10 | 65.0 | 1270 | 12700 | 82550 | COMPARATIVE EXAMPLE |
| P74 | 0.23 | 480 | 4 | 18 | 55.0 | 1920 | 8640 | 26400 | COMPARATIVE EXAMPLE |
| P75 | 0.23 | 1270 | 1 | 10 | 65.0 | 1270 | 12700 | 82550 | COMPARATIVE EXAMPLE |
| P76 | 0.23 | 480 | 4 | 18 | 55.0 | 1920 | 8640 | 26400 | COMPARATIVE EXAMPLE |
| P77 | 0.23 | 1270 | 1 | 10 | 65.0 | 1270 | 12700 | 82550 | COMPARATIVE EXAMPLE |
| P78 | 0.23 | 1270 | 1 | 10 | 65.0 | 1270 | 12700 | 82550 | COMPARATIVE EXAMPLE |
| P79 | 0.23 | 480 | 4 | 18 | 55.0 | 1920 | 8640 | 26400 | COMPARATIVE EXAMPLE |
| P80 | 0.23 | 410 | 4 | 18 | 65.0 | 1640 | 7380 | 26650 | COMPARATIVE EXAMPLE |
| P81 | 0.23 | 410 | 7 | 21 | 66.0 | 2870 | 8610 | 27060 | COMPARATIVE EXAMPLE |
| P82 | 0.23 | 850 | 8 | 22 | 62.0 | 6800 | 18700 | 52700 | COMPARATIVE EXAMPLE |
| P83 | 0.23 | 430 | 15 | 29 | 71.0 | 6450 | 12470 | 30530 | COMPARATIVE EXAMPLE |
| P84 | 0.23 | 850 | 8 | 22 | 62.0 | 6800 | 18700 | 52700 | COMPARATIVE EXAMPLE |
| P85 | 0.23 | 430 | 15 | 29 | 71.0 | 6450 | 12470 | 30530 | COMPARATIVE EXAMPLE |
| P86 | 0.23 | 850 | 8 | 22 | 62.0 | 6800 | 18700 | 52700 | COMPARATIVE EXAMPLE |

TABLE 23-continued

| PRODUCTION No. | OTHERS d/RmC/— | Rm45/ RmC/— | TS/fM × dis/dia/— | REMARKS |
|---|---|---|---|---|
| P44 | 1.0 | 2.4 | 358 | COMPARATIVE EXAMPLE |
| P45 | 1.0 | 2.0 | — | COMPARATIVE EXAMPLE |
| P46 | 1.0 | 2.4 | 358 | COMPARATIVE EXAMPLE |
| P47 | 0.7 | 2.4 | 3600 | COMPARATIVE EXAMPLE |
| P48 | 1.0 | 2.4 | 33 | COMPARATIVE EXAMPLE |
| P49 | 0.7 | 2.4 | 3600 | COMPARATIVE EXAMPLE |
| P50 | 1.0 | 2.4 | 33 | COMPARATIVE EXAMPLE |
| P51 | 0.7 | 2.4 | 3600 | COMPARATIVE EXAMPLE |
| P52 | 1.0 | 2.4 | 33 | COMPARATIVE EXAMPLE |
| P53 | 1.0 | 2.4 | 33 | COMPARATIVE EXAMPLE |
| P54 | 0.7 | 2.4 | 3600 | COMPARATIVE EXAMPLE |
| P55 | 1.0 | 2.4 | 516 | COMPARATIVE EXAMPLE |
| P56 | 0.9 | 2.2 | 336 | COMPARATIVE EXAMPLE |
| P57 | 0.9 | 2.2 | 336 | COMPARATIVE EXAMPLE |
| P58 | 0.9 | 2.2 | 344 | COMPARATIVE EXAMPLE |
| P59 | 0.9 | 2.2 | 436 | COMPARATIVE EXAMPLE |
| P60 | 0.9 | 2.2 | 416 | COMPARATIVE EXAMPLE |
| P61 | 1.1 | 1.8 | 336 | COMPARATIVE EXAMPLE |
| P62 | 1.1 | 1.8 | 336 | COMPARATIVE EXAMPLE |
| P63 | 0.9 | 2.2 | 455 | COMPARATIVE EXAMPLE |
| P64 | 1.1 | 1.8 | 336 | COMPARATIVE EXAMPLE |
| P65 | 0.9 | 2.2 | 436 | COMPARATIVE EXAMPLE |
| P66 | 0.9 | 2.2 | 336 | COMPARATIVE EXAMPLE |
| P67 | 0.9 | 2.2 | 436 | COMPARATIVE EXAMPLE |
| P68 | 1.2 | 1.8 | — | COMPARATIVE EXAMPLE |
| P69 | 1.1 | 1.8 | 336 | COMPARATIVE EXAMPLE |
| P70 | 1.2 | 1.8 | — | COMPARATIVE EXAMPLE |
| P71 | 1.1 | 1.8 | 336 | COMPARATIVE EXAMPLE |
| P72 | 0.9 | 2.2 | 3300 | COMPARATIVE EXAMPLE |
| P73 | 1.2 | 1.7 | 32 | COMPARATIVE EXAMPLE |
| P74 | 0.9 | 2.2 | 3300 | COMPARATIVE EXAMPLE |
| P75 | 1.2 | 1.7 | 32 | COMPARATIVE EXAMPLE |
| P76 | 0.9 | 2.2 | 3300 | COMPARATIVE EXAMPLE |
| P77 | 1.2 | 1.7 | 32 | COMPARATIVE EXAMPLE |
| P78 | 1.2 | 1.7 | 32 | COMPARATIVE EXAMPLE |
| P79 | 0.9 | 2.2 | 3300 | COMPARATIVE EXAMPLE |
| P80 | 1.2 | 1.7 | 470 | COMPARATIVE EXAMPLE |
| P81 | 1.0 | 2.0 | 7380 | COMPARATIVE EXAMPLE |
| P82 | 1.0 | 2.3 | 1020 | COMPARATIVE EXAMPLE |
| P83 | 1.0 | 1.9 | 516 | COMPARATIVE EXAMPLE |
| P84 | 1.0 | 2.3 | 1020 | COMPARATIVE EXAMPLE |
| P85 | 1.0 | 1.9 | 516 | COMPARATIVE EXAMPLE |
| P86 | 1.0 | 2.3 | 1020 | COMPARATIVE EXAMPLE |

TABLE 24

| PRODUCTION No. | LANKFORD-VLAUE rL/— | rC/— | r30/— | r60/— | REMARKS |
|---|---|---|---|---|---|
| P87 | 0.74 | 0.76 | 1.44 | 1.45 | COMPARATIVE EXAMPLE |
| P88 | 0.74 | 0.76 | 1.44 | 1.45 | COMPARATIVE EXAMPLE |
| P89 | Cracks occur during Hot rolling | | | | COMPARATIVE EXAMPLE |
| P90 | 0.74 | 0.76 | 1.44 | 1.45 | COMPARATIVE EXAMPLE |
| P91 | 0.74 | 0.76 | 1.44 | 1.45 | COMPARATIVE EXAMPLE |
| P92 | 0.74 | 0.76 | 1.44 | 1.45 | COMPARATIVE EXAMPLE |
| P93 | 0.74 | 0.76 | 1.44 | 1.45 | COMPARATIVE EXAMPLE |
| P94 | 0.74 | 0.76 | 1.44 | 1.45 | COMPARATIVE EXAMPLE |
| P95 | 0.74 | 0.76 | 1.44 | 1.45 | COMPARATIVE EXAMPLE |
| P96 | 0.74 | 0.76 | 1.44 | 1.45 | COMPARATIVE EXAMPLE |
| P97 | 0.52 | 0.56 | 1.66 | 1.69 | COMPARATIVE EXAMPLE |
| P98 | 0.52 | 0.56 | 1.66 | 1.69 | COMPARATIVE EXAMPLE |
| P99 | 0.52 | 0.56 | 1.66 | 1.69 | COMPARATIVE EXAMPLE |
| P100 | 0.74 | 0.76 | 1.44 | 1.45 | COMPARATIVE EXAMPLE |
| P101 | 0.74 | 0.76 | 1.44 | 1.45 | COMPARATIVE EXAMPLE |
| P102 | 0.74 | 0.76 | 1.44 | 1.45 | COMPARATIVE EXAMPLE |
| P103 | 0.74 | 0.76 | 1.44 | 1.45 | COMPARATIVE EXAMPLE |
| P104 | 0.74 | 0.76 | 1.44 | 1.45 | COMPARATIVE EXAMPLE |
| P105 | 0.74 | 0.76 | 1.44 | 1.45 | COMPARATIVE EXAMPLE |

TABLE 24-continued

| | | | | | |
|---|---|---|---|---|---|
| P106 | 0.74 | 0.76 | 1.44 | 1.45 | COMPARATIVE EXAMPLE |
| P107 | 0.74 | 0.76 | 1.44 | 1.45 | COMPARATIVE EXAMPLE |
| P108 | | Cracks occur during Hot rolling | | | COMPARATIVE EXAMPLE |
| P109 | | Cracks occur during Hot rolling | | | COMPARATIVE EXAMPLE |
| P110 | 0.74 | 0.76 | 1.44 | 1.45 | COMPARATIVE EXAMPLE |
| P111 | 0.74 | 0.76 | 1.44 | 1.45 | COMPARATIVE EXAMPLE |
| P112 | 0.89 | 0.91 | 1.29 | 1.31 | EXAMPLE |
| P113 | 0.89 | 0.91 | 1.29 | 1.31 | EXAMPLE |
| P114 | 0.89 | 0.91 | 1.29 | 1.31 | EXAMPLE |
| P115 | 0.89 | 0.91 | 1.29 | 1.31 | EXAMPLE |
| P116 | 0.89 | 0.91 | 1.29 | 1.31 | EXAMPLE |
| P117 | 0.89 | 0.91 | 1.29 | 1.31 | EXAMPLE |
| P118 | 0.89 | 0.91 | 1.29 | 1.31 | EXAMPLE |
| P119 | 0.89 | 0.91 | 1.29 | 1.31 | EXAMPLE |
| P120 | 0.89 | 0.91 | 1.29 | 1.31 | EXAMPLE |
| P121 | 0.89 | 0.91 | 1.29 | 1.31 | EXAMPLE |
| P122 | 0.89 | 0.91 | 1.29 | 1.31 | EXAMPLE |
| P123 | 0.89 | 0.91 | 1.29 | 1.31 | EXAMPLE |
| P124 | 0.89 | 0.91 | 1.29 | 1.31 | EXAMPLE |
| P125 | 0.89 | 0.91 | 1.29 | 1.31 | EXAMPLE |
| P126 | 0.89 | 0.91 | 1.29 | 1.31 | EXAMPLE |
| P127 | 0.89 | 0.91 | 1.29 | 1.31 | EXAMPLE |
| P128 | 0.89 | 0.91 | 1.29 | 1.31 | EXAMPLE |
| P129 | 0.89 | 0.91 | 1.29 | 1.31 | EXAMPLE |

| | | MECHANICAL PROPERTIES | | | | | | | |
|---|---|---|---|---|---|---|---|---|---|
| PRODUCTION No. | STANDARD DEVIATION RATIO OF HARDNESS/— | TS/ MPa | u-EL/% | EL/% | λ/% | TS × u-EL/ MPa % | TS × EL/ MPa % | TS × λ/ MPa % | REMARKS |
| P87 | 0.23 | 590 | 8 | 22 | 62.0 | 4720 | 12980 | 36580 | COMPARATIVE EXAMPLE |
| P88 | 0.23 | 590 | 11 | 29 | 62.0 | 6490 | 17110 | 36580 | COMPARATIVE EXAMPLE |
| P89 | | Cracks occur during Hot rolling | | | | | | | COMPARATIVE EXAMPLE |
| P90 | 0.23 | 590 | 8 | 22 | 62.0 | 4720 | 12980 | 36580 | COMPARATIVE EXAMPLE |
| P91 | 0.23 | 590 | 8 | 22 | 62.0 | 4720 | 12980 | 36580 | COMPARATIVE EXAMPLE |
| P92 | 0.23 | 590 | 8 | 22 | 62.0 | 4720 | 12980 | 36580 | COMPARATIVE EXAMPLE |
| P93 | 0.23 | 850 | 8 | 22 | 62.0 | 6800 | 18700 | 52700 | COMPARATIVE EXAMPLE |
| P94 | 0.23 | 850 | 8 | 22 | 62.0 | 6800 | 18700 | 52700 | COMPARATIVE EXAMPLE |
| P95 | 0.23 | 850 | 8 | 22 | 62.0 | 6800 | 18700 | 52700 | COMPARATIVE EXAMPLE |
| P96 | 0.23 | 850 | 8 | 22 | 62.0 | 6800 | 18700 | 52700 | COMPARATIVE EXAMPLE |
| P97 | 0.23 | 790 | 8 | 22 | 55.0 | 6320 | 17380 | 43450 | COMPARATIVE EXAMPLE |
| P98 | 0.23 | 830 | 8 | 22 | 55.0 | 6640 | 18260 | 45650 | COMPARATIVE EXAMPLE |
| P99 | 0.23 | 790 | 8 | 22 | 55.0 | 6320 | 17380 | 43450 | COMPARATIVE EXAMPLE |
| P100 | 0.23 | 850 | 8 | 22 | 62.0 | 6800 | 18700 | 52700 | COMPARATIVE EXAMPLE |
| P101 | 0.23 | 850 | 8 | 22 | 62.0 | 6800 | 18700 | 52700 | COMPARATIVE EXAMPLE |
| P102 | 0.23 | 590 | 8 | 22 | 62.0 | 4720 | 12980 | 36580 | COMPARATIVE EXAMPLE |
| P103 | 0.23 | 590 | 8 | 22 | 62.0 | 4720 | 12980 | 36580 | COMPARATIVE EXAMPLE |
| P104 | 0.23 | 850 | 8 | 22 | 62.0 | 6800 | 18700 | 52700 | COMPARATIVE EXAMPLE |
| P105 | 0.23 | 590 | 8 | 22 | 62.0 | 4720 | 12980 | 36580 | COMPARATIVE EXAMPLE |
| P106 | 0.23 | 850 | 8 | 22 | 62.0 | 6800 | 18700 | 52700 | COMPARATIVE EXAMPLE |
| P107 | 0.23 | 850 | 8 | 22 | 62.0 | 6800 | 18700 | 52700 | COMPARATIVE EXAMPLE |
| P108 | | Cracks occur during Hot rolling | | | | | | | COMPARATIVE EXAMPLE |
| P109 | | Cracks occur during Hot rolling | | | | | | | COMPARATIVE EXAMPLE |
| P110 | 0.23 | 590 | 11 | 23 | 62.0 | 6490 | 13570 | 36580 | COMPARATIVE EXAMPLE |
| P111 | 0.23 | 590 | 11 | 23 | 62.0 | 6490 | 13570 | 36580 | COMPARATIVE EXAMPLE |
| P112 | 0.23 | 467 | 15 | 30 | 66.0 | 7005 | 14010 | 30822 | EXAMPLE |
| P113 | 0.23 | 489 | 15 | 29 | 65.7 | 7335 | 14181 | 32127 | EXAMPLE |
| P114 | 0.23 | 511 | 14 | 29 | 65.4 | 7154 | 14819 | 33419 | EXAMPLE |
| P115 | 0.23 | 585 | 13 | 28 | 64.7 | 7605 | 16380 | 37850 | EXAMPLE |
| P116 | 0.23 | 632 | 12 | 27 | 64.1 | 7584 | 17064 | 40511 | EXAMPLE |
| P117 | 0.23 | 711 | 11 | 26 | 63.5 | 7821 | 18486 | 45149 | EXAMPLE |
| P118 | 0.23 | 746 | 11 | 25 | 63.1 | 8206 | 18650 | 47073 | EXAMPLE |
| P119 | 0.23 | 759 | 10 | 25 | 62.9 | 7590 | 18975 | 47741 | EXAMPLE |
| P120 | 0.23 | 840 | 9 | 23 | 62.2 | 7560 | 19320 | 52248 | EXAMPLE |
| P121 | 0.23 | 471 | 15 | 30 | 70.8 | 7065 | 14130 | 33347 | EXAMPLE |
| P122 | 0.23 | 482 | 15 | 30 | 70.5 | 7230 | 14460 | 33981 | EXAMPLE |
| P123 | 0.23 | 550 | 14 | 28 | 68.9 | 7700 | 15400 | 37895 | EXAMPLE |
| P124 | 0.23 | 670 | 11 | 25 | 65.2 | 7370 | 16750 | 43684 | EXAMPLE |
| P125 | 0.23 | 842 | 9 | 23 | 62.1 | 7578 | 19366 | 52288 | EXAMPLE |
| P126 | 0.23 | 467 | 15 | 30 | 70.9 | 7005 | 14010 | 33110 | EXAMPLE |
| P127 | 0.23 | 475 | 15 | 30 | 70.7 | 7125 | 14250 | 33583 | EXAMPLE |
| P128 | 0.23 | 521 | 14 | 29 | 69.5 | 7294 | 15109 | 36210 | EXAMPLE |
| P129 | 0.23 | 615 | 13 | 27 | 67.6 | 7995 | 16605 | 41574 | EXAMPLE |

TABLE 24-continued

| PRODUCTION No. | OTHERS d/RmC/— | Rm45/ RmC/— | TS/fM × dis/dia/— | REMARKS |
|---|---|---|---|---|
| P87 | 1.0 | 2.3 | 708 | COMPARATIVE EXAMPLE |
| P88 | 1.0 | 1.9 | 708 | COMPARATIVE EXAMPLE |
| P89 | Cracks occur during Hot rolling | | | COMPARATIVE EXAMPLE |
| P90 | 1.0 | 2.3 | 708 | COMPARATIVE EXAMPLE |
| P91 | 1.0 | 2.3 | 708 | COMPARATIVE EXAMPLE |
| P92 | 1.0 | 2.3 | 708 | COMPARATIVE EXAMPLE |
| P93 | 1.0 | 2.3 | 1020 | COMPARATIVE EXAMPLE |
| P94 | 1.0 | 2.3 | 1020 | COMPARATIVE EXAMPLE |
| P95 | 1.0 | 2.3 | 1020 | COMPARATIVE EXAMPLE |
| P96 | 1.0 | 2.3 | 1020 | COMPARATIVE EXAMPLE |
| P97 | 0.7 | 2.4 | 948 | COMPARATIVE EXAMPLE |
| P98 | 0.7 | 2.4 | 996 | COMPARATIVE EXAMPLE |
| P99 | 0.7 | 2.4 | 948 | COMPARATIVE EXAMPLE |
| P100 | 1.0 | 2.3 | 1020 | COMPARATIVE EXAMPLE |
| P101 | 1.0 | 2.3 | 1020 | COMPARATIVE EXAMPLE |
| P102 | 1.0 | 2.3 | 708 | COMPARATIVE EXAMPLE |
| P103 | 1.0 | 2.3 | 708 | COMPARATIVE EXAMPLE |
| P104 | 1.0 | 2.3 | 1020 | COMPARATIVE EXAMPLE |
| P105 | 1.0 | 2.3 | 708 | COMPARATIVE EXAMPLE |
| P106 | 1.0 | 2.3 | 1020 | COMPARATIVE EXAMPLE |
| P107 | 1.0 | 2.3 | 1020 | COMPARATIVE EXAMPLE |
| P108 | Cracks occur during Hot rolling | | | COMPARATIVE EXAMPLE |
| P109 | Cracks occur during Hot rolling | | | COMPARATIVE EXAMPLE |
| P110 | 1.0 | 2.3 | 708 | COMPARATIVE EXAMPLE |
| P111 | 1.0 | 2.3 | 708 | COMPARATIVE EXAMPLE |
| P112 | 1.4 | 1.4 | 535 | EXAMPLE |
| P113 | 1.4 | 1.4 | 560 | EXAMPLE |
| P114 | 1.3 | 1.6 | 586 | EXAMPLE |
| P115 | 1.3 | 1.6 | 670 | EXAMPLE |
| P116 | 1.2 | 1.7 | 724 | EXAMPLE |
| P117 | 1.2 | 1.7 | 815 | EXAMPLE |
| P118 | 1.1 | 1.8 | 855 | EXAMPLE |
| P119 | 1.1 | 1.8 | 870 | EXAMPLE |
| P120 | 1.0 | 2.0 | 963 | EXAMPLE |
| P121 | 1.4 | 1.4 | 540 | EXAMPLE |
| P122 | 1.4 | 1.4 | 552 | EXAMPLE |
| P123 | 1.3 | 1.6 | 630 | EXAMPLE |
| P124 | 1.2 | 1.7 | 768 | EXAMPLE |
| P125 | 1.0 | 2.0 | 965 | EXAMPLE |
| P126 | 1.4 | 1.4 | 535 | EXAMPLE |
| P127 | 1.4 | 1.4 | 544 | EXAMPLE |
| P128 | 1.3 | 1.6 | 597 | EXAMPLE |
| P129 | 1.3 | 1.6 | 705 | EXAMPLE |

TABLE 25

| PRODUCTION No. | LANKFORD-VLAUE rL/— | rC/— | r30/— | r60/— | REMARKS |
|---|---|---|---|---|---|
| P130 | 0.89 | 0.91 | 1.29 | 1.31 | EXAMPLE |
| P131 | 0.89 | 0.91 | 1.29 | 1.31 | EXAMPLE |
| P132 | 0.89 | 0.91 | 1.29 | 1.31 | EXAMPLE |
| P133 | 0.89 | 0.91 | 1.29 | 1.31 | EXAMPLE |
| P134 | 0.89 | 0.91 | 1.29 | 1.31 | EXAMPLE |
| P135 | 0.89 | 0.91 | 1.29 | 1.31 | EXAMPLE |
| P136 | 0.89 | 0.91 | 1.29 | 1.31 | EXAMPLE |
| P137 | 0.89 | 0.91 | 1.29 | 1.31 | EXAMPLE |
| P138 | 0.89 | 0.91 | 1.29 | 1.31 | EXAMPLE |
| P139 | 0.89 | 0.91 | 1.29 | 1.31 | EXAMPLE |
| P140 | 0.89 | 0.91 | 1.29 | 1.31 | EXAMPLE |
| P141 | 0.89 | 0.91 | 1.29 | 1.31 | EXAMPLE |
| P142 | 0.89 | 0.91 | 1.29 | 1.31 | EXAMPLE |
| P143 | 0.89 | 0.91 | 1.29 | 1.31 | EXAMPLE |
| P144 | 0.89 | 0.91 | 1.29 | 1.31 | EXAMPLE |
| P145 | 0.89 | 0.91 | 1.29 | 1.31 | EXAMPLE |
| P146 | 0.89 | 0.91 | 1.29 | 1.31 | EXAMPLE |
| P147 | 0.89 | 0.91 | 1.29 | 1.31 | EXAMPLE |
| P148 | 0.89 | 0.91 | 1.29 | 1.31 | EXAMPLE |
| P149 | 0.89 | 0.91 | 1.29 | 1.31 | EXAMPLE |
| P150 | 0.89 | 0.91 | 1.29 | 1.31 | EXAMPLE |
| P151 | 0.89 | 0.91 | 1.29 | 1.31 | EXAMPLE |

TABLE 25-continued

| | | | | | |
|---|---|---|---|---|---|
| P152 | 0.89 | 0.91 | 1.29 | 1.31 | EXAMPLE |
| P153 | 0.89 | 0.91 | 1.29 | 1.31 | EXAMPLE |
| P154 | 0.89 | 0.91 | 1.29 | 1.31 | EXAMPLE |
| P155 | 0.89 | 0.91 | 1.29 | 1.31 | EXAMPLE |
| P156 | 0.89 | 0.91 | 1.29 | 1.31 | EXAMPLE |
| P157 | 0.89 | 0.91 | 1.29 | 1.31 | EXAMPLE |
| P158 | 0.89 | 0.91 | 1.29 | 1.31 | EXAMPLE |
| P159 | 0.89 | 0.91 | 1.29 | 1.31 | EXAMPLE |
| P160 | 0.89 | 0.91 | 1.29 | 1.31 | EXAMPLE |
| P161 | 0.89 | 0.91 | 1.29 | 1.31 | EXAMPLE |
| P162 | 0.89 | 0.91 | 1.29 | 1.31 | EXAMPLE |
| P163 | 0.89 | 0.91 | 1.29 | 1.31 | EXAMPLE |
| P164 | 0.89 | 0.91 | 1.29 | 1.31 | EXAMPLE |
| P165 | 0.89 | 0.91 | 1.29 | 1.31 | EXAMPLE |
| P166 | 0.89 | 0.91 | 1.29 | 1.31 | EXAMPLE |
| P167 | 0.89 | 0.91 | 1.29 | 1.31 | EXAMPLE |
| P168 | 0.89 | 0.91 | 1.29 | 1.31 | EXAMPLE |
| P169 | 0.89 | 0.91 | 1.29 | 1.31 | EXAMPLE |
| P170 | 0.89 | 0.91 | 1.29 | 1.31 | EXAMPLE |
| P171 | 0.89 | 0.91 | 1.29 | 1.31 | EXAMPLE |
| P172 | 0.89 | 0.91 | 1.29 | 1.31 | EXAMPLE |

| | MECHANICAL PROPERTIES | | | | | | | | |
|---|---|---|---|---|---|---|---|---|---|
| PRODUCTION No. | STANDARD DEVIATION RATIO OF HARDNESS/— | TS/ MPa | u-EL/% | EL/% | λ/% | TS × u-EL/ MPa % | TS × EL/ MPa % | TS × λ/ MPa % | REMARKS |
| P130 | 0.23 | 698 | 11 | 25 | 64.8 | 7678 | 17450 | 45230 | EXAMPLE |
| P131 | 0.23 | 740 | 11 | 25 | 63.9 | 8140 | 18500 | 47286 | EXAMPLE |
| P132 | 0.23 | 777 | 10 | 24 | 63.3 | 7770 | 18648 | 49184 | EXAMPLE |
| P133 | 0.23 | 801 | 10 | 24 | 62.8 | 8010 | 19224 | 50303 | EXAMPLE |
| P134 | 0.23 | 845 | 9 | 23 | 61.9 | 7605 | 19435 | 52306 | EXAMPLE |
| P135 | 0.23 | 590 | 12 | 24 | 60.0 | 7080 | 14160 | 35400 | EXAMPLE |
| P136 | 0.23 | 590 | 13 | 24 | 70.0 | 7670 | 14160 | 41300 | EXAMPLE |
| P137 | 0.23 | 590 | 13 | 24 | 80.0 | 7670 | 14160 | 47200 | EXAMPLE |
| P138 | 0.23 | 590 | 13 | 24 | 80.0 | 7670 | 14160 | 47200 | EXAMPLE |
| P139 | 0.23 | 590 | 12 | 24 | 60.0 | 7080 | 14160 | 35400 | EXAMPLE |
| P140 | 0.23 | 570 | 14 | 29 | 80.0 | 7980 | 16530 | 45600 | EXAMPLE |
| P141 | 0.23 | 570 | 13 | 28 | 80.0 | 7410 | 15960 | 45600 | EXAMPLE |
| P142 | 0.23 | 570 | 13 | 28 | 80.0 | 7410 | 15960 | 45600 | EXAMPLE |
| P143 | 0.23 | 590 | 12 | 27 | 75.0 | 7080 | 15930 | 44250 | EXAMPLE |
| P144 | 0.23 | 590 | 12 | 27 | 75.0 | 7080 | 15930 | 44250 | EXAMPLE |
| P145 | 0.23 | 590 | 13 | 25 | 80.0 | 7670 | 14750 | 47200 | EXAMPLE |
| P146 | 0.23 | 590 | 13 | 24 | 65.0 | 7670 | 14160 | 38350 | EXAMPLE |
| P147 | 0.23 | 590 | 12 | 24 | 65.0 | 7080 | 14160 | 38350 | EXAMPLE |
| P148 | 0.23 | 590 | 13 | 25 | 80.0 | 7670 | 14750 | 47200 | EXAMPLE |
| P149 | 0.23 | 590 | 13 | 24 | 65.0 | 7670 | 14160 | 38350 | EXAMPLE |
| P150 | 0.23 | 590 | 12 | 24 | 65.0 | 7080 | 14160 | 38350 | EXAMPLE |
| P151 | 0.23 | 590 | 13 | 25 | 80.0 | 7670 | 14750 | 47200 | EXAMPLE |
| P152 | 0.23 | 590 | 13 | 24 | 65.0 | 7670 | 14160 | 38350 | EXAMPLE |
| P153 | 0.23 | 590 | 12 | 24 | 65.0 | 7080 | 14160 | 38350 | EXAMPLE |
| P154 | 0.23 | 590 | 12 | 26 | 80.0 | 7080 | 15340 | 47200 | EXAMPLE |
| P155 | 0.23 | 650 | 12 | 26 | 74.0 | 7800 | 16900 | 48100 | EXAMPLE |
| P156 | 0.23 | 780 | 11 | 23 | 68.0 | 8580 | 17940 | 53040 | EXAMPLE |
| P157 | 0.23 | 590 | 12 | 26 | 80.0 | 7080 | 15340 | 47200 | EXAMPLE |
| P158 | 0.23 | 680 | 12 | 26 | 74.0 | 8160 | 17680 | 50320 | EXAMPLE |
| P159 | 0.23 | 720 | 11 | 23 | 68.0 | 7920 | 16560 | 48960 | EXAMPLE |
| P160 | 0.23 | 590 | 12 | 26 | 80.0 | 7080 | 15340 | 47200 | EXAMPLE |
| P161 | 0.23 | 640 | 12 | 26 | 75.0 | 7680 | 16640 | 48000 | EXAMPLE |
| P162 | 0.23 | 780 | 11 | 23 | 70.0 | 8580 | 17940 | 54600 | EXAMPLE |
| P163 | 0.23 | 780 | 10 | 20 | 58.0 | 7800 | 15600 | 45240 | EXAMPLE |
| P164 | 0.23 | 590 | 12 | 26 | 80.0 | 7080 | 15340 | 47200 | EXAMPLE |
| P165 | 0.23 | 570 | 13 | 28 | 85.0 | 7410 | 15960 | 48450 | EXAMPLE |
| P166 | 0.23 | 570 | 13 | 30 | 90.0 | 7410 | 17100 | 51300 | EXAMPLE |
| P167 | 0.23 | 590 | 12 | 26 | 80.0 | 7080 | 15340 | 47200 | EXAMPLE |
| P168 | 0.23 | 570 | 13 | 27 | 85.0 | 7410 | 15390 | 48450 | EXAMPLE |
| P169 | 0.23 | 570 | 13 | 30 | 90.0 | 7410 | 17100 | 51300 | EXAMPLE |
| P170 | 0.23 | 590 | 12 | 26 | 80.0 | 7080 | 15340 | 47200 | EXAMPLE |
| P171 | 0.23 | 570 | 13 | 27 | 85.0 | 7410 | 15390 | 48450 | EXAMPLE |
| P172 | 0.23 | 570 | 13 | 29 | 89.0 | 7410 | 16530 | 50730 | EXAMPLE |

| | OTHERS | | | |
|---|---|---|---|---|
| PRODUCTION No. | d/RmC/— | Rm45/ RmC/— | TS/fM × dis/dia/— | REMARKS |
| P130 | 1.2 | 1.7 | 800 | EXAMPLE |
| P131 | 1.1 | 1.8 | 848 | EXAMPLE |

TABLE 25-continued

| | | | | |
|---|---|---|---|---|
| P132 | 1.1 | 1.8 | 890 | EXAMPLE |
| P133 | 1.1 | 1.8 | 918 | EXAMPLE |
| P134 | 1.0 | 2.0 | 968 | EXAMPLE |
| P135 | 1.2 | 1.7 | 676 | EXAMPLE |
| P136 | 1.3 | 1.6 | 676 | EXAMPLE |
| P137 | 1.3 | 1.6 | 676 | EXAMPLE |
| P138 | 1.3 | 1.6 | 676 | EXAMPLE |
| P139 | 1.2 | 1.7 | 676 | EXAMPLE |
| P140 | 1.4 | 1.4 | 653 | EXAMPLE |
| P141 | 1.3 | 1.6 | 653 | EXAMPLE |
| P142 | 1.3 | 1.6 | 653 | EXAMPLE |
| P143 | 1.2 | 1.7 | 676 | EXAMPLE |
| P144 | 1.2 | 1.7 | 676 | EXAMPLE |
| P145 | 1.2 | 1.7 | 676 | EXAMPLE |
| P146 | 1.1 | 1.8 | 676 | EXAMPLE |
| P147 | 1.1 | 1.8 | 676 | EXAMPLE |
| P148 | 1.2 | 1.7 | 676 | EXAMPLE |
| P149 | 1.1 | 1.8 | 676 | EXAMPLE |
| P150 | 1.1 | 1.8 | 676 | EXAMPLE |
| P151 | 1.2 | 1.7 | 676 | EXAMPLE |
| P152 | 1.1 | 1.8 | 676 | EXAMPLE |
| P153 | 1.1 | 1.8 | 676 | EXAMPLE |
| P154 | 1.2 | 1.7 | 676 | EXAMPLE |
| P155 | 1.1 | 1.8 | 745 | EXAMPLE |
| P156 | 1.0 | 2.0 | 894 | EXAMPLE |
| P157 | 1.2 | 1.7 | 676 | EXAMPLE |
| P158 | 1.1 | 1.8 | 779 | EXAMPLE |
| P159 | 1.0 | 2.0 | 825 | EXAMPLE |
| P160 | 1.2 | 1.7 | 676 | EXAMPLE |
| P161 | 1.1 | 1.8 | 733 | EXAMPLE |
| P162 | 1.1 | 1.8 | 894 | EXAMPLE |
| P163 | 1.0 | 2.0 | 894 | EXAMPLE |
| P164 | 1.2 | 1.7 | 676 | EXAMPLE |
| P165 | 1.3 | 1.6 | 653 | EXAMPLE |
| P166 | 1.4 | 1.4 | 653 | EXAMPLE |
| P167 | 1.2 | 1.7 | 676 | EXAMPLE |
| P168 | 1.3 | 1.6 | 653 | EXAMPLE |
| P169 | 1.4 | 1.4 | 653 | EXAMPLE |
| P170 | 1.2 | 1.7 | 676 | EXAMPLE |
| P171 | 1.3 | 1.6 | 653 | EXAMPLE |
| P172 | 1.3 | 1.6 | 653 | EXAMPLE |

TABLE 26

| PRODUCTION | LANKFORD-VLAUE | | | | |
|---|---|---|---|---|---|
| No. | rL/— | rC/— | r30/— | r60/— | REMARKS |
| P173 | 0.89 | 0.91 | 1.29 | 1.31 | EXAMPLE |
| P174 | 0.89 | 0.91 | 1.29 | 1.31 | EXAMPLE |
| P175 | 0.89 | 0.91 | 1.29 | 1.31 | EXAMPLE |
| P176 | 0.89 | 0.91 | 1.29 | 1.31 | EXAMPLE |
| P177 | 0.89 | 0.91 | 1.29 | 1.31 | EXAMPLE |
| P178 | 0.89 | 0.91 | 1.29 | 1.31 | EXAMPLE |
| P179 | 0.89 | 0.91 | 1.29 | 1.31 | EXAMPLE |
| P180 | 0.89 | 0.91 | 1.29 | 1.31 | EXAMPLE |
| P181 | 0.89 | 0.91 | 1.29 | 1.31 | EXAMPLE |
| P182 | 0.89 | 0.91 | 1.29 | 1.31 | EXAMPLE |
| P183 | 0.89 | 0.91 | 1.29 | 1.31 | EXAMPLE |
| P184 | 0.89 | 0.91 | 1.29 | 1.31 | EXAMPLE |
| P185 | 0.89 | 0.91 | 1.29 | 1.31 | EXAMPLE |
| P186 | 0.89 | 0.91 | 1.29 | 1.31 | EXAMPLE |
| P187 | 0.89 | 0.91 | 1.29 | 1.31 | EXAMPLE |
| P188 | 0.89 | 0.91 | 1.29 | 1.31 | EXAMPLE |
| P189 | 0.89 | 0.91 | 1.29 | 1.31 | EXAMPLE |
| P190 | 0.89 | 0.91 | 1.29 | 1.31 | EXAMPLE |
| P191 | 0.89 | 0.91 | 1.29 | 1.31 | EXAMPLE |
| P192 | 0.89 | 0.91 | 1.29 | 1.31 | EXAMPLE |
| P193 | 0.89 | 0.91 | 1.29 | 1.31 | EXAMPLE |
| P194 | 0.89 | 0.91 | 1.29 | 1.31 | EXAMPLE |
| P195 | 0.89 | 0.91 | 1.29 | 1.31 | EXAMPLE |
| P196 | 0.89 | 0.91 | 1.29 | 1.31 | EXAMPLE |
| P197 | 0.89 | 0.91 | 1.29 | 1.31 | EXAMPLE |
| P198 | 0.89 | 0.91 | 1.29 | 1.31 | EXAMPLE |
| P199 | 0.89 | 0.91 | 1.29 | 1.31 | EXAMPLE |
| P200 | 0.89 | 0.91 | 1.29 | 1.31 | EXAMPLE |
| P201 | 0.89 | 0.91 | 1.29 | 1.31 | EXAMPLE |

TABLE 26-continued

| | | | | | |
|---|---|---|---|---|---|
| P202 | 0.89 | 0.91 | 1.29 | 1.31 | EXAMPLE |
| P203 | 0.89 | 0.91 | 1.29 | 1.31 | EXAMPLE |
| P204 | 0.89 | 0.91 | 1.29 | 1.31 | EXAMPLE |
| P205 | 0.89 | 0.91 | 1.29 | 1.31 | EXAMPLE |
| P206 | 0.89 | 0.91 | 1.29 | 1.31 | EXAMPLE |
| P207 | 0.89 | 0.91 | 1.29 | 1.31 | EXAMPLE |
| P208 | 0.89 | 0.91 | 1.29 | 1.31 | EXAMPLE |
| P209 | 0.89 | 0.91 | 1.29 | 1.31 | EXAMPLE |
| P210 | 0.89 | 0.91 | 1.29 | 1.31 | EXAMPLE |
| P211 | 0.89 | 0.91 | 1.29 | 1.31 | EXAMPLE |
| P212 | 0.89 | 0.91 | 1.29 | 1.31 | EXAMPLE |
| P213 | 0.89 | 0.91 | 1.29 | 1.31 | EXAMPLE |
| P214 | 0.89 | 0.91 | 1.29 | 1.31 | EXAMPLE |

| | MECHANICAL PROPERTIES | | | | | | | | |
|---|---|---|---|---|---|---|---|---|---|
| PRODUCTION No. | STANDARD DEVIATION RATIO OF HARDNESS/— | TS/ MPa | u-EL/% | EL/% | λ/% | TS × u-EL/ MPa % | TS × EL/ MPa % | TS × λ/ MPa % | REMARKS |
| P173 | 0.23 | 590 | 12 | 26 | 80.0 | 7080 | 15340 | 47200 | EXAMPLE |
| P174 | 0.23 | 640 | 12 | 26 | 80.0 | 7680 | 16640 | 51200 | EXAMPLE |
| P175 | 0.23 | 720 | 10 | 20 | 75.0 | 7200 | 14400 | 54000 | EXAMPLE |
| P176 | 0.23 | 590 | 12 | 26 | 80.0 | 7080 | 15340 | 47200 | EXAMPLE |
| P177 | 0.23 | 645 | 12 | 26 | 80.0 | 7740 | 16770 | 51600 | EXAMPLE |
| P178 | 0.23 | 720 | 10 | 20 | 75.0 | 7200 | 14400 | 54000 | EXAMPLE |
| P179 | 0.23 | 590 | 12 | 26 | 80.0 | 7080 | 15340 | 47200 | EXAMPLE |
| P180 | 0.23 | 650 | 12 | 26 | 80.0 | 7800 | 16900 | 52000 | EXAMPLE |
| P181 | 0.23 | 720 | 10 | 20 | 75.0 | 7200 | 14400 | 54000 | EXAMPLE |
| P182 | 0.23 | 590 | 12 | 26 | 80.0 | 7080 | 15340 | 47200 | EXAMPLE |
| P183 | 0.23 | 640 | 12 | 26 | 80.0 | 7680 | 16640 | 51200 | EXAMPLE |
| P184 | 0.23 | 710 | 10 | 20 | 75.0 | 7100 | 14200 | 53250 | EXAMPLE |
| P185 | 0.23 | 590 | 12 | 26 | 80.0 | 7080 | 15340 | 47200 | EXAMPLE |
| P186 | 0.23 | 640 | 12 | 26 | 80.0 | 7680 | 16640 | 51200 | EXAMPLE |
| P187 | 0.23 | 780 | 10 | 20 | 75.0 | 7800 | 15600 | 58500 | EXAMPLE |
| P188 | 0.23 | 590 | 12 | 26 | 80.0 | 7080 | 15340 | 47200 | EXAMPLE |
| P189 | 0.23 | 640 | 12 | 26 | 80.0 | 7680 | 16640 | 51200 | EXAMPLE |
| P190 | 0.23 | 590 | 12 | 26 | 80.0 | 7080 | 15340 | 47200 | EXAMPLE |
| P191 | 0.23 | 670 | 12 | 26 | 80.0 | 8040 | 17420 | 53600 | EXAMPLE |
| P192 | 0.23 | 750 | 11 | 23 | 80.0 | 8250 | 17250 | 60000 | EXAMPLE |
| P193 | 0.23 | 780 | 11 | 23 | 75.0 | 8580 | 17940 | 58500 | EXAMPLE |
| P194 | 0.23 | 590 | 12 | 26 | 80.0 | 7080 | 15340 | 47200 | EXAMPLE |
| P195 | 0.23 | 680 | 12 | 26 | 80.0 | 8160 | 17680 | 54400 | EXAMPLE |
| P196 | 0.23 | 780 | 11 | 23 | 80.0 | 8580 | 17940 | 62400 | EXAMPLE |
| P197 | 0.23 | 590 | 12 | 26 | 80.0 | 7080 | 15340 | 47200 | EXAMPLE |
| P198 | 0.23 | 640 | 12 | 26 | 80.0 | 7680 | 16640 | 51200 | EXAMPLE |
| P199 | 0.23 | 700 | 11 | 23 | 75.0 | 7700 | 16100 | 52500 | EXAMPLE |
| P200 | 0.23 | 760 | 10 | 20 | 75.0 | 7600 | 15200 | 57000 | EXAMPLE |
| P201 | 0.23 | 590 | 12 | 26 | 80.0 | 7080 | 15340 | 47200 | EXAMPLE |
| P202 | 0.23 | 590 | 12 | 26 | 80.0 | 7080 | 15340 | 47200 | EXAMPLE |
| P203 | 0.23 | 590 | 12 | 26 | 80.0 | 7080 | 15340 | 47200 | EXAMPLE |
| P204 | 0.23 | 640 | 11 | 24 | 65.0 | 7040 | 15360 | 41600 | EXAMPLE |
| P205 | 0.23 | 590 | 12 | 26 | 80.0 | 7080 | 15340 | 47200 | EXAMPLE |
| P206 | 0.23 | 590 | 12 | 26 | 80.0 | 7080 | 15340 | 47200 | EXAMPLE |
| P207 | 0.23 | 590 | 12 | 26 | 80.0 | 7080 | 15340 | 47200 | EXAMPLE |
| P208 | 0.23 | 640 | 11 | 24 | 65.0 | 7040 | 15360 | 41600 | EXAMPLE |
| P209 | 0.23 | 590 | 12 | 26 | 80.0 | 7080 | 15340 | 47200 | EXAMPLE |
| P210 | 0.23 | 590 | 12 | 26 | 80.0 | 7080 | 15340 | 47200 | EXAMPLE |
| P211 | 0.23 | 640 | 11 | 23 | 65.0 | 7040 | 14720 | 41600 | EXAMPLE |
| P212 | 0.23 | 590 | 12 | 26 | 80.0 | 7080 | 15340 | 47200 | EXAMPLE |
| P213 | 0.23 | 590 | 12 | 26 | 80.0 | 7080 | 15340 | 47200 | EXAMPLE |
| P214 | 0.23 | 640 | 11 | 23 | 65.0 | 7040 | 14720 | 41600 | EXAMPLE |

| | OTHERS | | | |
|---|---|---|---|---|
| PRODUCTION No. | d/RmC/— | Rm45/ RmC/— | TS/fM × dis/dia/— | REMARKS |
| P173 | 1.2 | 1.7 | 676 | EXAMPLE |
| P174 | 1.1 | 1.8 | 733 | EXAMPLE |
| P175 | 1.0 | 2.0 | 825 | EXAMPLE |
| P176 | 1.2 | 1.7 | 676 | EXAMPLE |
| P177 | 1.1 | 1.8 | 739 | EXAMPLE |
| P178 | 1.0 | 2.0 | 825 | EXAMPLE |
| P179 | 1.2 | 1.7 | 676 | EXAMPLE |
| P180 | 1.1 | 1.8 | 745 | EXAMPLE |
| P181 | 1.0 | 2.0 | 825 | EXAMPLE |
| P182 | 1.2 | 1.7 | 676 | EXAMPLE |
| P183 | 1.1 | 1.8 | 733 | EXAMPLE |

TABLE 26-continued

| | | | | |
|---|---|---|---|---|
| P184 | 1.0 | 2.0 | 814 | EXAMPLE |
| P185 | 1.2 | 1.7 | 676 | EXAMPLE |
| P186 | 1.1 | 1.8 | 733 | EXAMPLE |
| P187 | 1.0 | 2.0 | 894 | EXAMPLE |
| P188 | 1.2 | 1.7 | 676 | EXAMPLE |
| P189 | 1.1 | 1.8 | 733 | EXAMPLE |
| P190 | 1.2 | 1.7 | 676 | EXAMPLE |
| P191 | 1.2 | 1.7 | 768 | EXAMPLE |
| P192 | 1.2 | 1.7 | 859 | EXAMPLE |
| P193 | 1.1 | 1.8 | 894 | EXAMPLE |
| P194 | 1.2 | 1.7 | 676 | EXAMPLE |
| P195 | 1.2 | 1.7 | 779 | EXAMPLE |
| P196 | 1.1 | 1.8 | 894 | EXAMPLE |
| P197 | 1.2 | 1.7 | 676 | EXAMPLE |
| P198 | 1.2 | 1.7 | 733 | EXAMPLE |
| P199 | 1.1 | 1.8 | 802 | EXAMPLE |
| P200 | 1.0 | 2.0 | 871 | EXAMPLE |
| P201 | 1.2 | 1.7 | 676 | EXAMPLE |
| P202 | 1.2 | 1.7 | 676 | EXAMPLE |
| P203 | 1.2 | 1.7 | 676 | EXAMPLE |
| P204 | 1.1 | 1.8 | 733 | EXAMPLE |
| P205 | 1.2 | 1.7 | 676 | EXAMPLE |
| P206 | 1.2 | 1.7 | 676 | EXAMPLE |
| P207 | 1.2 | 1.7 | 676 | EXAMPLE |
| P208 | 1.1 | 1.8 | 733 | EXAMPLE |
| P209 | 1.2 | 1.7 | 676 | EXAMPLE |
| P210 | 1.2 | 1.7 | 676 | EXAMPLE |
| P211 | 1.0 | 2.0 | 733 | EXAMPLE |
| P212 | 1.2 | 1.7 | 676 | EXAMPLE |
| P213 | 1.2 | 1.7 | 676 | EXAMPLE |
| P214 | 1.0 | 2.0 | 733 | EXAMPLE |

INDUSTRIAL APPLICABILITY

According to the above aspects of the present invention, it is possible to obtain the cold-rolled steel sheet which simultaneously has the high-strength, the excellent uniform deformability, the excellent local deformability, and the excellent Lankford-value. Accordingly, the present invention has significant industrial applicability.

The invention claimed is:

1. A method for producing a cold-rolled steel sheet, comprising:

first-hot-rolling a steel in a temperature range of 1000° C. to 1200° C. under conditions such that at least one pass whose reduction is 40% or more is included so as to control an average grain size of an austenite in the steel to 200 μm or less, wherein the steel includes, as a chemical composition, by mass %, C: 0.01% to 0.4%, Si: 0.001% to 2.5%, Mn: 0.001% to 4.0%, Al: 0.001% to 2.0%, P: limited to 0.15% or less, S: limited to 0.03% or less, N: limited to 0.01% or less, O: limited to 0.01% or less, and a balance consisting of Fe and unavoidable impurities;

second-hot-rolling the steel under conditions such that, when a temperature calculated by a following Expression 4 is defined as T1 in unit of ° C. and a ferritic transformation temperature calculated by a following Expression 5 is defined as $Ar_3$ in unit of ° C., a large reduction pass whose reduction is 30% or more in a temperature range of T1+30° C. to T1+200° C. is included, a cumulative reduction in the temperature range of T1+30° C. to T1+200° C. is 50% or more, a cumulative reduction in a temperature range of $Ar_3$ to lower than T1+30° C. is limited to 30% or less, and a rolling finish temperature is $Ar_3$ or higher;

first-cooling the steel under conditions such that, when a waiting time from a finish of a final pass in the large reduction pass to a cooling start is defined as t in unit of second, the waiting time t satisfies a following Expression 6, an average cooling rate is 50° C./second or faster, a cooling temperature change which is a difference between a steel temperature at the cooling start and a steel temperature at a cooling finish is 40° C. to 140° C., and the steel temperature at the cooling finish is T1+100° C. or lower;

second-cooling the steel to a temperature range of a room temperature to 600° C. after finishing the second-hot-rolling;

coiling the steel in the temperature range of the room temperature to 600° C.;

pickling the steel;

cold-rolling the steel under a reduction of 30% to 70%;

heating-and-holding the steel in a temperature range of 750° C. to 900° C. for 1 second to 1000 seconds;

third-cooling the steel to a temperature range of 580° C. to 720° C. under an average cooling rate of 1° C./second to 12° C./second;

fourth-cooling the steel to a temperature range of 200° C. to 600° C. under an average cooling rate of 4° C./second to 300° C./second; and holding the steel as an overageing treatment under conditions such that, when an overageing temperature is defined as T2 in unit of ° C. and an overageing holding time dependent on the overageing temperature T2 is defined as t2 in unit of second, the overageing temperature T2 is within a temperature range of 200° C. to 600° C. and the overageing holding time t2 satisfies a following Expression 8, $$T1=850+10\times([C]+[N])\times[Mn] \quad \text{(Expression 4)},$$

here, [C], [N], and [Mn] represent mass percentages of C, N, and Mn respectively, $$Ar_3=879.4-516.1\times[C]-65.7\times[Mn]+38.0\times[Si]+274.7\times[P] \quad \text{(Expression 5)},$$

here, in Expression 5, [C], [Mn], [Si] and [P] represent mass percentages of C, Mn, Si, and P respectively, $$t\leq 2.5\times t1 \quad \text{(Expression 6)},$$

here, t1 is represented by a following Expression 7, $$t1=0.001\times((Tf-T1)\times P1/100)^2-0.109\times((Tf-T1)\times P1/100)+3.1 \quad \text{(Expression 7)},$$

here, Tf represents a celsius temperature of the steel at the finish of the final pass, and P1 represents a percentage of a reduction at the final pass, $$\log(t2)\leq 0.0002\times(T2-425)^2+1.18 \quad \text{(Expression 8)}.$$

2. The method for producing the cold-rolled steel sheet according to claim 1, wherein the steel further includes, as the chemical composition, by mass %, at least one selected from the group consisting of Ti: 0.001% to 0.2%,
Nb: 0.001% to 0.2%,
B: 0.0001% to 0.005%,
Mg: 0.0001% to 0.01%,
Rare Earth Metal: 0.0001% to 0.1%,
Ca: 0.0001% to 0.01%,
Mo: 0.001% to 1.0%,
Cr: 0.001% to 2.0%,
V: 0.001% to 1.0%,
Ni: 0.001% to 2.0%,
Cu: 0.001% to 2.0%,
Zr: 0.0001% to 0.2%,
W: 0.001% to 1.0%,
As: 0.0001% to 0.5%,
Co: 0.0001% to 1.0%,
Sn: 0.0001% to 0.2%,
Pb: 0.0001% to 0.2%,
Y: 0.001% to 0.2%, and
Hf: 0.001% to 0.2%, wherein a temperature calculated by a following Expression 9 is substituted for the temperature calculated by the Expression 4 as T1, $$T1=850+10\times([C]+[N])\times[Mn]+350\times[Nb]+250\times[Ti]+40\times[B]+10\times[Cr]+100\times[Mo]+100\times[V] \quad \text{(Expression 9)},$$

here, [C], [N], [Mn], [Nb], [Ti], [B], [Cr], [Mo], and [V] represent mass percentages of C, N, Mn, Nb, Ti, B, Cr, Mo, and V respectively.

3. The method for producing the cold-rolled steel sheet according to claim 1 or 2, wherein the waiting time t further satisfies a following Expression 10, $$0\leq t<t1 \quad \text{(Expression 10)}.$$

4. The method for producing the cold-rolled steel sheet according to claim 1 or 2, wherein the waiting time t further satisfies a following Expression 11, $$t1\leq t\leq t1\times 2.5 \quad \text{(Expression 11)}.$$

5. The method for producing the cold-rolled steel sheet according to claim 1 or 2, wherein, in the first-hot-rolling, at least two times of rollings whose reduction is 40% or more are conducted, and the average grain size of the austenite is controlled to 100 μm or less.

6. The method for producing the cold-rolled steel sheet according to claim 1 or 2, wherein the second-cooling starts within 3 seconds after finishing the second-hot-rolling.

7. The method for producing the cold-rolled steel sheet according to claim 1 or 2, wherein, in the second-hot-rolling, a temperature rise of the steel between passes is 18° C. or lower.

8. The method for producing the cold-rolled steel sheet according to claim 1 or 2, wherein the first-cooling is conducted at an interval between rolling stands.

9. The method for producing the cold-rolled steel sheet according to claim 1 or 2, wherein a final pass of rollings in the temperature range of T1+30° C. to T1+200° C. is the large reduction pass.

10. The method for producing the cold-rolled steel sheet according to claim 1 or 2, wherein, in the second-cooling, the steel is cooled under an average cooling rate of 10° C./second to 300° C./second.

11. The method for producing the cold-rolled steel sheet according to claim 1 or 2, wherein a galvanizing is conducted after the overageing treatment.

12. The method for producing the cold-rolled steel sheet according to claim 1 or 2, wherein: a galvanizing is conducted after the overageing treatment; and a heat treatment is conducted in a temperature range of 450° C. to 600° C. after the galvanizing.

13. A method for producing a cold-rolled steel sheet, comprising:

first-hot-rolling a steel in a temperature range of 1000° C. to 1200° C. under conditions such that at least one pass whose reduction is 40% or more is included so as to control an average grain size of an austenite in the steel to 200 μm or less, wherein the steel includes, as a chemical composition, by mass %, C: 0.01% to 0.4%,
Si: 0.001% to 2.5%,
Mn: 0.001% to 4.0%,
Al: 0.001% to 2.0%,
P: limited to 0.15% or less,
S: limited to 0.03% or less,
N: limited to 0.01% or less,
O: limited to 0.01% or less, and
a balance comprising Fe and unavoidable impurities;

second-hot-rolling the steel under conditions such that, when a temperature calculated by a following Expression 4 is defined as T1 in unit of ° C. and a ferritic transformation temperature calculated by a following Expression 5 is defined as $Ar_3$ in unit of ° C., a large reduction pass whose reduction is 30% or more in a temperature range of T1+30° C. to T1+200° C. is included, a cumulative reduction in the temperature range of T1+30° C. to T1+200° C. is 50% or more, a cumulative reduction in a temperature range of $Ar_3$ to lower than T1+30° C. is limited to 30% or less, and a rolling finish temperature is $Ar_3$ or higher;

first-cooling the steel under conditions such that, when a waiting time from a finish of a final pass in the large reduction pass to a cooling start is defined as t in unit of second, the waiting time t satisfies a following Expression 6, an average cooling rate is 50° C./second or faster, a cooling temperature change which is a difference between a steel temperature at the cooling start and a steel temperature at a cooling finish is 40° C.

to 140° C., and the steel temperature at the cooling finish is T1+100° C. or lower;

second-cooling the steel to a temperature range of a room temperature to 600° C. after finishing the second-hot-rolling;

coiling the steel in the temperature range of the room temperature to 600° C.;

pickling the steel;

cold-rolling the steel under a reduction of 30% to 70%;

heating-and-holding the steel in a temperature range of 750° C. to 900° C. for 1 second to 1000 seconds;

third-cooling the steel to a temperature range of 580° C. to 720° C. under an average cooling rate of 1° C./second to 12° C./second;

fourth-cooling the steel to a temperature range of 200° C. to 600° C. under an average cooling rate of 4° C./second to 300° C./second; and holding the steel as an overageing treatment under conditions such that, when an overageing temperature is defined as T2 in unit of ° C. and an overageing holding time dependent on the overageing temperature T2 is defined as t2 in unit of second, the overageing temperature T2 is within a temperature range of 200° C. to 600° C. and the overageing holding time t2 satisfies a following Expression 8, $$T1=850+10\times([C]+[N])\times[Mn] \quad \text{(Expression 4)},$$

here, [C], [N], and [Mn] represent mass percentages of C, N, and Mn respectively, $$Ar_3=879.4-516.1\times[C]-65.7\times[Mn]+38.0\times[Si]+274.7\times[P] \quad \text{(Expression 5)},$$

here, in Expression 5, [C], [Mn], [Si] and [P] represent mass percentages of C, Mn, Si, and P respectively, $$t\leq 2.5\times t1 \quad \text{(Expression 6)},$$

here, t1 is represented by a following Expression 7, $$t1=0.001\times((Tf-T1)\times P1/100)^2-0.109\times((Tf-T1)\times P1/100)+3.1 \quad \text{(Expression 7)},$$

here, Tf represents a celsius temperature of the steel at the finish of the final pass, and P1 represents a percentage of a reduction at the final pass, $$\log(t2)\leq 0.0002\times(T2-425)^2+1.18 \quad \text{(Expression 8)}.$$

* * * * *